US011613890B2

(12) United States Patent
Schofield

(10) Patent No.: US 11,613,890 B2
(45) Date of Patent: Mar. 28, 2023

(54) MODULAR BUILDING SYSTEM

(71) Applicant: Schofield Technologies, Inc., Dearborn, MI (US)

(72) Inventor: William J. Schofield, Dearborn, MI (US)

(73) Assignee: Schofield Technologies, Inc., Dearborn, MI (US)

( * ) Notice: Subject to any disclaimer, the term of this patent is extended or adjusted under 35 U.S.C. 154(b) by 0 days.

(21) Appl. No.: 17/748,667

(22) Filed: May 19, 2022

(65) Prior Publication Data

US 2022/0275637 A1 Sep. 1, 2022

Related U.S. Application Data

(63) Continuation of application No. PCT/US2021/034356, filed on May 26, 2021.

(60) Provisional application No. 63/030,291, filed on May 26, 2020.

(51) Int. Cl.
*E04B 2/18* (2006.01)
*E04B 2/02* (2006.01)

(52) U.S. Cl.
CPC ..... *E04B 2/18* (2013.01); *E04B 2002/0204* (2013.01)

(58) Field of Classification Search
CPC ..... E04B 2/18; E04B 2/30; E04B 2/32; E04B 2002/0204; E04B 2002/0206
See application file for complete search history.

(56) References Cited

U.S. PATENT DOCUMENTS 2,942,454 A * 6/1960 Jackson ..... E04B 2/56 52/249
3,390,497 A * 7/1968 Longinotti ..... E04B 1/4185 52/320
4,229,920 A * 10/1980 Lount ..... E04C 2/205 52/426

(Continued)

FOREIGN PATENT DOCUMENTS

FR 2845410 A1 * 4/2004 ..... E04C 1/397

OTHER PUBLICATIONS

International Search Report and Written Opinion for International Application No. PCT/US2021/034356, dated Sep. 10, 2021.

*Primary Examiner* — Christine T Cajilig
(74) *Attorney, Agent, or Firm* — Quinn IP Law

(57) ABSTRACT

A modular wall building system includes a plurality of course modules which can be connected to form a wall such as a wall of a building structure. A course module includes inner and outer wall panels connected by upper and lower panel connectors via connector pins which are received by receiving rails extending from interior surfaces of the inner and outer wall panels. The course modules include wall course modules, bottom course modules and top course modules. Door and window modules can be installed to the building structure by attachment to the course modules. The panel connectors include structural openings for receiving vertical structural members. The wall building system includes a bottom plate structure and tie down system for attachment of the wall structure to a foundation, and a top plate structure including truss connectors for attaching a roof structure. A method of forming a wall structure is provided.

28 Claims, 38 Drawing Sheets

(56) References Cited

U.S. PATENT DOCUMENTS

| | | | | |
|---|---|---|---|---|
| 4,698,947 | A * | 10/1987 | McKay | E04B 2/8641 52/564 |
| 6,122,880 | A * | 9/2000 | Kolb | E04C 2/34 52/503 |
| 9,234,347 | B2 * | 1/2016 | Cossette | E04B 2/8611 |
| 10,190,313 | B1 | 1/2019 | Toledo | |
| 2007/0119115 | A1 | 5/2007 | Negron | |
| 2009/0188186 | A1 | 7/2009 | Ebanks | |
| 2010/0236179 | A1 * | 9/2010 | Kim | E04B 2/44 52/745.1 |
| 2016/0281357 | A1 | 9/2016 | Aribas et al. | |

* cited by examiner

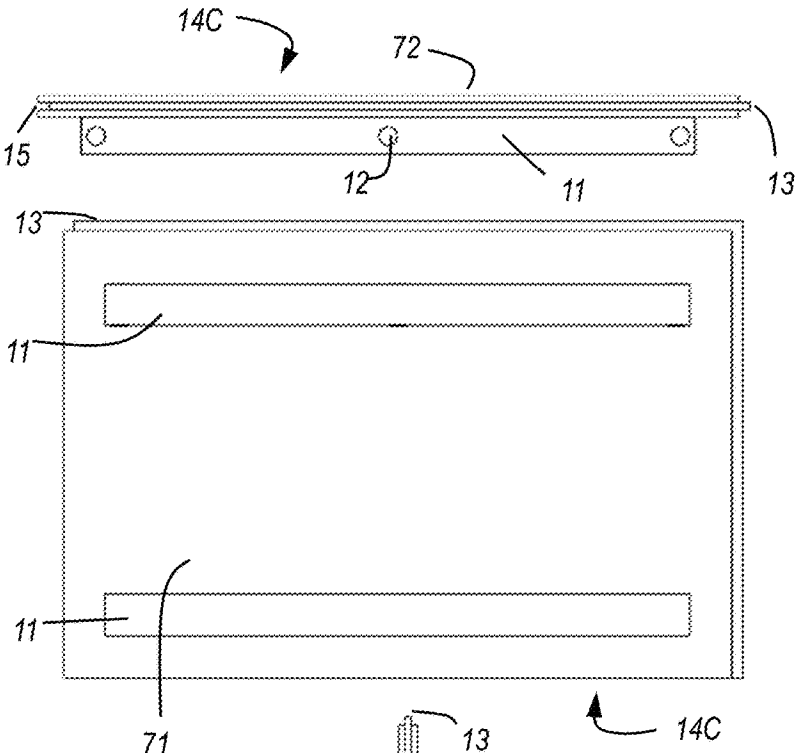
FIG. 3B
FIG. 3C
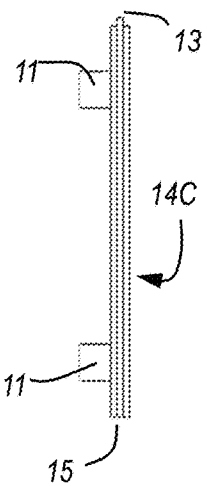
FIG. 3D
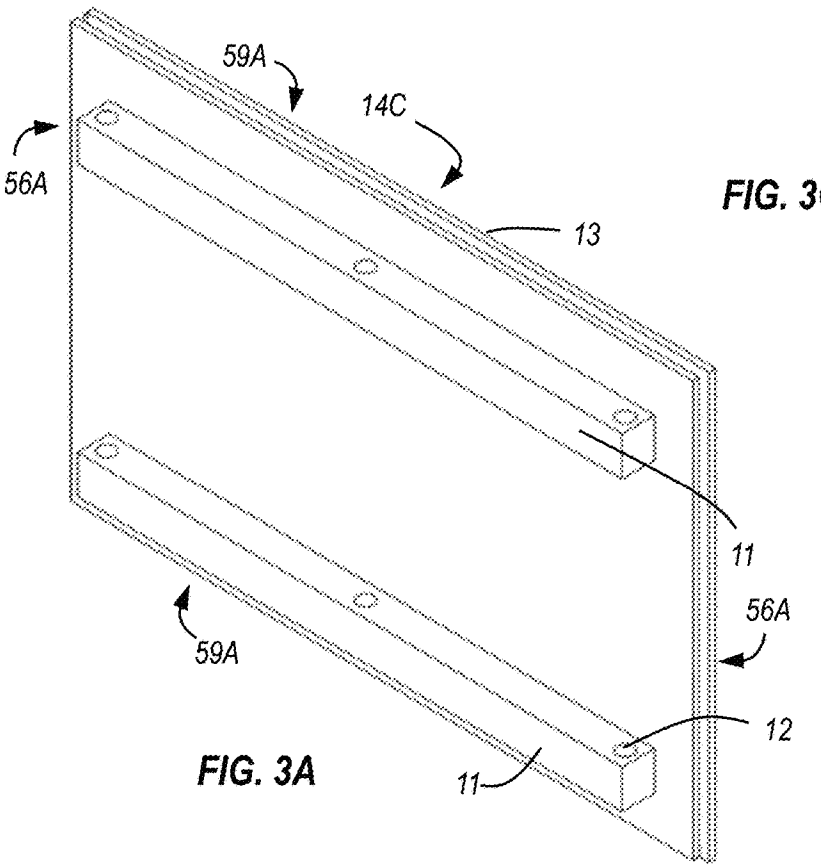
FIG. 3A 24
12
15

24
11
25

13
24
11
25

56B
25
75
13
59C
11
24
56B

MODULAR BUILDING SYSTEM

CROSS-REFERENCE TO RELATED APPLICATION

This application claims priority to and the benefit of International Patent Application PCT/US2021/034356 filed May 26, 2021, and U.S. Provisional Application No. 63/030,291 filed May 26, 2020, all of which are hereby incorporated by reference in their entirety.

TECHNICAL FIELD

The present disclosure pertains to modular building construction, more specifically in the direction of a lightweight modular rigid wall system for use in the areas of construction of temporary shelters, storage units, property demarcation, emergency facilities, and similar facilities for the military, homeowner, and displaced person.

BACKGROUND

The sheltering of people and goods in temporary structures has been a human concern and need since the beginning of modern time. The need for shelter and storage due to natural disasters, political displacement, war, and the general need for additional space has long plagued those in need of it on how to achieve it in an easy, cost effective way.

Standard methods for the sheltering and storage of people and goods are typically contained within two primary groupings: Soft Wall Structures (tents and the like), and Rigid Wall Structures (shipping containers, framed walls, pre-fab structures and the like). Each of these solutions solves a problem, but introduces a multitude of other problems during their use. Tents and soft sided tarp and canvas structures deteriorate in the elements, provide no, or limited, structural capacity, have essentially no thermal efficiency, are typically ground based (direct contact with the ground), and must be replaced frequently to remain even the least bit effective for providing coverage to people and goods. Rigid structures can solve the problems of thermal efficiency and structural capacity, but are currently heavy to move and assemble, expensive, more complex than a tent to assemble, fixed use (once in place it will typically stay in place), typically requires equipment and power to assemble, and are not conducive to rapid deployment in areas without ease of accessibility, power, or a skilled workforce capable of lifting, maneuvering, and assembling these heavy rigid structures.

The current available solutions are disadvantaged by being not versatile enough to accommodate the advantages from their competitors' spaces. Rigid and soft wall systems will continue to have the same advantages and disadvantages with a clear lack of versatility to accommodate the best of each in a single system.

SUMMARY

A rigid wall modular system which is as lightweight, transportable and as easy to assemble as a tent, but strong enough to support structural loading, wind loads, thermal events (on a global scale), and a method of construction of a rigid wall structure using the rigid wall modular system, and which can be assembled without the use of power tools, or electrical power, and without the use of skilled trades persons, is disclosed herein. The lightweight modular rigid wall system described herein is usable in the areas of construction of temporary shelters, storage units, property demarcation, emergency facilities, and similar facilities for the military, homeowner, and displaced person. The rigid wall modular system is comprised of lightweight components which can be assembled without the use of power tools, without electrical power, and by unskilled labor, including, for example, local persons displaced by natural or manmade disaster, or otherwise in need of shelter, storage structures, or other rigid wall structures. The rigid wall structures assembled using the lightweight components described herein can be assembled by assembling a plurality of course modules in a layered arrangement, the layered course modules in a first configuration to provide a first wall structure in a first location, disassembled, transported, and reassembled in a second location, in either the same first configuration to provide a reassembled first wall structure at the second location, or in a different configuration to provide a second wall structure in the second location, such that the components can be provided as a kit or in bulk for use in building multiple wall structures of differing configurations, according to the then existing needs and conditions, which can be disassembled and relocated and/or reconfigured into new structures as needed in response to changing needs and/or conditions. The components comprising the rigid wall modular system are formed from lightweight materials including, for example, polymer based materials, polymer composites, lightweight metals such as aluminum, ballistic materials such as Kevlar or carbon fiber reinforced materials, such that the components described herein are readily formable by molding, extrusion, stamping, etc., and such that the components described herein can be fabricated at relatively low cost, and in some example, can be made of materials which are environmentally neutral and/or recyclable. Further, due to the lightweight characteristics of the components, transportation costs are comparatively low, and transport by any available means, including air drop or manual transport into locations not accessible by vehicle, is feasible.

A course module for a modular wall building system, is described herein, each course module comprising at least one inner wall panel; at least one outer wall panel. Each of the inner wall panels and each of the outer wall panels comprises: upper and lower receiving rails extending from an interior surface of the wall panel; each of the receiving rails including a plurality of receiver holes; a first longitudinal panel edge adjacent a first lateral panel edge; a second longitudinal panel edge opposing the first longitudinal panel edge and adjacent a second lateral panel edge, the second lateral panel edge opposing the first lateral panel edge; a panel tongue defined by the first longitudinal panel edge and the first lateral panel edge; a panel groove extending from the second longitudinal panel edge and the second lateral panel edge; wherein the panel tongue defined by the first lateral panel edge of a respective inner panel is inserted into the panel groove of an adjacent inner panel to form a panel joint therebetween connecting the respective and adjacent inner panels; wherein the panel tongue defined by the first lateral panel edge of a respective inner panel is inserted into the panel groove extending from the second lateral panel edge of an adjacent inner panel to define a panel joint therebetween connecting the respective and adjacent inner panels; wherein the panel tongue defined by the first lateral panel edge of a respective outer panel is inserted into the panel groove extending from the second lateral panel edge of an adjacent outer panel to form a panel joint therebetween connecting the respective and adjacent outer panels; panel connectors; wherein each of the panel connectors comprises:

a first longitudinal connector edge positioned adjacent a first lateral connector edge; a second longitudinal edge opposing the first longitudinal edge and positioned adjacent a second lateral connector edge, the second lateral connector edge opposing the first lateral connector edge; a first plurality of connector pins extending from the panel connector and distributed along the first longitudinal connector edge; a second plurality of connector pins extending from the panel connector and distributed along the second longitudinal connector edge; wherein each of the first and second plurality of connector pins are configured to be received into the receiver holes of the receiving rail thereby attaching the panel connector to the receiving rail; wherein each of the panel connectors are disposed between the inner wall panels and the outer wall panels and connected via the connector pins to the receiving rails such that each panel connector is at least one of: an upper panel connector attached to the upper receiving rails of the respective and adjacent inner wall panels and to the upper receiving rails of the respective and adjacent outer wall panels; or a lower panel connector attached to the lower receiving rails of the respective and adjacent inner wall panels and to the lower receiving rails of the respective and adjacent outer wall panels; wherein the upper panel connector is positioned such that: the first longitudinal connector edge of the upper panel connector is connected to the upper receiving rails of the respective and adjacent inner panels such that the upper panel connector spans the first panel joint and connects the upper receiving rail of the first inner panel to the second inner panel; and the second longitudinal connector edge of the upper panel connector is connected to the upper receiving rails of the respective and adjacent outer panels such that the upper panel connector spans the second panel joint and connects the upper receiving rail of the first outer panel to the second outer panel; and wherein the lower panel connector is positioned such that: the first longitudinal connector edge of the lower panel connector is connected to the lower receiving rails of the respective and adjacent inner panels such that the lower panel connector spans the first panel joint and connects the lower receiving rail of the first inner panel to the second inner panel; the second longitudinal connector edge of the lower panel connector is connected to the lower receiving rails of the respective and adjacent outer panels such that the lower panel connector spans the second panel joint and connects the lower receiving rail of the first outer panel to the second outer panel.

A modular wall building system including a plurality of course modules as described herein is provided, wherein the plurality of course modules are layered to form a wall structure; each respective course module layered adjacent to another course module such that each course module is connected to the another course module by connection of the panel tongues of the wall panels of one of the respective course module and the another course module into the panel grooves of the wall panels of the other of the respective course module and the another course module to form the wall structure.

A method for assembling a modular wall building system including a plurality of course modules as described herein is provided, the method comprising: providing a plurality of course modules; layering a respective course module on to another course module; connecting each respective course module to the another course module via insertion of the panel tongues of the wall panels of one of the respective course module and the another course module into the panel grooves of the wall panels of the other of the respective course module and the another course module.

The above noted and other features and advantages of the present disclosure are readily apparent from the following detailed description when taken in connection with the accompanying drawings.

BRIEF DESCRIPTION OF THE DRAWINGS

FIG. 3A is a schematic isometric view of a partial length outer wall panel including upper and lower receiving rails for assembling a course module for the modular wall building system as described herein;

FIG. 3B is a schematic top view of the wall panel of FIG. 3A showing the receiving rails extending from an interior surface of the wall panel of FIG. 3A;

FIG. 3C is a schematic side view of an interior surface of the outer wall panel of FIG. 3A showing the upper and lower receiving rails integrated to the wall panel;

FIG. 3D is a schematic end view of the wall panel of FIG. 3A;

DETAILED DESCRIPTION

Figure 1B:
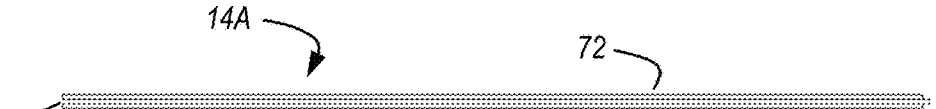
FIG. 1B is a schematic top view of the wall panel of FIG. 1A showing the receiving rails extending from an interior surface of the wall panel of FIG. 1A.
Figure 1C:
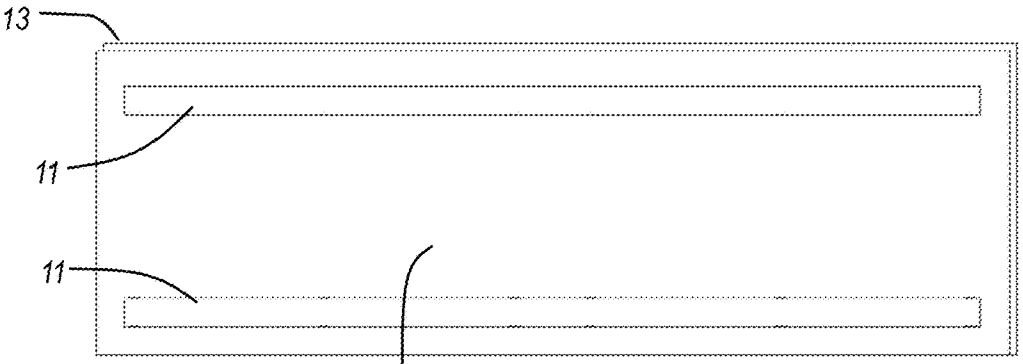
FIG. 1C is a schematic side view of an interior surface of the outer wall panel of FIG. 1A showing the upper and lower receiving rails integrated to the wall panel.
Figure 1D:
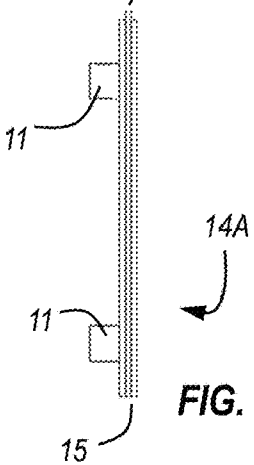
FIG. 1D is a schematic end view of the wall panel of FIG. 1A.
Figure 1A:
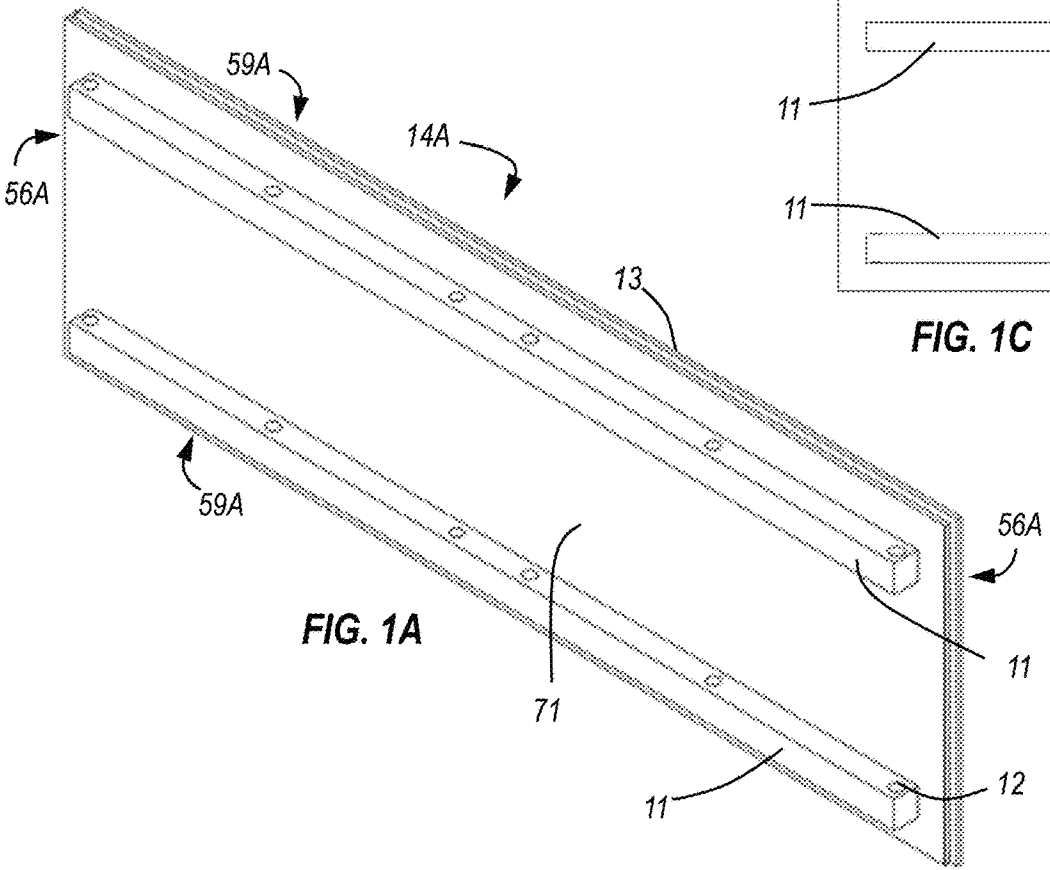
FIG. 1A is a schematic isometric view of a full length outer wall panel including upper and lower receiving rails for assembling a course module for a modular wall building system as described herein.
Figure 2B:
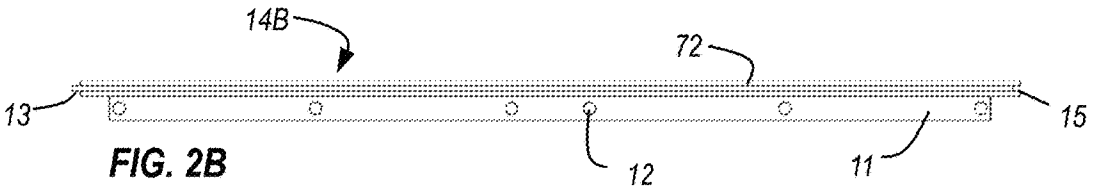
FIG. 2B is a schematic top view of the wall panel of FIG. 2A showing the receiving rails extending from an interior surface of the wall panel of FIG. 2A.
Figure 2C:
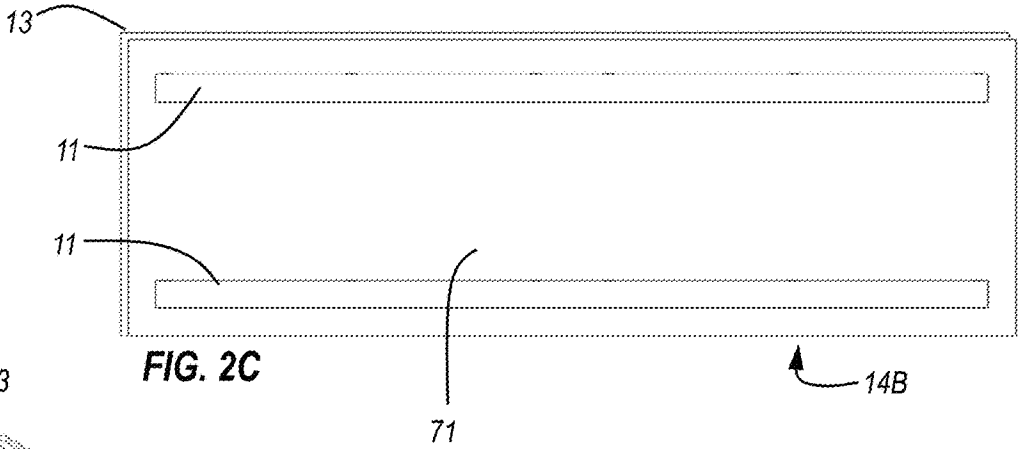
FIG. 2C is a schematic side view of an interior surface of the outer wall panel of FIG. 2A showing the upper and lower receiving rails integrated to the wall panel.
Figure 2D:
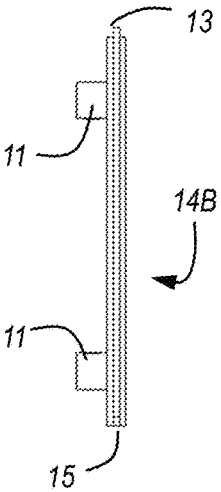
FIG. 2D is a schematic end view of the wall panel of FIG. 2A.
Figure 2A:
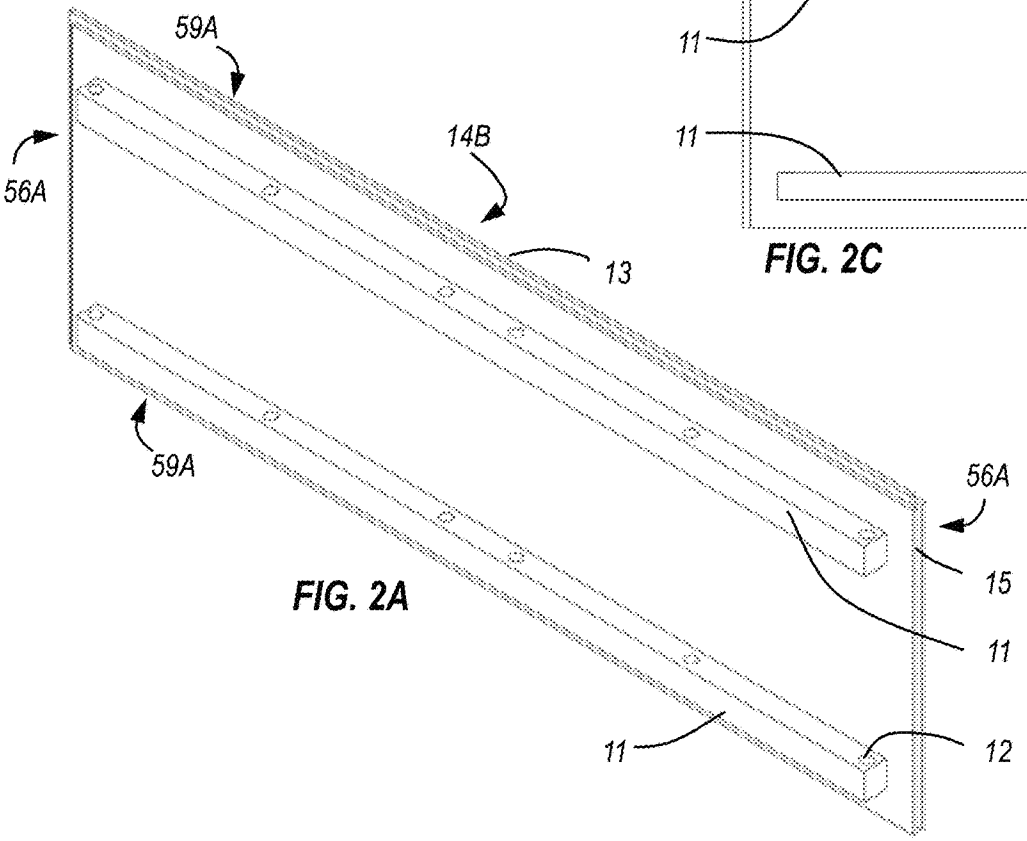
FIG. 2A is a schematic isometric view of a full length inner wall panel including upper and lower receiving rails for assembling a course module for the modular wall building system as described herein.
Figure 4B:
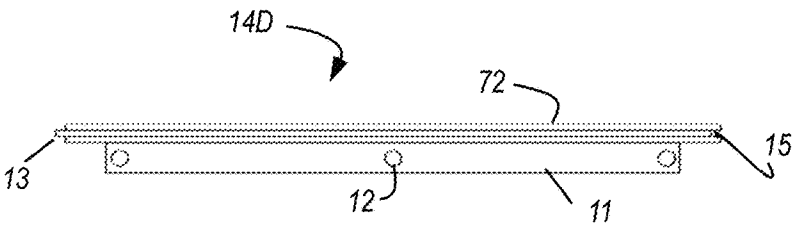
FIG. 4B is a schematic top view of the wall panel of FIG. 4A showing the receiving rails extending from an interior surface of the wall panel of FIG. 4A.
Figure 4C:
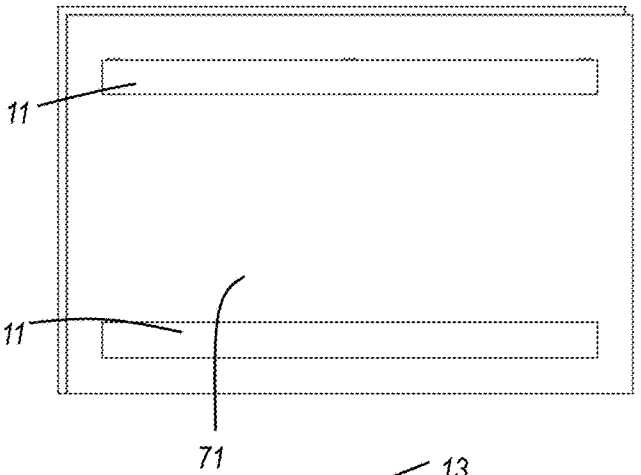
FIG. 4C is a schematic side view of an interior surface of the outer wall panel of FIG. 4A showing the upper and lower receiving rails integrated to the wall panel.
Figure 4D:
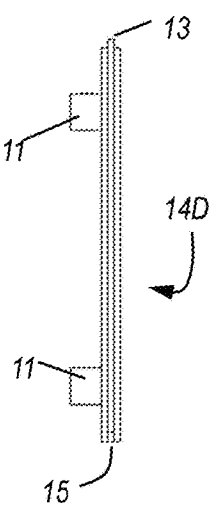
FIG. 4D is a schematic end view of the wall panel of FIG. 4A.
Figure 4A:
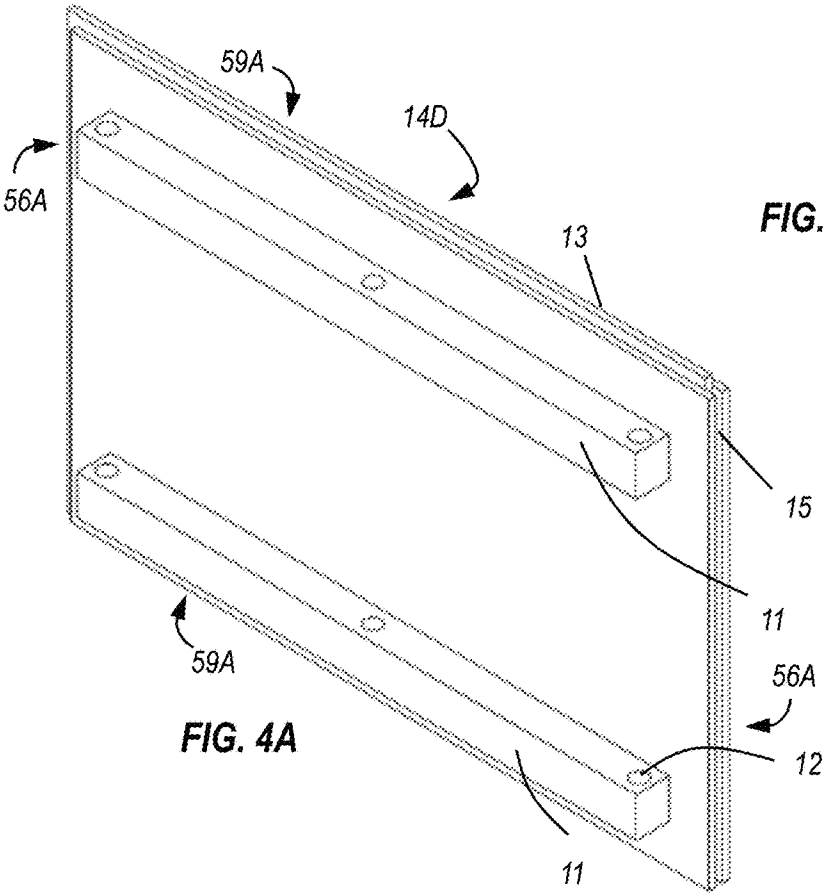
FIG. 4A is schematic isometric view of a partial length inner wall panel including upper and lower receiving rails for assembling a course module for the modular wall building system as described herein.
Figure 5B:
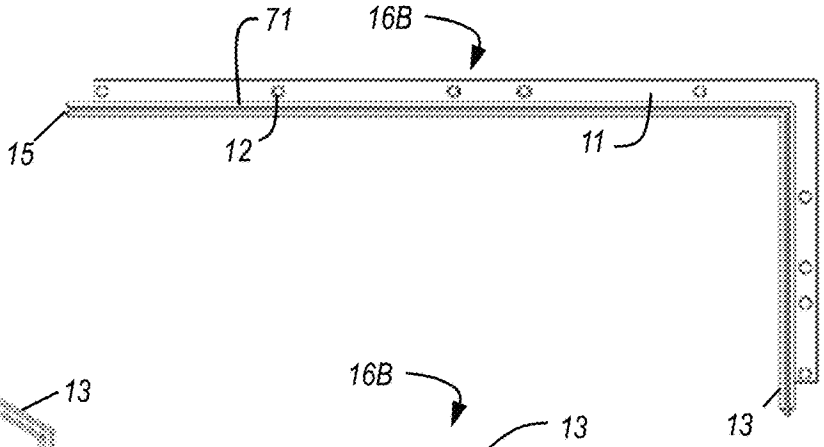
FIG. 5B is a schematic top view of the wall panel of FIG. 5A.
Figure 5C:
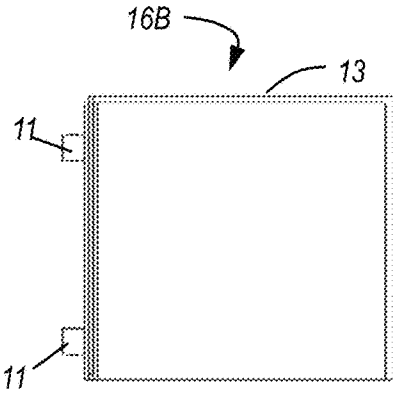
FIG. 5C is a schematic end view of the inner corner panel showing the dual rail locations in relation to the panel boundaries and to each other.
Figure 5D:
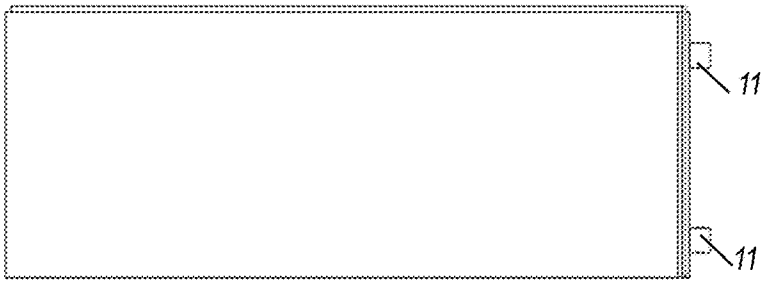
FIG. 5D is a schematic end view of the wall panel of FIG. 5A.
Figure 5A:
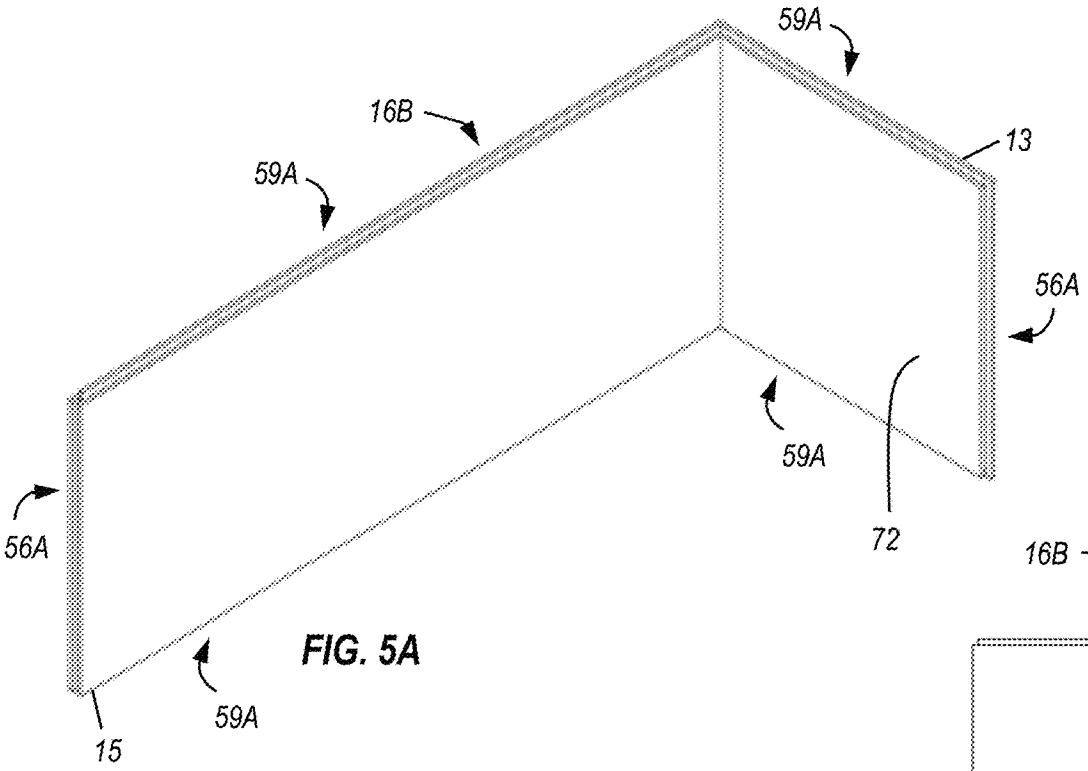
FIG. 5A is schematic isometric view of an inner corner wall panel including upper and lower receiving rails for assembling a course module for the modular wall building system as described herein.
Figure 6B:
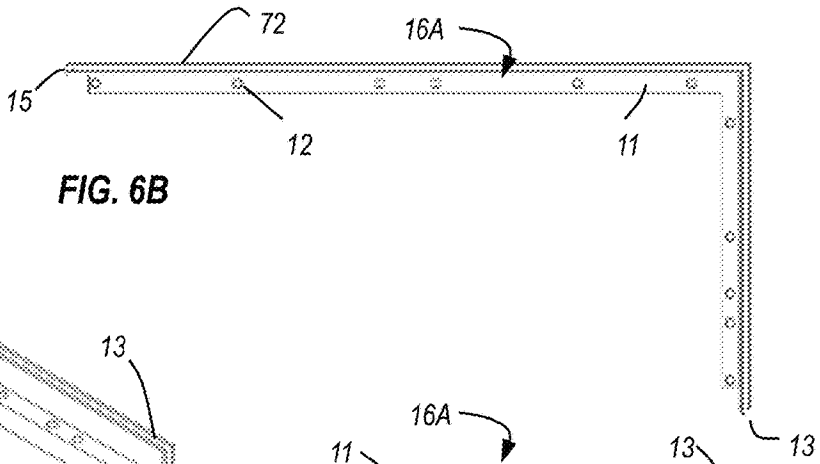
FIG. 6B is a schematic top view of the wall panel of FIG. 6A.
Figure 6C:
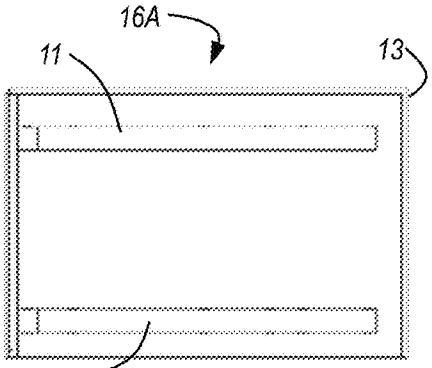
FIG. 6C is a schematic end view of the outer corner panel showing the dual rail locations in relation to the panel boundaries and to each other.
Figure 6D:
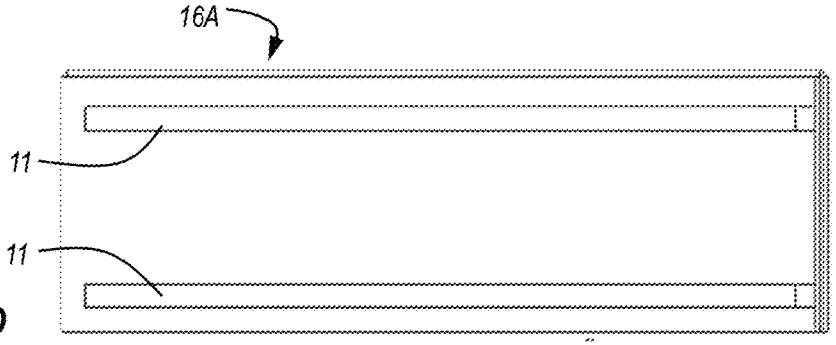
FIG. 6D is a schematic end view of the wall panel of FIG. 6A.
Figure 6A:
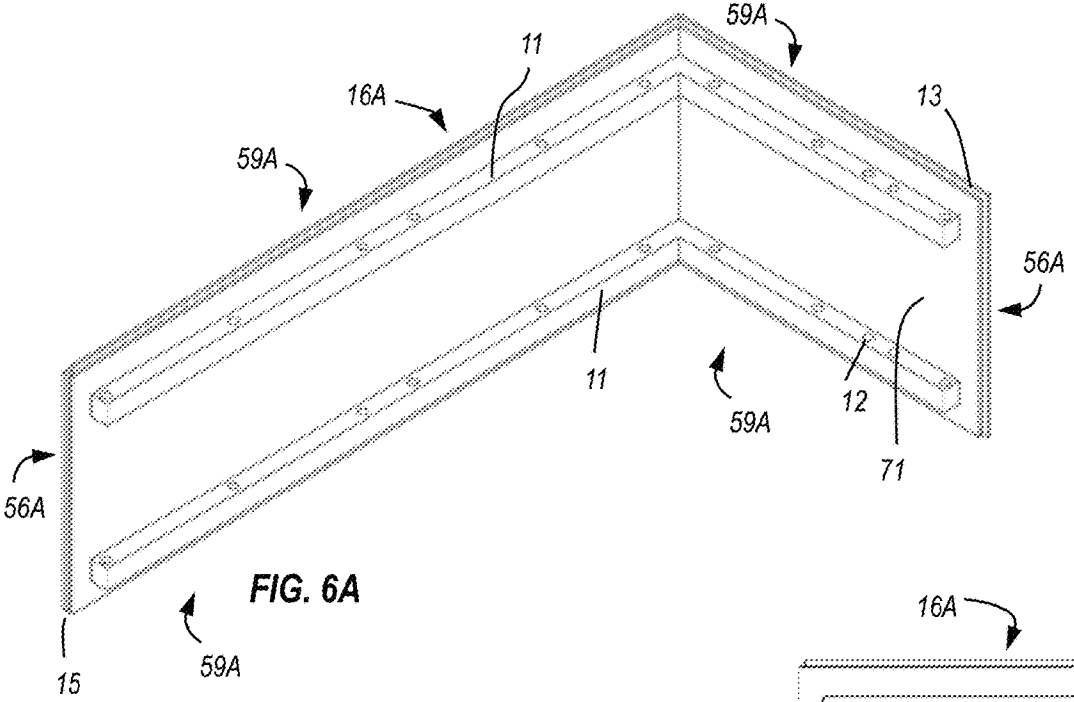
FIG. 6A is schematic isometric view of an outer corner wall panel including upper and lower receiving rails for assembling a course module for the modular wall building system as described herein.
Figure 7B:
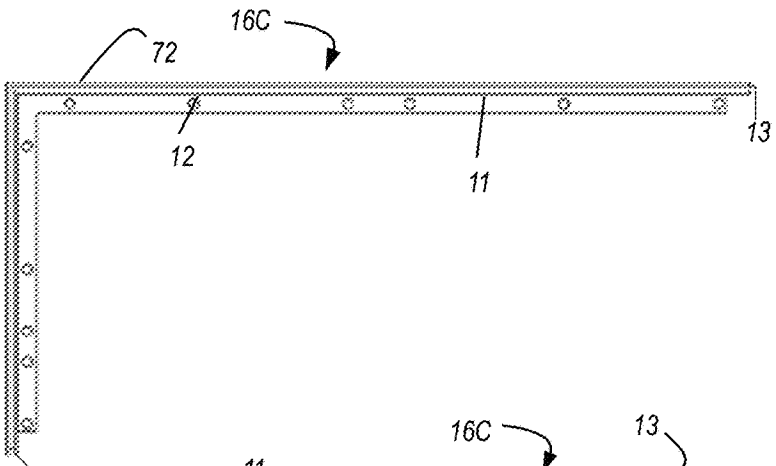
FIG. 7B is a schematic top view of the wall panel of FIG. 7A.
Figure 7C:
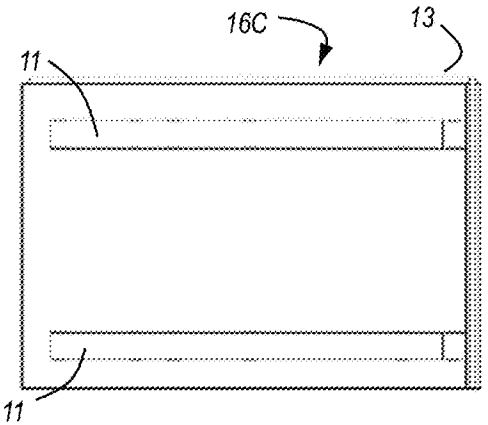
FIG. 7C is a schematic end view of the outer corner panel of FIG. 7A showing the dual rail locations in relation to the panel boundaries and to each other.
Figure 7D:
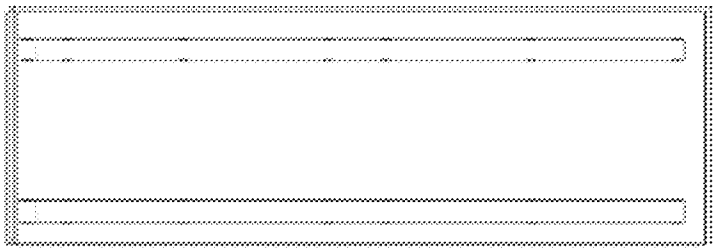
FIG. 7D is a schematic end view of the wall panel of FIG. 7A.
Figure 7A:
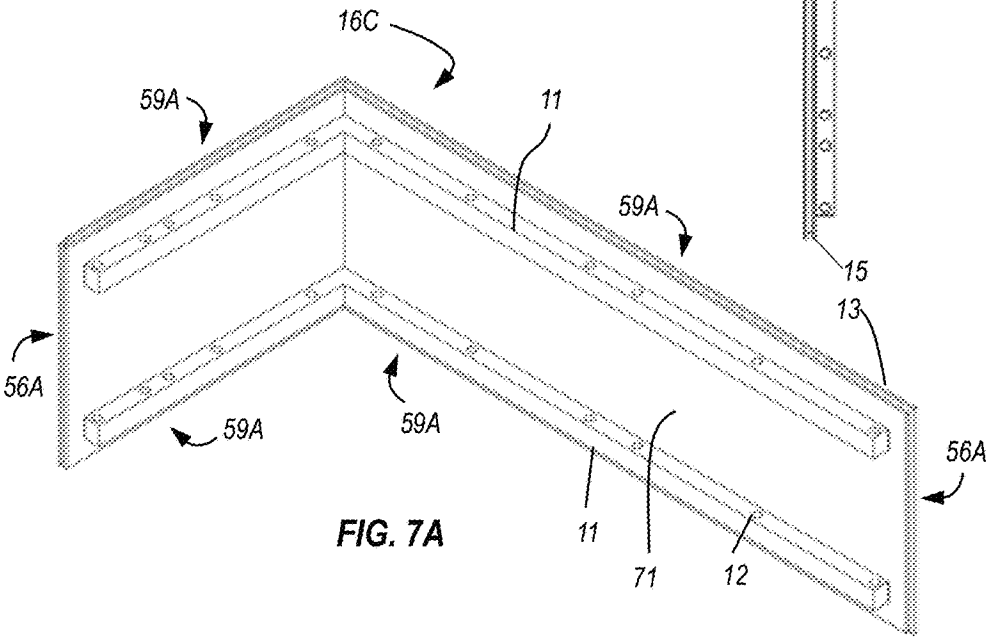
FIG. 7A is schematic isometric view of another outer corner wall panel including upper and lower receiving rails for assembling a course module for the modular wall building system as described herein.
Figure 8B:
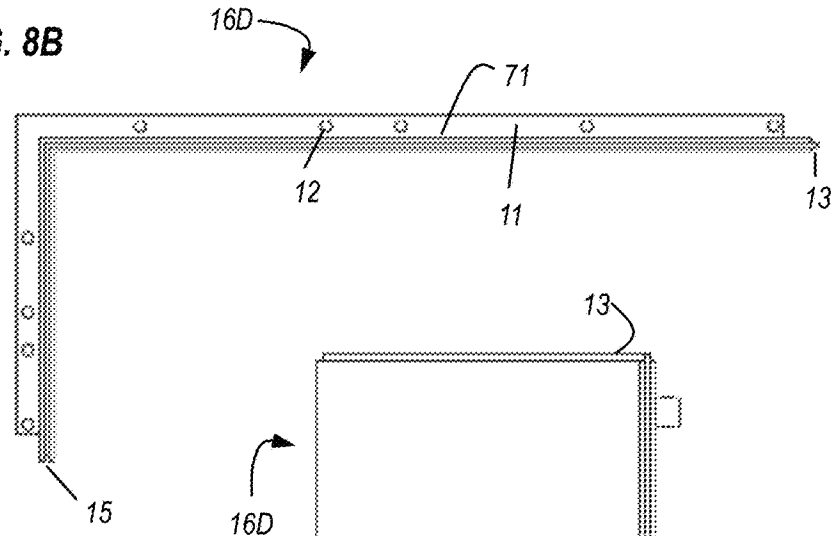
FIG. 8B is a schematic top view of the wall panel of FIG. 8A.
Figure 8C:
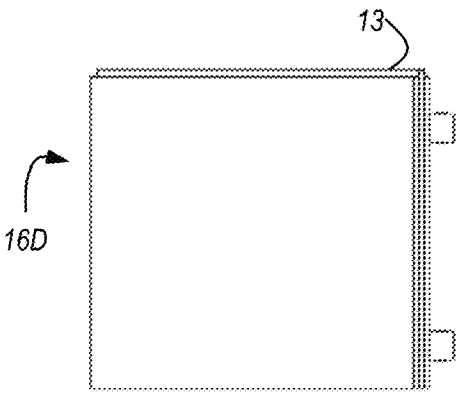
FIG. 8C is a schematic end view of the inner corner panel of FIG. 8A showing the dual rail locations in relation to the panel boundaries and to each other.
Figure 8D:
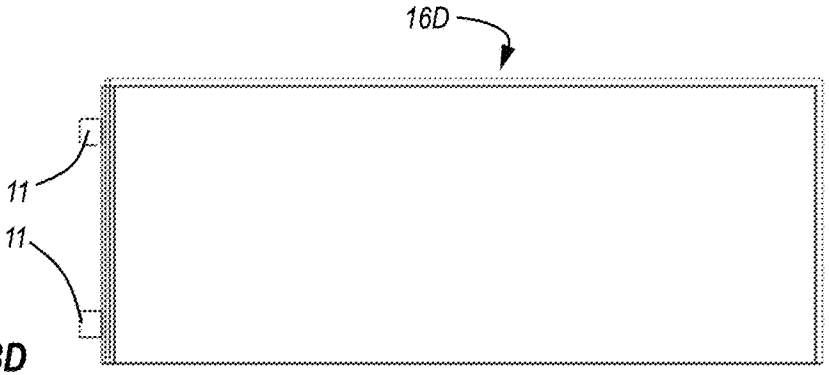
FIG. 8D is a schematic end view of the wall panel of FIG. 8A.
Figure 8A:
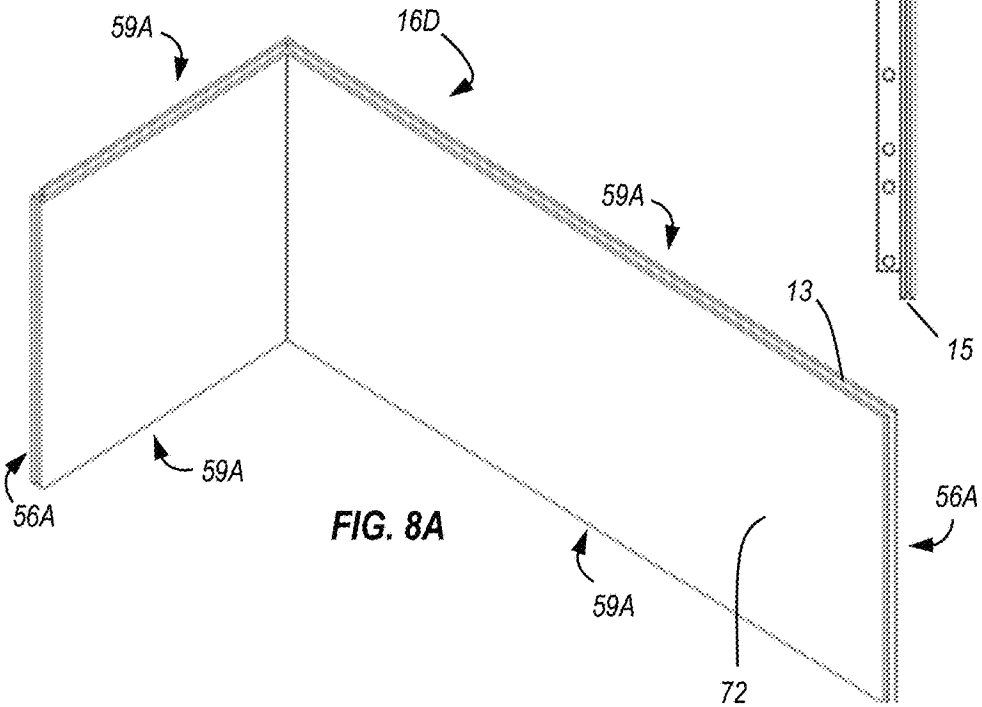
FIG. 8A is a schematic isometric view of another inner corner wall panel including upper and lower receiving rails for assembling a course module for the modular wall building system as described herein.
Figure 9B:
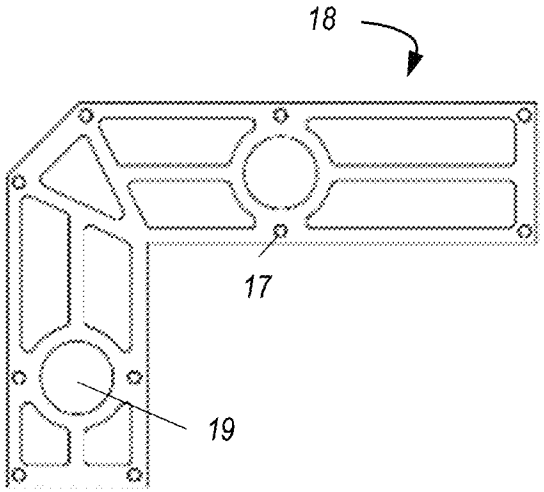
FIG. 9B is a schematic top view of the corner connector of FIG. 9A.
Figure 9C:
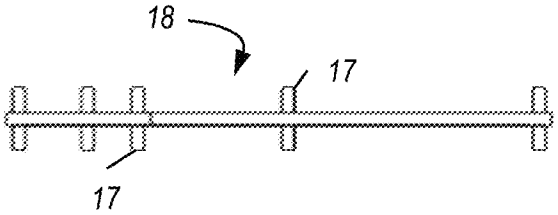
FIG. 9C is a schematic side view of the corner connector of FIG. 9A.
Figure 9D:
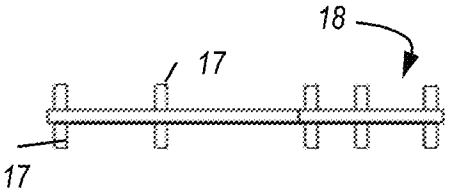
FIG. 9D is a schematic end view of the corner connector of FIG. 9A.
Figure 9A:
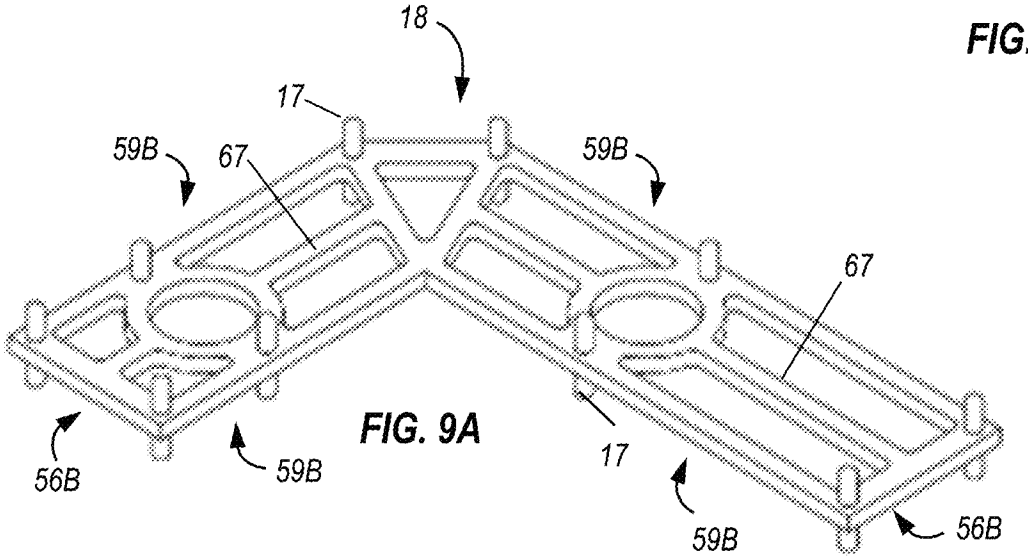
FIG. 9A is a schematic isometric view of a non-handed corner panel connector for assembling a course module for the modular wall building system as described herein.
Figures 10A, 10B, 10C, 10D:
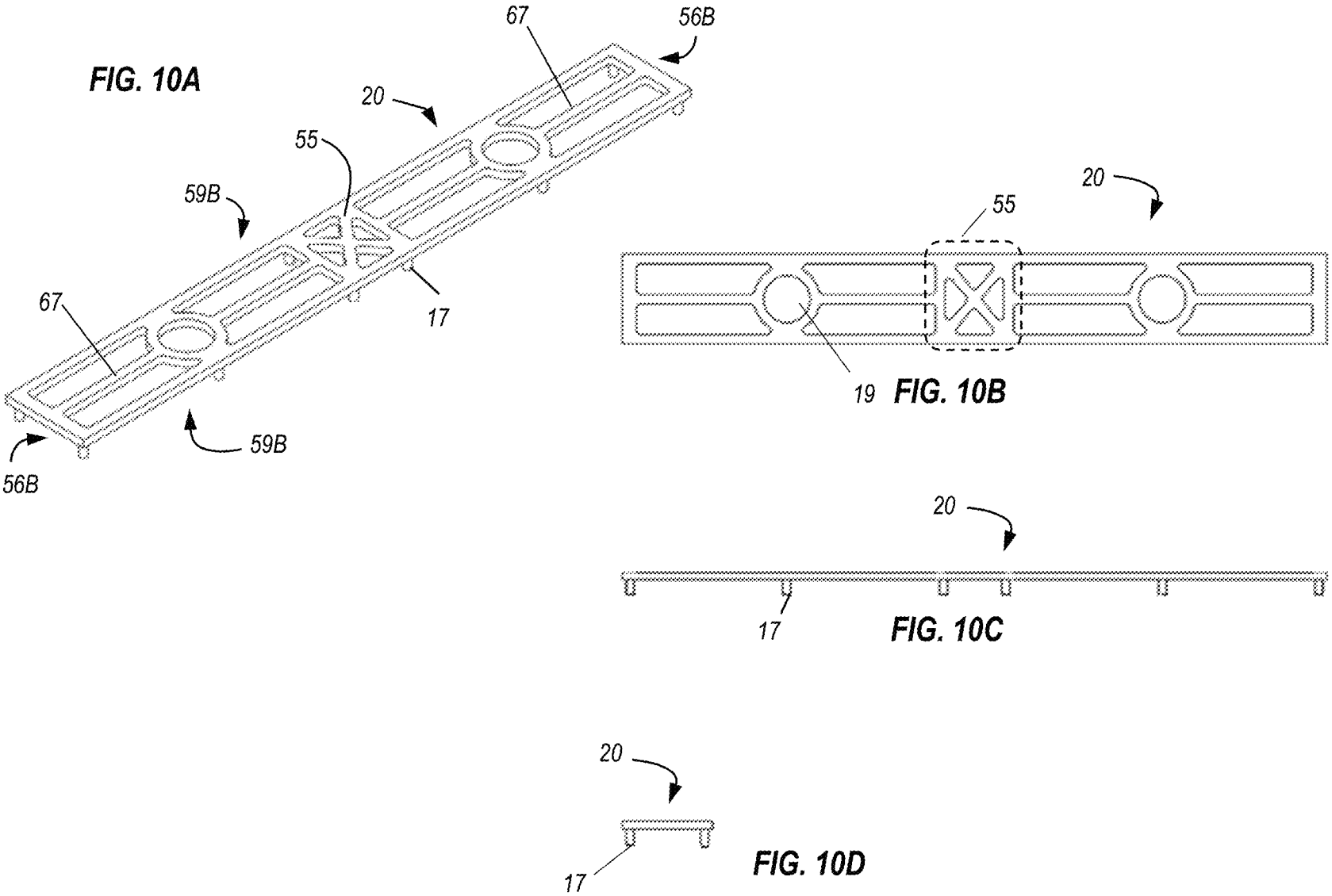
FIG. 10A is a schematic isometric view of a full panel connector for assembling a course module for the modular wall building system as described herein.
FIG. 10B is a schematic top view of the full panel connector of FIG. 10A.
FIG. 10C is a schematic side view of the full panel connector of FIG. 10A.
FIG. 10D is a schematic end view of the full panel connector of FIG. 10A.
Figure 11B:
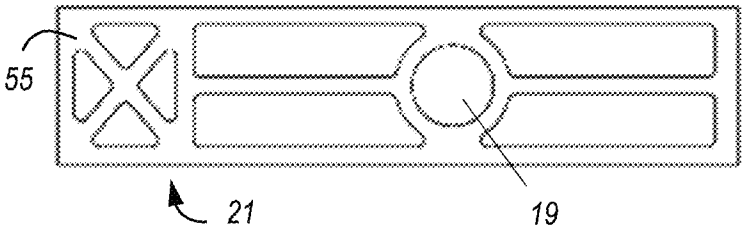
FIG. 11B is a schematic top view of the jamb panel connector of FIG. 11A.
Figure 11C:
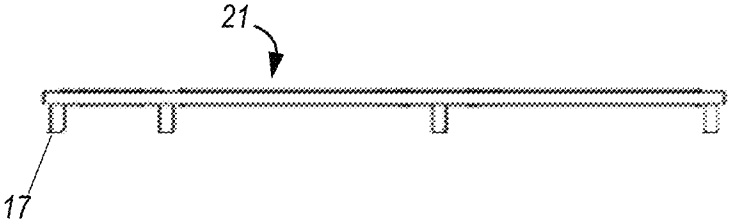
FIG. 11C is a schematic side view of the jamb panel connector of FIG. 11A.
Figure 11D:
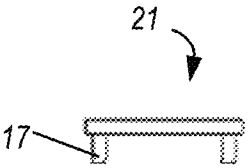
FIG. 11D is a schematic end view of the jamb panel connector of FIG. 11A.
Figure 11A:
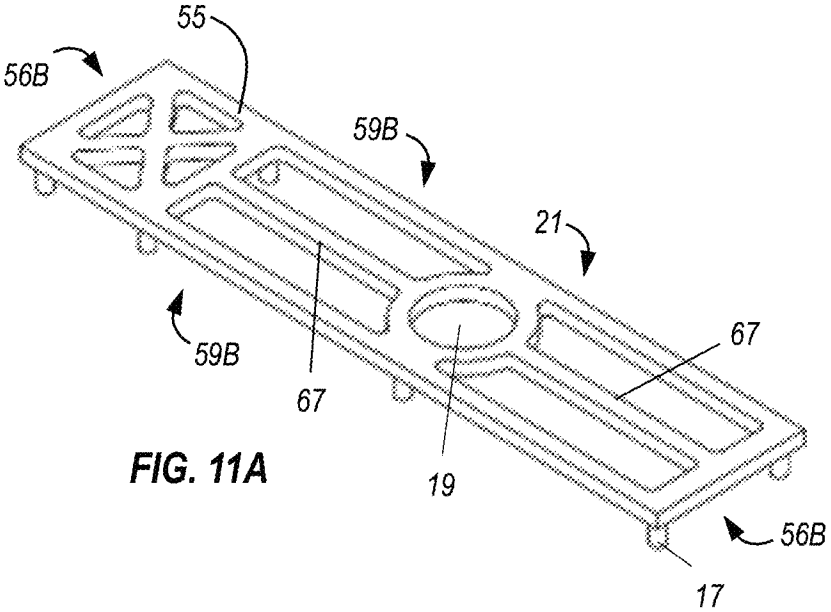
FIG. 11A is a schematic isometric view of a jamb panel connector for assembling a course module for the modular wall building system as described herein.
Figure 12B:
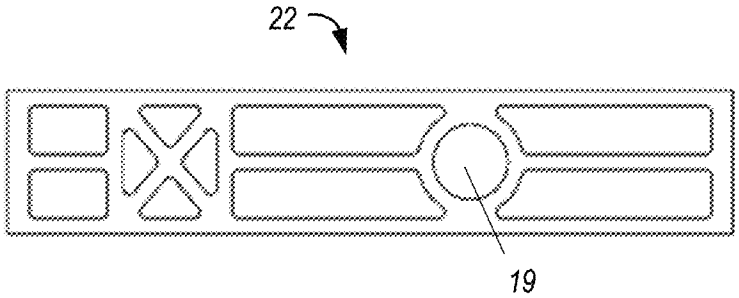
FIG. 12B is a schematic top view of the partial panel connector of FIG. 12A.
Figure 12C:
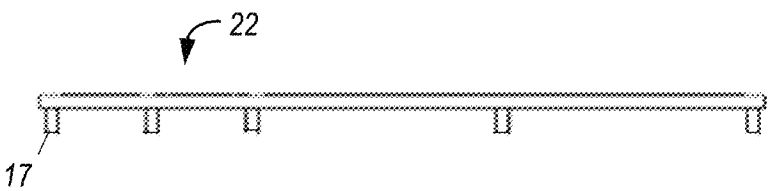
FIG. 12C is a schematic side view of the partial panel connector of FIG. 12A.
Figure 12D:
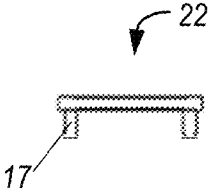
FIG. 12D is a schematic end view of the partial panel connector of FIG. 12A.
Figure 12A:
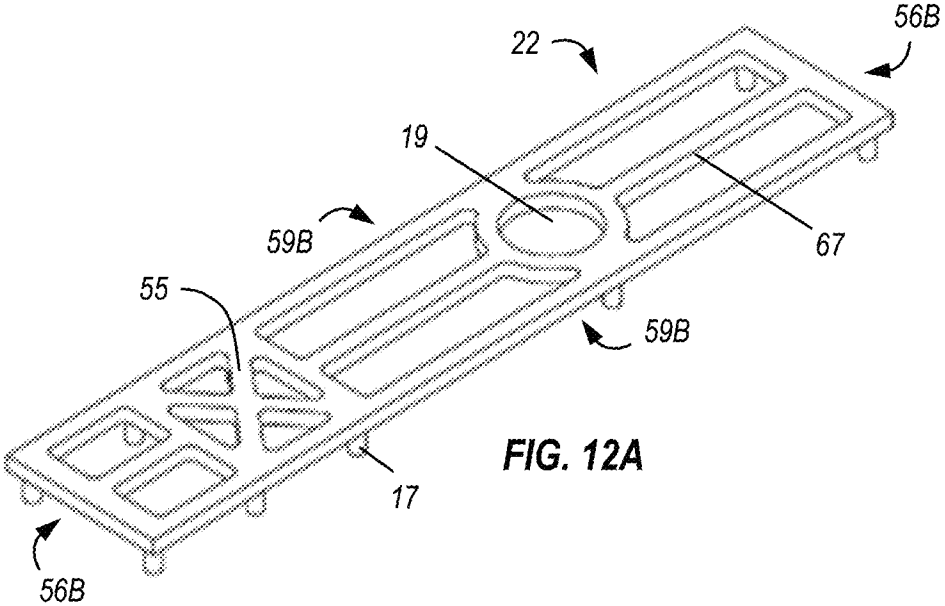
FIG. 12A is a schematic isometric view of a partial panel connector for assembling a course module for the modular wall building system as described herein.
Figure 13B:
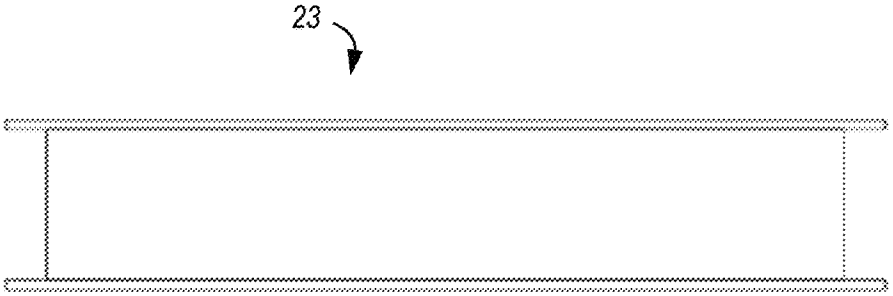
FIG. 13B is a schematic top view of the door jamb header of FIG. 13A.
Figure 13C:
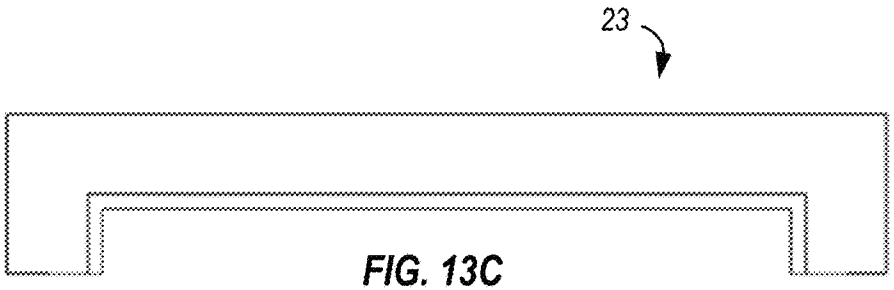
FIG. 13C is a schematic side view of the door jamb header of FIG. 13A.
Figure 13D:
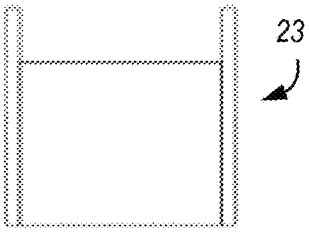
FIG. 13D is a schematic end view of the door jamb header of FIG. 13A.
Figure 13A:
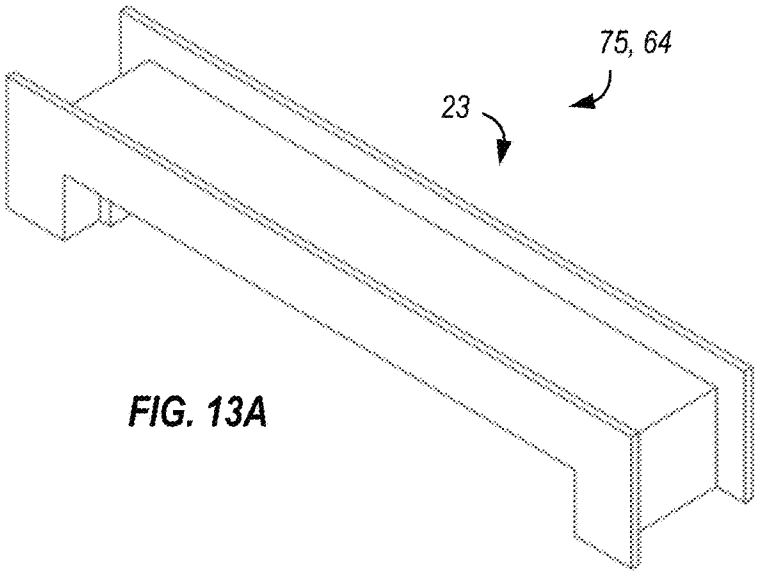
FIG. 13A is a schematic isometric view of a door jamb header for assembling a course module for the modular wall building system as described herein.
Figures 14A, 14B, 14C, 14D:
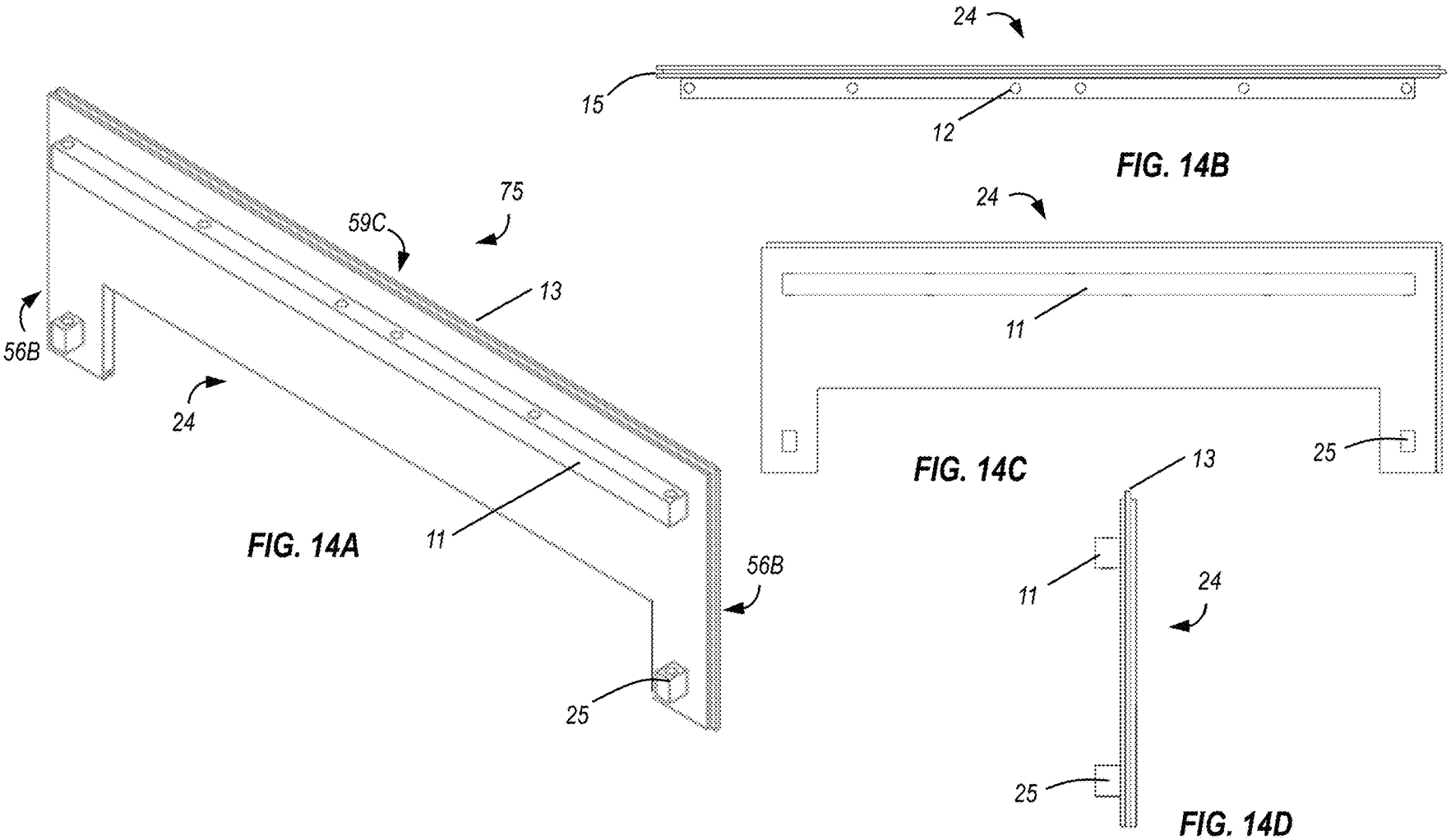
FIG. 14A is a schematic isometric view of an inner door header panel including integrated upper receiving rail and integrated lower receiving rails for assembling a course module for the modular wall building system as described herein.
FIG. 14B is a schematic top view of the door header panel of FIG. 14A.
FIG. 14C is a schematic side view of the door header panel of FIG. 14A.
FIG. 14D is a schematic end view of the door header panel of FIG. 14A.
Figure 15B:
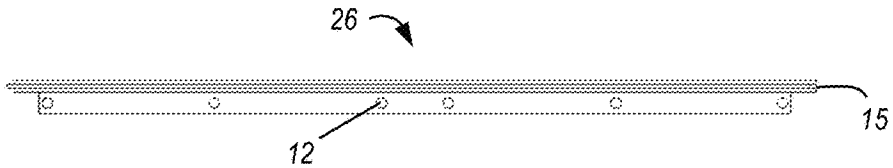
FIG. 15B is a schematic top view of the door header panel of FIG. 15A.
Figure 15C:
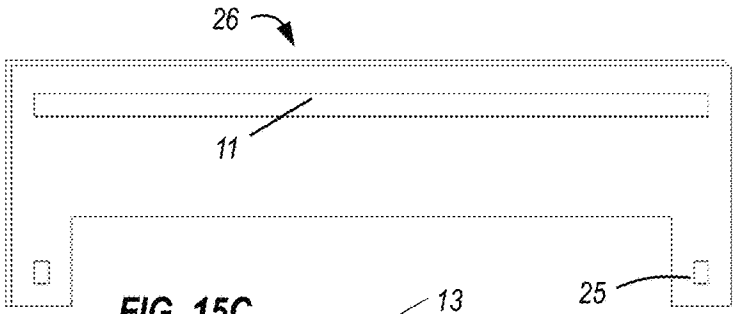
FIG. 15C is a schematic side view of the door header panel of FIG. 15A.
Figure 15D:
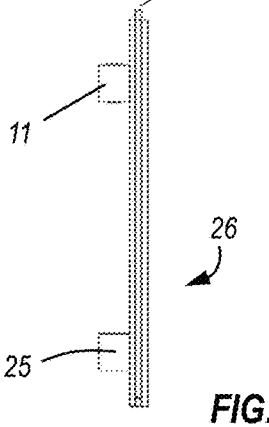
FIG. 15D is a schematic end view of the door header panel of FIG. 15A.
Figure 15A:
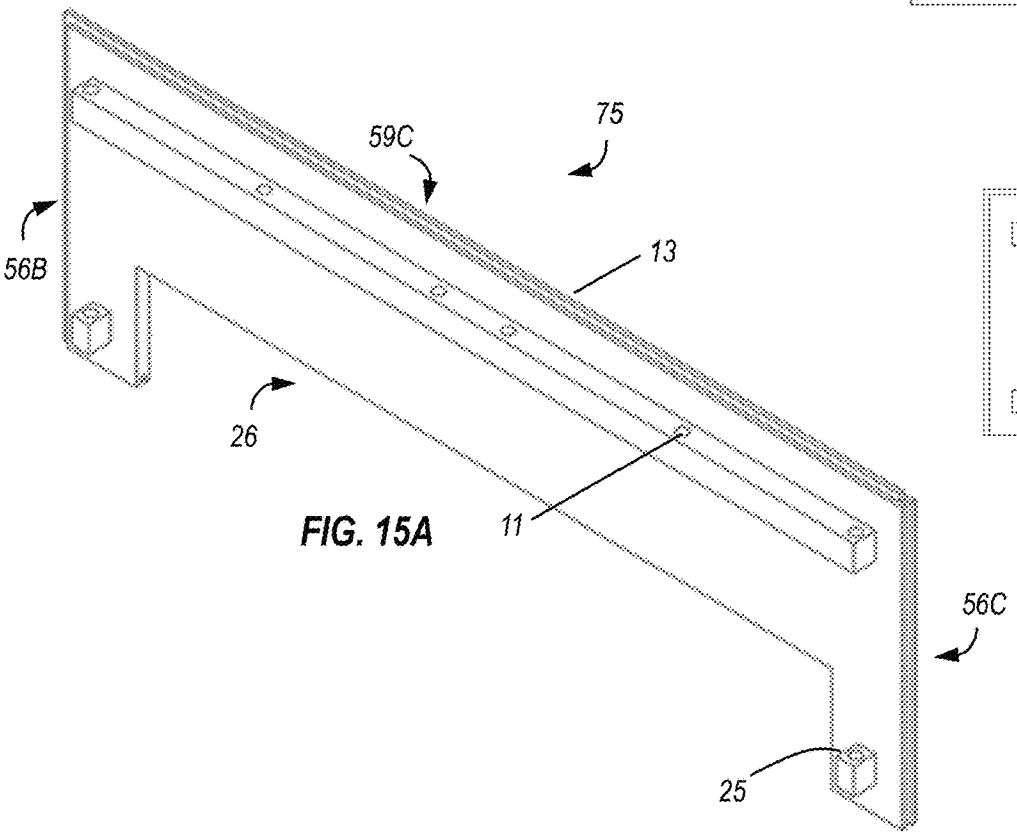
FIG. 15A is a schematic isometric view of an outer door header panel including an integrated upper receiving rail and integrated lower receiving rails for assembling a course module for the modular wall building system as described herein.
Figure 16C:
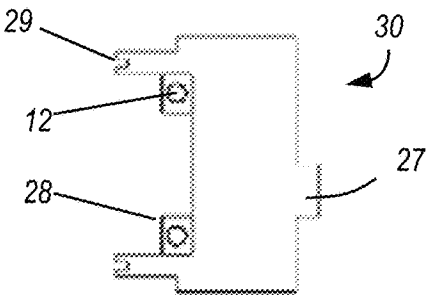
FIG. 16C is a schematic top view of the door side jamb of FIG. 16A.
Figure 16B:
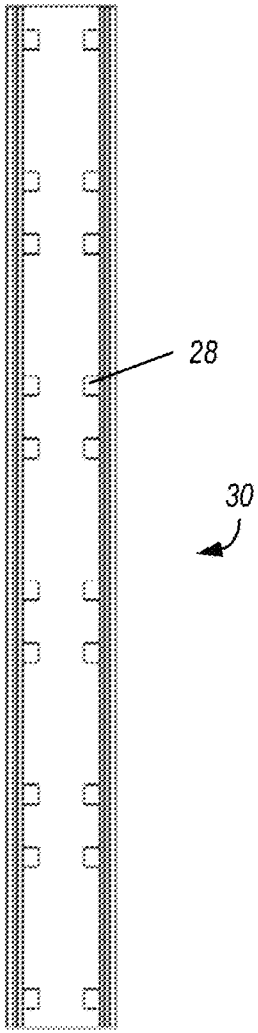
FIG. 16B is a schematic side view of an interior side of the door side jamb of FIG. 16A.
Figure 16A:
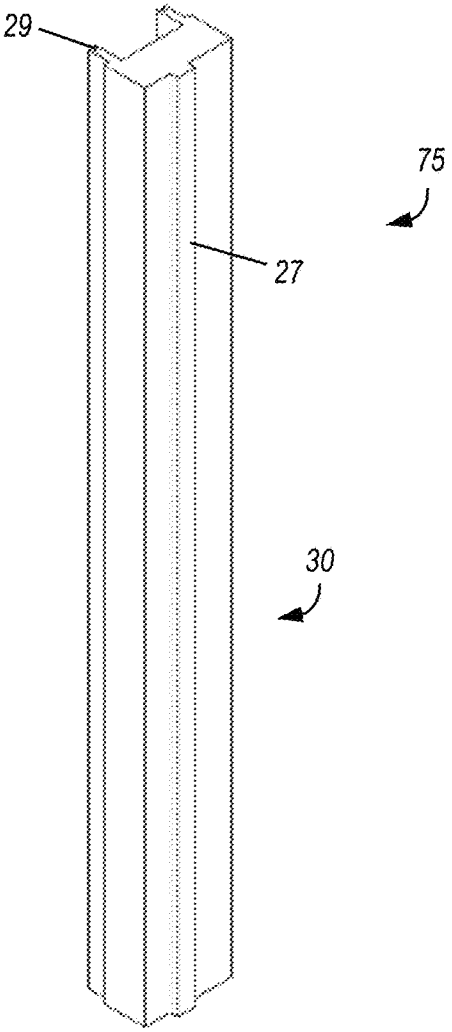
FIG. 16A is a schematic isometric view of a door left side jamb and integrated stop for assembling a door structure of the modular wall building system as described herein.
Figure 17C:
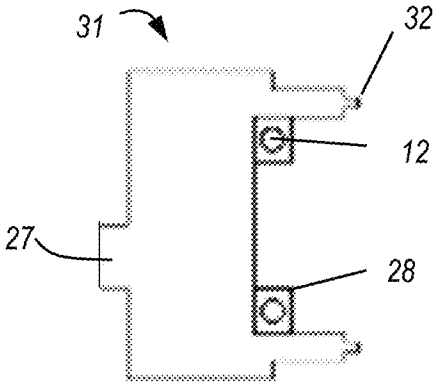
FIG. 17C is a schematic top view of the door side jamb of FIG. 17A.
Figure 17B:
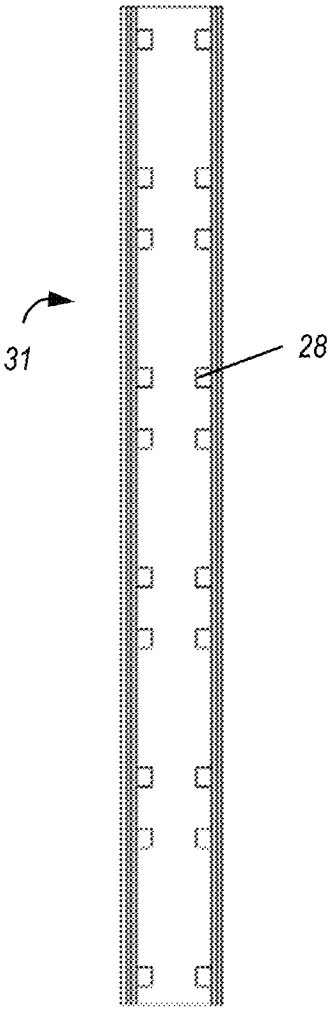
FIG. 17B is a schematic side view of an interior side of the door side jamb of FIG. 17A.
Figure 17A:
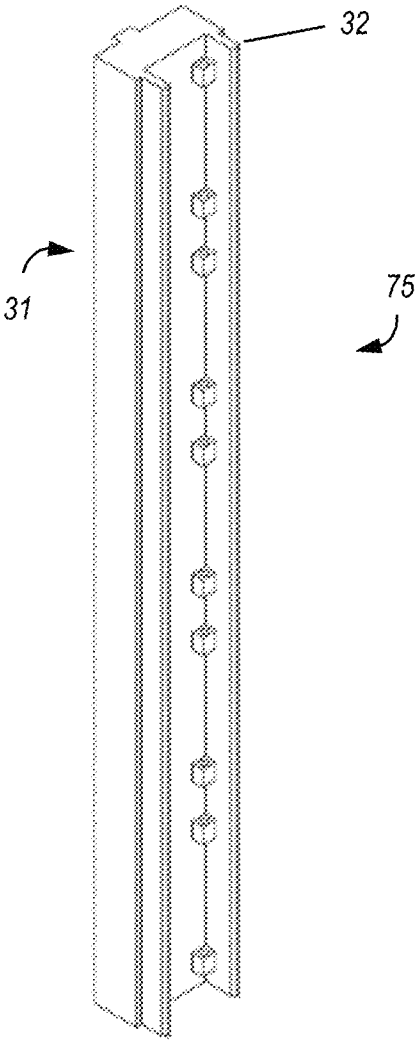
FIG. 17A is a schematic isometric view of a door right side jamb and integrated stop for assembling a course module for the modular wall building system as described herein.

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. Furthermore, the disclosure, as illustrated and described herein, may be practiced in the absence of an element that is not specifically disclosed herein.

Those having ordinary skill in the art will recognize that terms such as "above," "below," "upward," "downward," "top," "bottom," etc., are used descriptively for the figures, and do not represent limitations on the scope of the disclosure, as defined by the appended claims. Referring to the drawings wherein like reference numbers represent like components throughout the several figures, the elements shown in FIGS. 1-8 are not necessarily to scale or proportion. Accordingly, the particular dimensions and applications provided in the drawings presented herein are not to be considered limiting.

Referring to FIGS. 1-38, a rigid wall modular system 100 which is as lightweight, transportable and as easy to assemble as a tent, but strong enough to support structural loading, wind loads, thermal events on a global scale, and a method of construction of a rigid wall structure 70 using the rigid wall modular system 100, and which can be assembled without the use of power tools, or electrical power, and without the use of skilled trades persons, is disclosed herein. Referring to the drawings wherein like reference numbers represent like components throughout the several figures, the elements shown in FIGS. 1-38 are not necessarily to scale or proportion. Accordingly, the particular dimensions and applications provided in the drawings presented herein are not to be considered limiting.

Figure 38:
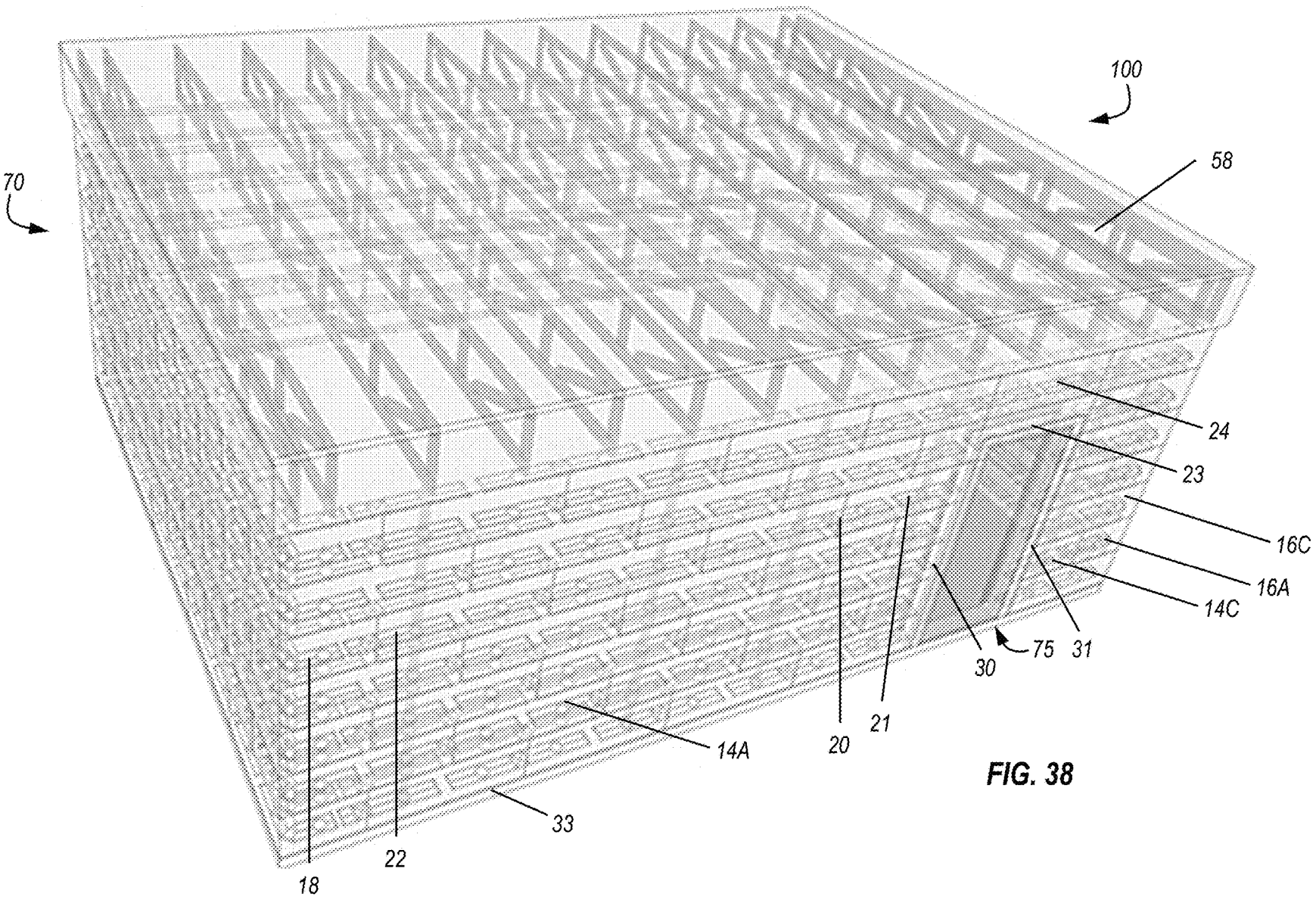
FIG. 38 is a perspective view of an exemplary rigid wall structure assembled from the rigid wall of the modular wall building system as described herein.

Referring to FIG. 38, a modular rigid wall structure 70 assembled from components, as further described herein, of the rigid wall modular system 100, is shown. In the illustrative example shown, the rigid wall modular system 100, also referred to as a modular building system 100, includes a plurality of components which can be combined in various configurations and assembled into rigid wall structures 70 of the type shown in FIG. 38. As described in further detail, and as illustrated by the component drawings, the possible combinations of the components are unlimited in number and variation, such that a combination of components can be used to assemble rigid wall structures of differing configurations, e.g., of different lengths, widths, heights, perimeter shapes (square, rectangular, L-shaped, U-shaped, straight wall, etc.), and with different combinations of door and window openings. Further, a wall structure 70 assembled from the system components described herein can be disassembled, and the disassembled components reused for re-assembly of the wall structure 70, for example, in a different location, such that the wall structures 70 described herein are portable and/or can be configured as temporary structures, and/or the disassembled components can be reassembled in a different arrangement, such that the wall structure 70 is reconfigurable and/or the disassembled components are reusable. The various modular components described herein are preferably made of one or more lightweight materials, such that they are manually transportable. In one example, the modular components are made from materials including materials which are at least one of environmentally neutral, eco-friendly, and/or recyclable.

Figure 31:
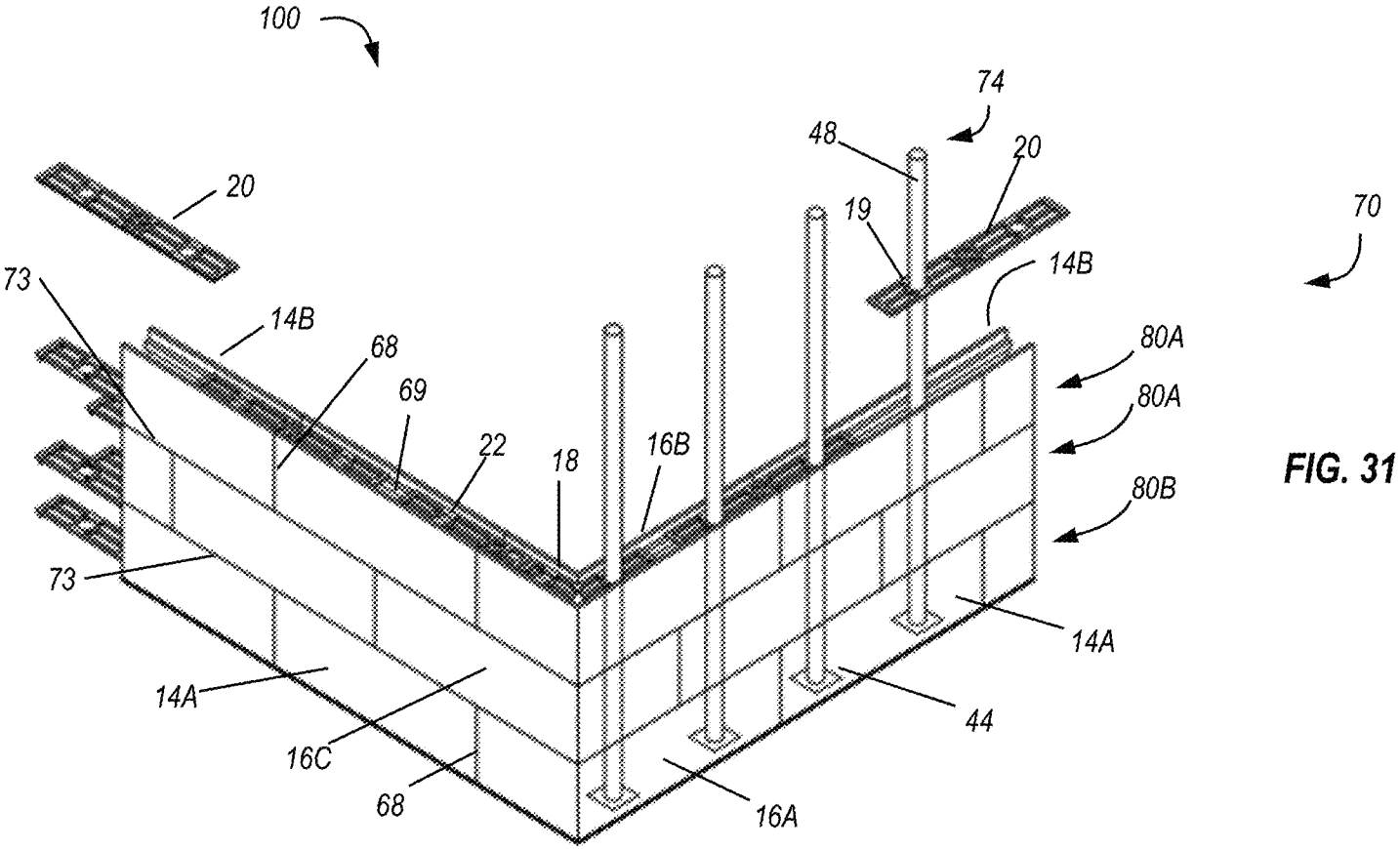
FIG. 31 is a schematic isometric partially exploded view of portion of a wall structure including a bottom course module, a plurality of wall course modules layered on and attached to the bottom course module, and structural columns extending through the layered panel connectors and disposed between the inner and outer wall panels.
Figure 32:
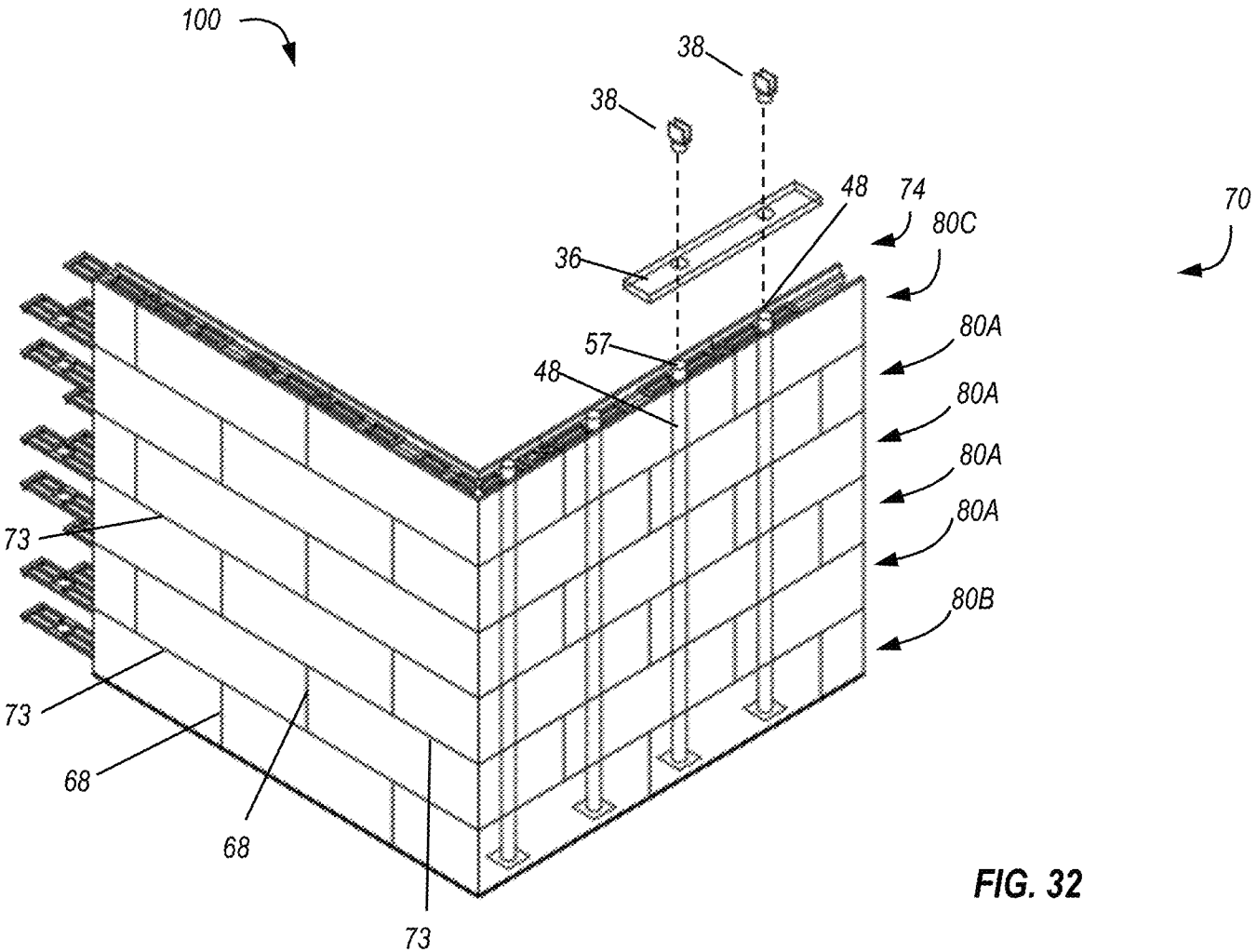
FIG. 32 is a schematic isometric partially exploded view of the wall structure of FIG. 31 further including a top course module, top plate and truss connectors connecting the top plate to the structural columns.

Referring to FIGS. 1-8D, primary components making up the wall structure 70 include wall panels 14A, 14B, 14C, 14D (referred to collectively herein as wall panels 14), corner wall panels 16A, 16B, 16C, 16D (referred to collectively herein as corner wall panels or corner panels 16). Each wall panel 14, 16 includes an interior surface 71 and an exterior surface 72. In the illustrative example shown the wall panels 14, 16 are rectangular in shape, each panel having opposing longitudinal panel edges 59A and opposing lateral panel edges 56A. Each wall panel 14, 15 has a first longitudinal edge 59A and an adjacent first lateral edge 56A defining a panel tongue 13, and has a second longitudinal panel edge 59A and an adjacent second lateral panel edge 56A defining a panel groove 15, such that the adjacent wall panels 14, 16 can be joined by insertion of a panel tongue 13 of a respective panel 14, 16 into a panel groove 15 of an adjacent wall panel 14, in a tongue 13 and groove 15 positive location system, to form vertical panel joints 68 and horizontal panel joints 73 between adjoining panels, where the panel joints 68, 73 are resistant to fluid (air, water, etc.) transmission and leakage through the wall structure 70, to seal the wall panels 14, 16 to each other and improve the thermal efficiency of the wall structure 70, as shown in FIGS. 31 and 32.

Figure 26:
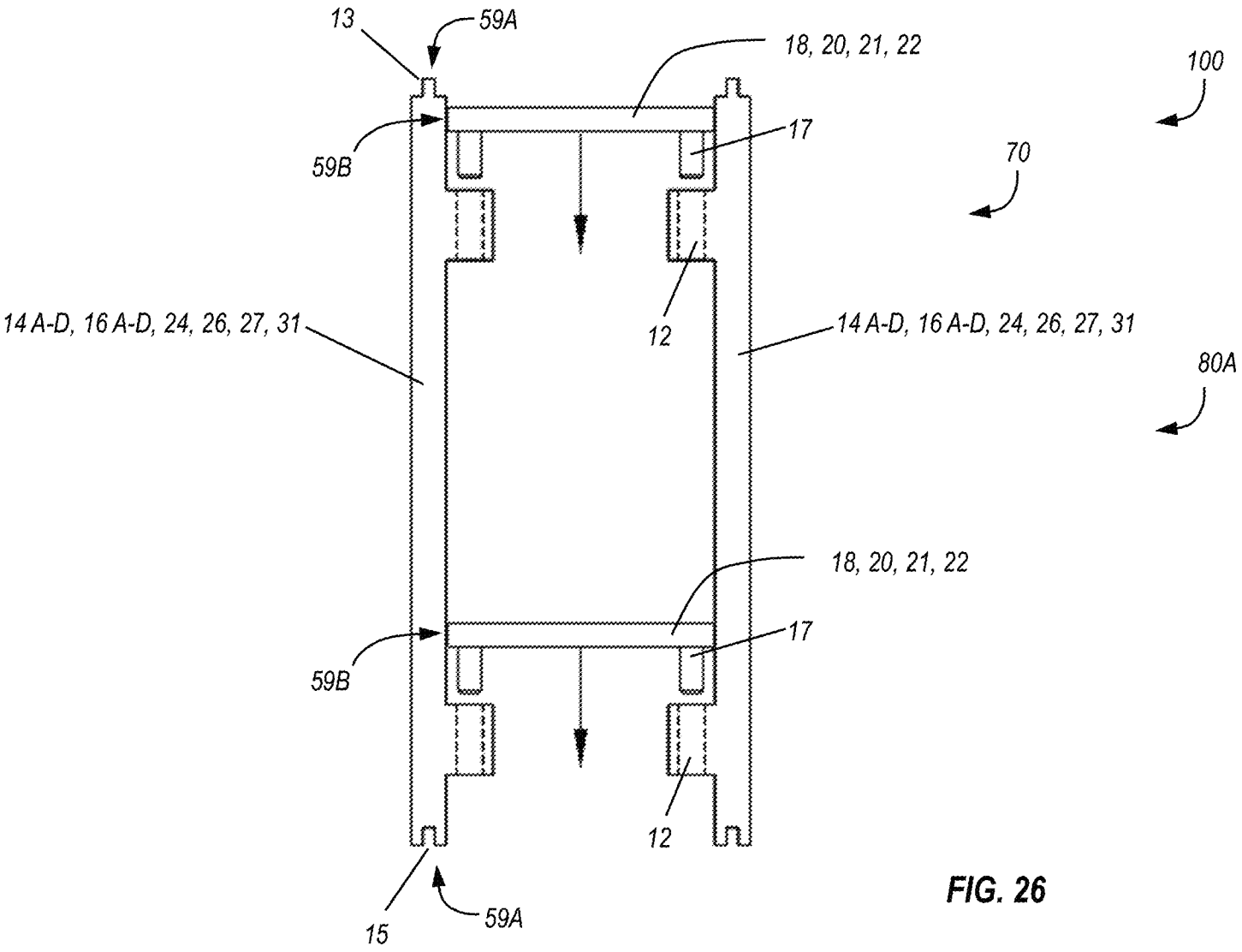
FIG. 26 is a schematic cross-sectional exploded view of a course module illustrating attachment of upper and lower panel connectors to upper and lower receiving rails of inner and outer wall panels, by insertion of connector pins into receiver through holes.
Figure 27:
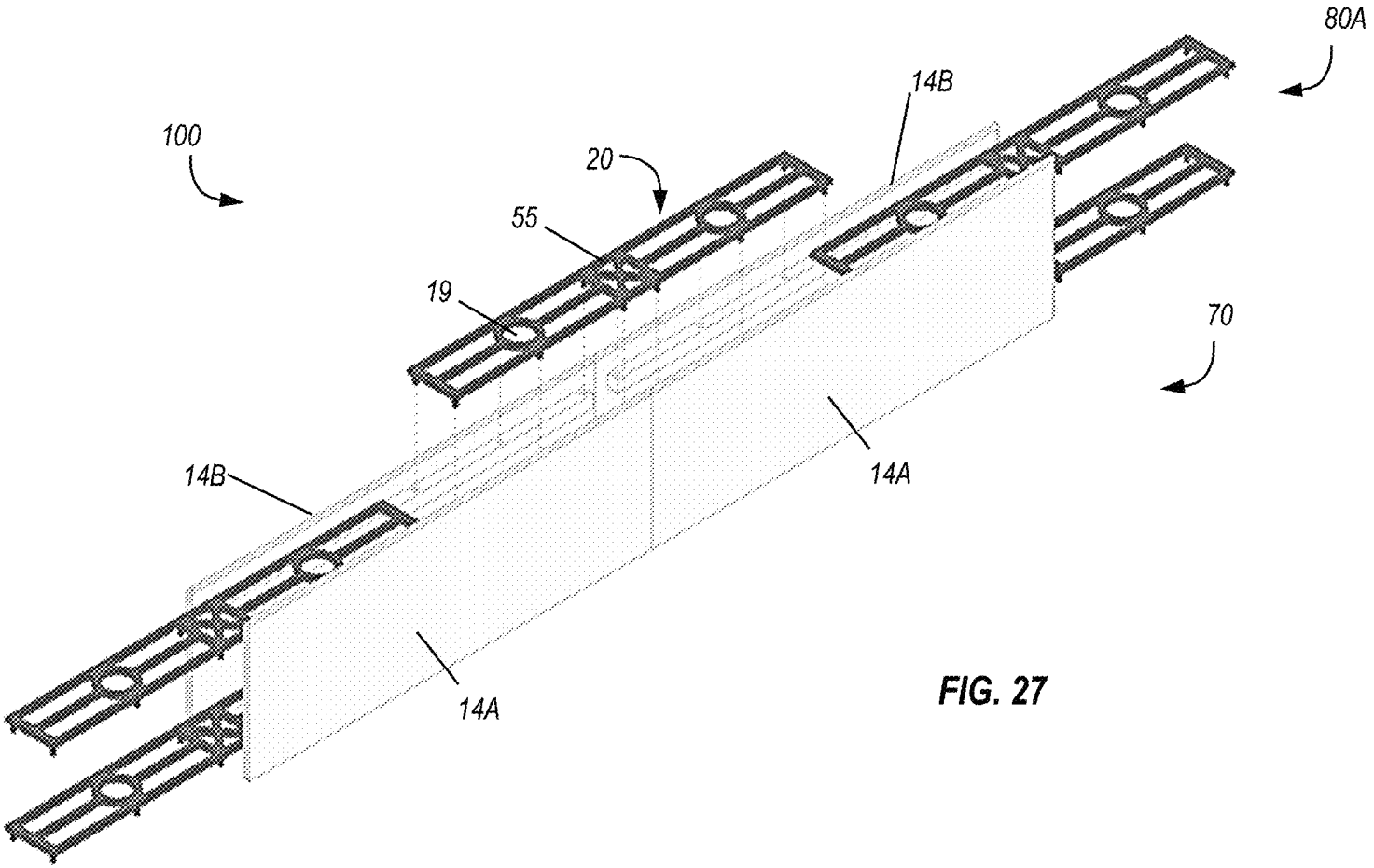
FIG. 27 is a schematic isometric view of a portion of a course module including a plurality of inner and outer wall panels and panel connectors, showing the panel connector positioned relative to vertical wall panel tongue and groove joints formed between adjacent panels such that the panel connector spans the adjacent panels and such that the end of the panel connect is non-coincident with the vertical wall panel joint and a stiffening cross member formed in the panel connector is aligned with the vertical wall panel joint to stiffen the joint.
Figure 28:
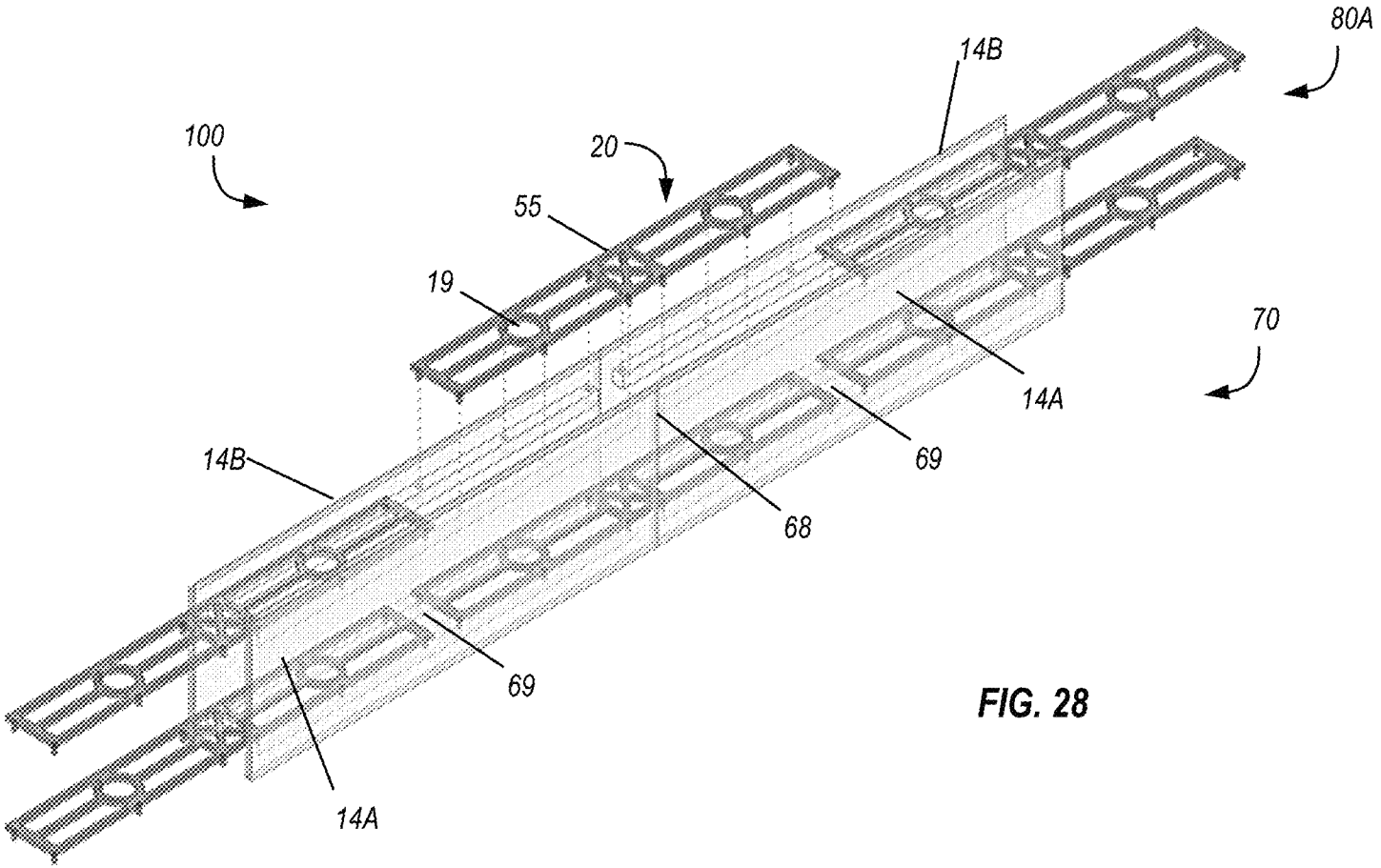
FIG. 28 is a schematic translucent isometric view of the course module of FIG. 27.
Figure 29:
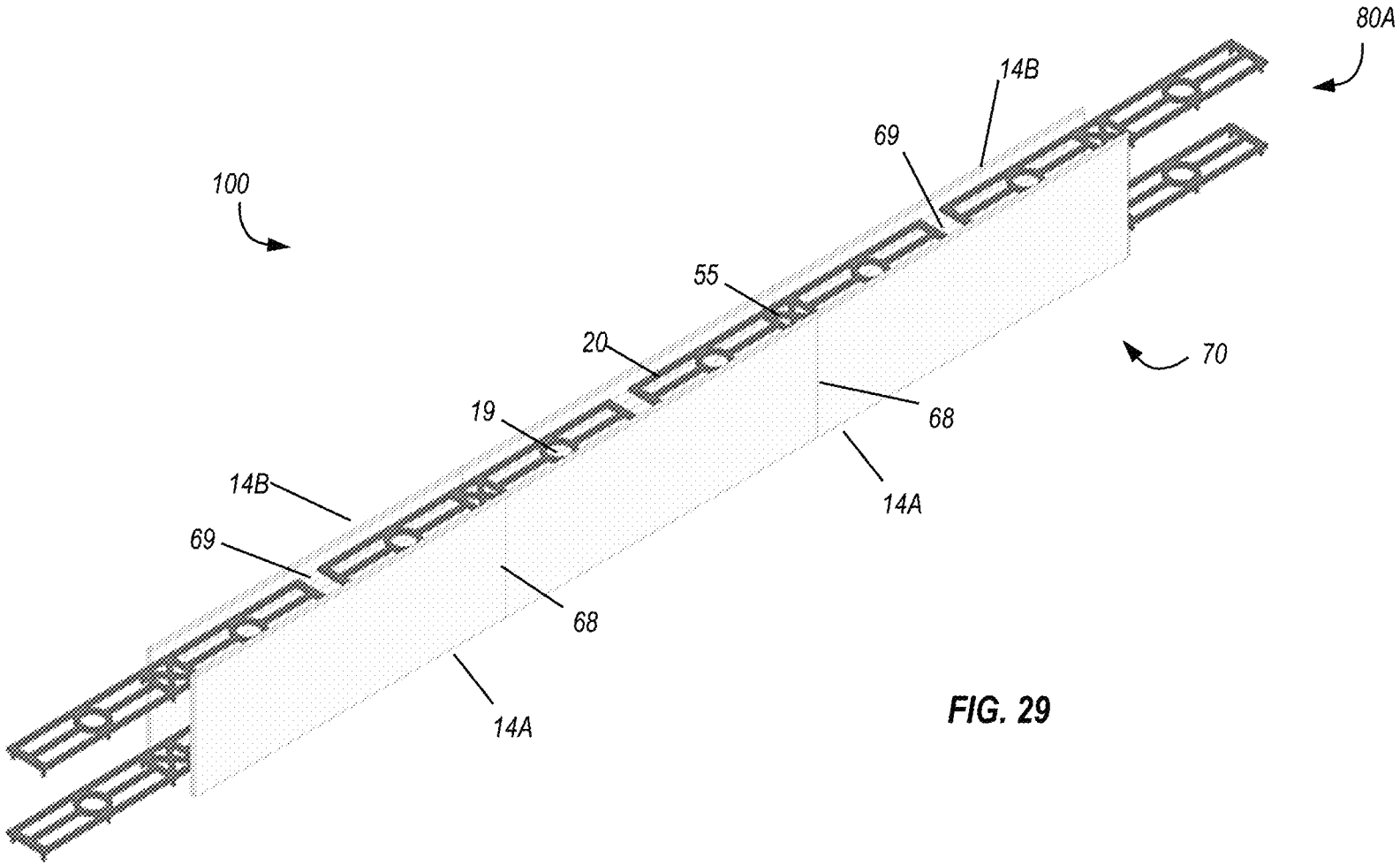
FIG. 29 is a schematic isometric view of the course module of FIG. 27 including an additional wall section.

Each wall panel 14, 16 includes upper and lower receiving rails 11 extending from the interior surface 71, where the receiving rails 11 are adjacent and substantially parallel to longitudinal panel edges 59A. The receiving rails 11 include a plurality of receiver through holes 12, for receiving corresponding connector pins 17 of panel connectors 18, 20, 21, 22, as shown in FIG. 26, to attach the wall panels 14, 16 to the panel connectors 18, 20, 21, 22, where inner panels 14B, 14D, 16B, 16D and respectively corresponding outer panels 14A, 14C, 16A, 16C are attached to each other via panel connectors 18, 20, 21, 22 to form wall structures 70.

The panels 14, 16 and receiving rails 11 can be made of any material which can hold the given shape including, but not limited to, wood, metal, plastic, polymer based materials, composites, fiberboard, cement board, etc., and preferably, of a lightweight material capable of being formed in the required shape. In a non-limiting example, the panels 14, 16 can be formed of a ballistic material such as a carbon fiber material, Kevlar®, etc. The panels 14, 16 can be extruded, molded, milled, or otherwise fabricated as needed and/or suitable for the intended use of the structure 70 into which the panels 14, 16 are installed. The receiving rails can be formed integrally with the panels 14, 16, for example, by molding, extrusion, stamping, pressing, etc. and/or can be attached to the panels 14, 16 by any suitable means including, for example, using fasteners, plastic welding, staking, riveting, using adhesives, etc. The panels 14, 16 can be colored, patterned, textured, painted, coated, and/or otherwise fabricated and/or treated to provide an exterior appearance suitable to a user's functional and/or aesthetic preferences, or as needed and/or suitable for the intended use of the panels 14, 16 and/or wall structure 70 formed therefrom. By way of non-limiting example, the exterior surfaces 72 of the panels 14, 16 may be camouflaged, or may include a reflective coating for thermal management. The panels 14, 16 can be modified to any thickness as needed and/or suitable for the intended use. For example, the thickness of the panels 14, 16 can be modified based on the environmental conditions of the intended use including precipitation, sun exposure, wind exposure, temperature range, etc., and/or use conditions, including thermal management, ballistic resistance, etc. The examples provided herein are illustrative and non-limiting. The tongues 13, grooves 15, receiving rails 11 and receiving through-holes 12 are symmetrically opposite between all inner panels 14B, 14D, 16B, 16D and respectively corresponding outer panels 14A, 14C, 16A, 16C to allow aligned connection points between the receiving rails 11 through-holes 12 on each of the inner panels 14B, 14D, 16B, 16D and outer panels 14A, 14C, 16A, 16C. The receiver through-holes 12 of the receiving rails 11 are of constant size to receive structural connector pins 17 as described within, and are distributed on the receiving rails 11 to correspond to the location of the connector pins 17 on the panel connectors 18, 20, 21, 22 for convenient attachment of the panel connectors 18, 20, 21, 22 to the wall panels 14, 16, using manual pressure and/or minimal pressure, for example, from a pounding object such as a mallet or hammer, to assemble course modules 80.

Referring to FIGS. 1A-8D, shown are example panels 14, 16 of the rigid wall modular system 100, in varying configurations, such that the panels 14, 16 can be selected from the system 100 and combined as required to assemble modular rigid wall structure 70 in the desired configuration, which may be, for example, a rectangular, U-shaped, L-shaped, or other regular polygonal shaped enclosed wall structure, and/or to assemble a wall structure 70 which can be configured as a freestanding wall, barricade, etc. In an illustrative example, the modular wall building system 100 includes corresponding full length outer and inner panels 14A, 14B, where "full length" as referred to herein indicates a predetermined design length of panels 14A, 14B, corresponding to the length of the longitudinal edge 59A of the full length panels 14A, 14B, and to the length of the longitudinal edge 59A of the longer segment of outer corner panels 16A, 16C. The predetermined full length of the panels 14A, 14B in one example may be about three feet, and in another non-limiting example may be about four feet, such that the panels 14, 16 are configured in a size which is readily transportable in standard vehicles including transport trucks, and which is of a size and weight which is manually moveable by a person with requiring the assistance of powered or supplemental lifting equipment. In an illustrative example, the modular wall building system 100 includes corresponding partial length outer and inner panels 14C, 14D, where "partial length" as referred to herein indicates a predetermined design length of the panels 14C, 14D, and the shorter segment of outer corner panels 16A, 16C, which corresponding to a partial length of the longitudinal edge 59A of the full length panels 14A, 14B where the partial length also determines the offset between wall panels 14, 16 when course modules 80 are layered, for example, including bottom course module 80B, top course module 80C, and intermediate wall course modules 80A (modules 80A, 80B, 80C collectively referred to herein as course modules 80), as shown in FIG. 32, to form a wall structure 70 using the wall building system 100. In an illustrative example, the predetermined full length can be four feet, and the predetermined partial length can be two feet, such that, when the course modules 80 are layered and connected as shown in FIG. 32, with the courses 80 alternating the long side and short side of the corner panels 16, a wall structure 70 with a running bond pattern is created. In the present example, the partial length of two feet is half of the full length of four feet, such that a half-bond pattern is produced in the wall structure 70. The example is non-limiting, and it would be understood that panels 14, 16 fabricated with other combinations of full and partial lengths can be included in the modular wall building system 100 such that variations the combinations of panels 14, 16 can be used in assembling course modules 80 and/or wall structures 70.

Still referring to FIGS. 1A-8D, in the illustrative examples shown, the modular wall building system 100 includes outer corner wall panels 16A, 16C and corresponding inner corner wall panels 16B, 16D, each corner panel 16 including a long panel segment and a short panel segment joined at one end to form a corner of the corner panel 16. In the illustrative example, the long panel segment of the outer corner panels 16A, 16C has a length equal to the full length of wall panels 14A, 14B, and the short panel segment of the outer corner panels 16A, 16C has a length equal to the partial length of the wall panels 14C, 14D, for assembling course modules 80 having corresponding perimeter shapes which can be layered to form a wall structure 70. The lengths of the long and short segments of inner corner panels 16B, 16D are proportional to and less than the lengths of the long and short segments of the outer corner panels 16A, 16C, as determined, for example, by the wall thickness of the course module 80, including the width of the panel connectors 18, 20, 21, 22 and the panel thickness of the inner and outer wall panels 14, 16. The panel thickness, as defined herein, is the distance between the interior and exterior surfaces 71, 72 of the wall panels 14, 16. In one example, the inner panels 14B, 14D, 16B, 16D can be the same thickness as the outer panels 14A, 14C, 16A, 16C. In one example, the inner panels 14B, 14D, 16B, 16D can have a different thickness than the outer panels 14A, 14C, 16A, 16C, considering the different properties, including thermal, strength, density, environment, etc., required for the function of each of the inner panels 14B, 14D, 16B, 16D and outer panels 14A, 14C, 16A, 16C. The inner panels 14B, 14D, 16B, 16D and outer panels 14A, 14C, 16A, 16C may be made of the same materials and/or have the same properties, thicknesses, appearance, etc., or may differ in material, thermal, strength, density, ballistic, environmental or other properties, thicknesses, appearance, color, etc. according to the functional and aesthetic requirements of the wall structure 70 formed therefrom.

Referring to FIG. 5A, 6A, 7A, 8A the long and short segments of the corner wall panels 16 and corresponding corner connectors 18 (see FIG. 9A) are formed, in the illustrative example, to include a 90 degree angle, such that combinations of the wall panels 14, 16 can be used to form structures 70 which are square, rectangular, L-shaped, U-shaped, H-shaped, of other polygon shapes including right angle corners. The example is non-limiting, such that corner panels 16 and corresponding corner connectors 16 having an included angle other than ninety degrees can be included in the wall building system 100, used in combination with full length and/or partial length wall panels 14 to assembly course modules 80 and/or wall structures 70 having different perimeter shapes. In one example, the corner panels 16 and corresponding corner connectors 18 can be formed having a curvilinear shape, such that a course module 80 including the curvilinear corner panels 16 and corner connectors 18 can be formed in an oval shape, as an S-shape, etc. The corners can be formed through molding, extruding, welding, bracketing, pinning, fastening, adhesive, or any other attachment or forming method allowing the corner to be created.

Referring to FIGS. 9A-12D, shown are internal structural connectors 18, 20, 21, 22, also referred to herein as panel connectors, which create the inner core and structural integrity of the wall system 100 by tying the inner and outer wall panels together turning the individual wall panels into a single structural wall mass 70. In the illustrative example shown the panel connectors 18, 20, 21, 22 have opposing longitudinal connector edges 59B and lateral panel edges 56B. The panel connectors 20, 21, 22 each contain a series of connecting pins 17 extending from an underside of the connector. Corner panel connector 18 contains a series of connecting pins 17 extending from both the top side and underside of the connector 18 to allow for non-handed use at any corner location within the course modules 80 and/or wall structure 70. The connector pins 17 on connectors 18, 20, 21, 22 are inserted into receiver through-holes of the receiving rail 11 to tie the inner and outer wall panels 14, 16 together. The connectors 18, 20, 21, 22 are designed specifically to transfer loads throughout the wall creating a single wall mass structure 70 as opposed to individual blocks tied together. As shown in the drawings, the connector 20 spans half the width of two individual adjacent panels 14, 16, locking across the vertical panel joint 68 with an integrated tensile stiffening cross member 55. The specific location of the panel connectors 18, 20, 21, 22 in relation to both the vertical and horizontal joints 68, 73 of the individual panels results in loads being transferred across a total wall mass for compression, tension, and torsion. Jamb panel connector 21 and partial panel connector 22 span specific areas of the module course 80 and wall 70, as shown in the drawings, and integrate the same tensile stiffening cross member 55 and connecting pins 17 into their design to tie the wall structure panels 14, 16 together. The corner panel connector 18 ties the corner wall panels 16 together and integrates an angular tensile stiffening member, also utilizing connecting pins 17 to attach the inner and outer wall panels 14, 16. The connectors 18, 20, 21, 22 each integrate structural openings 19, also referred to herein as pass-throughs 19, allowing for the introduction and receipt of structural members 48, also referred to herein as structural columns 48 and configured in the non-limiting example shown as columnar structures, to be integrated through the internal structure of the layered course modules 80 and the resultant wall structure 70. The pass-through openings 19 are designed specifically to align through the full vertical height of the wall structure 70 and layered course modules 80, allowing unencumbered installation of a structural unit 48 from the top of wall to the bottom. The pass-throughs 19 are specifically designed to meet International Building Code (IBC) spacing requirements for additional loading considerations. The connectors 18, 20, 21, 22 are designed to establish the thickness of the wall as measured from the exterior surface 72 of the outer wall panel 14, 16 to the exterior surface 72 of the inner wall panel 14, 16. The connectors 18, 20, 21, 22 can all be manufactured to any needed width effectively accommodating any required wall size, and such that the wall thickness of a course module 80 can be changed by changing the width of the connectors 18, 20, 21, 22. As shown in the drawings, panel connector 18 is a corner connector for use with corner wall panels 16. Panel connector 20 is a full length connector such that, when used to connect adjacent full length panels 14A, 14B as shown in FIGS. 27-30, the full length panel connector 20 spans about half of the length of the adjacent wall panels 14 being connected at a vertical panel joint 68, with the stiffening cross member 55 being located at the vertical panel joint 68, and such that a gap 69 is defined between the lateral edges 56B of adjacent panel connectors 20, as shown in the figures. Panel connectors 18, 20, 21, 22 can include a structural web 67 formed therein, where in the examples shown in FIGS. 9A, 10A, 11A and 12A, the web 57 is configured to increase the longitudinal tensile strength of the panel connector 18, 20, 21, 22.

Referring to FIGS. 13A-17C, FIGS. 34A-34B and FIG. 38, shown is a door module 75 of the wall building system 100. FIGS. 13A-13D illustrate a door jamb header 23 of the door module 75, also referred to herein as a door header 23, which can be inserted into a recessed portion of door header panels 24 26 shown in FIGS. 14A-15D and FIG. 34, to form a header assembly for the door module 75. The door jamb header 23 and side door jambs 30, 31 are arranged to form a door module 75, including door stops 27 extending from side door jambs 30, 31, for receiving and/or attaching a door (not shown).

Figure 34B:
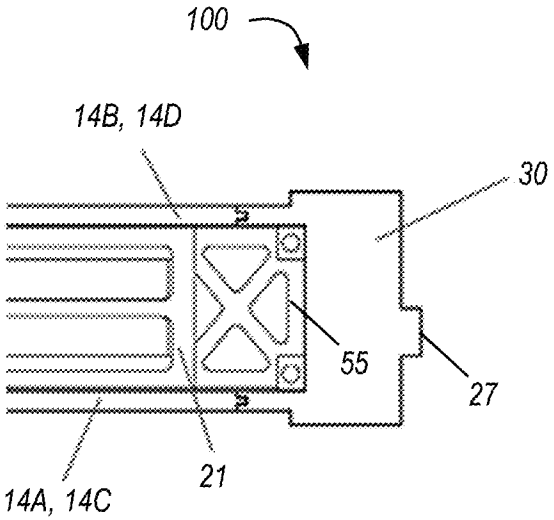
FIG. 34B is a schematic top cross-sectional view of course module of the wall structure of FIG. 34A, showing a door jamb of the door module of FIG. 34A and a jamb panel connector connecting the door jamb, inner wall panel and outer wall panel of the course module.

As shown in FIGS. 14A-15D, the inner door header panel 24 and the outer door header panel 26 each include, adjacent to a longitudinal header panel edge 59C, an upper receiving rail 11 for connecting to a panel connector 20, 22, and receiving rails 25, which can also be referred to herein as receiving blocks 25 at each lateral header panel edge 59C, including receiver through-holes for connecting to a jamb panel connector 21 as shown in FIG. 34B. The door header panels 24, 26 each include a panel tongue 13 extending from the longitudinal edge 59C, for connecting to wall panels 14, 16 of a course module 80 layered on the course module 80 including the door header 23 and header panels 24, 26, to form a horizontal panel joint 73 therewith. The door header panels 24, 26 each include a panel tongue 13 and a panel groove 15 defined by the opposing lateral edges 56C of the header panels 24, 26, for connection to adjacent wall panels 14, 16 to form vertical panel joints 68 therewith.

Figure 34A:
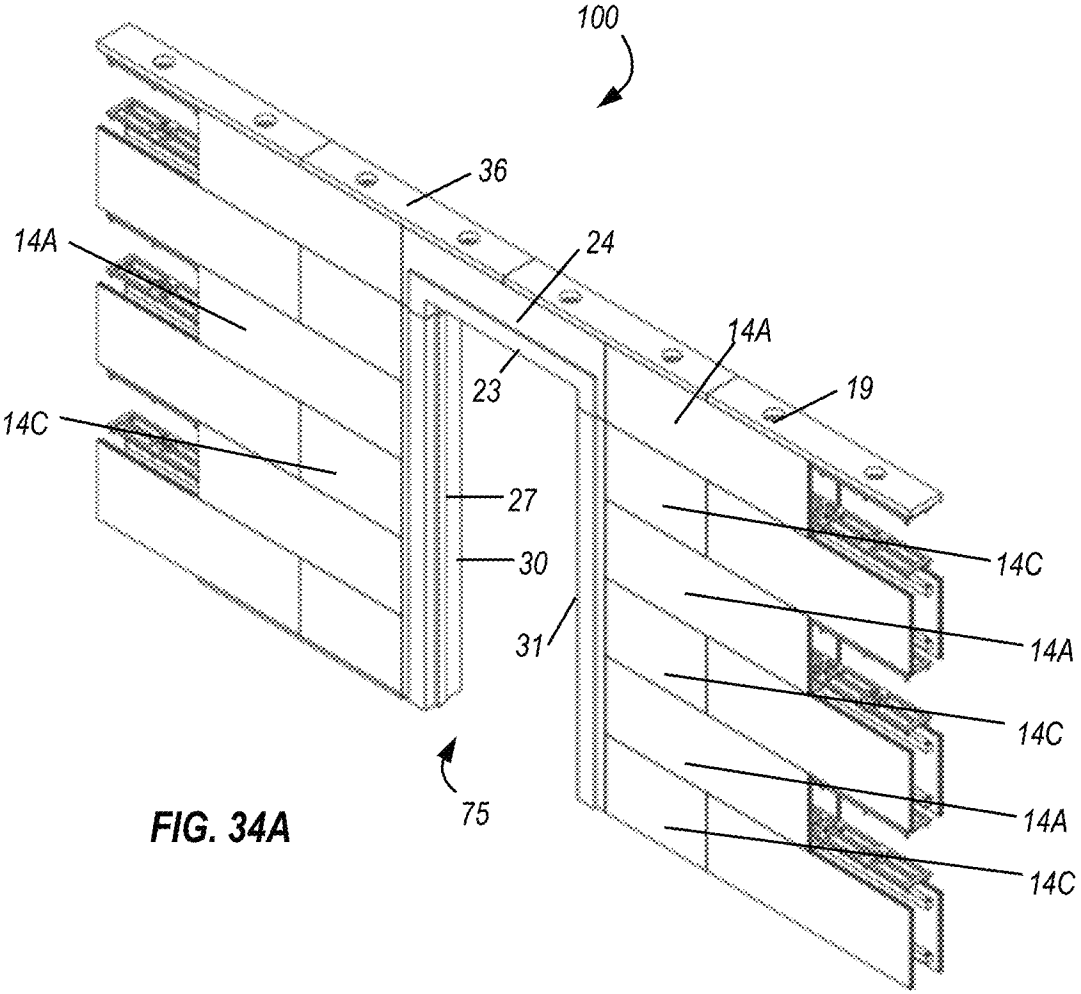
FIG. 34A is a schematic isometric view of wall structure of the modular wall building system as described herein, the wall structure including a door module installed in the wall structure.
Figures 35A, 35B, 35C, 35D:
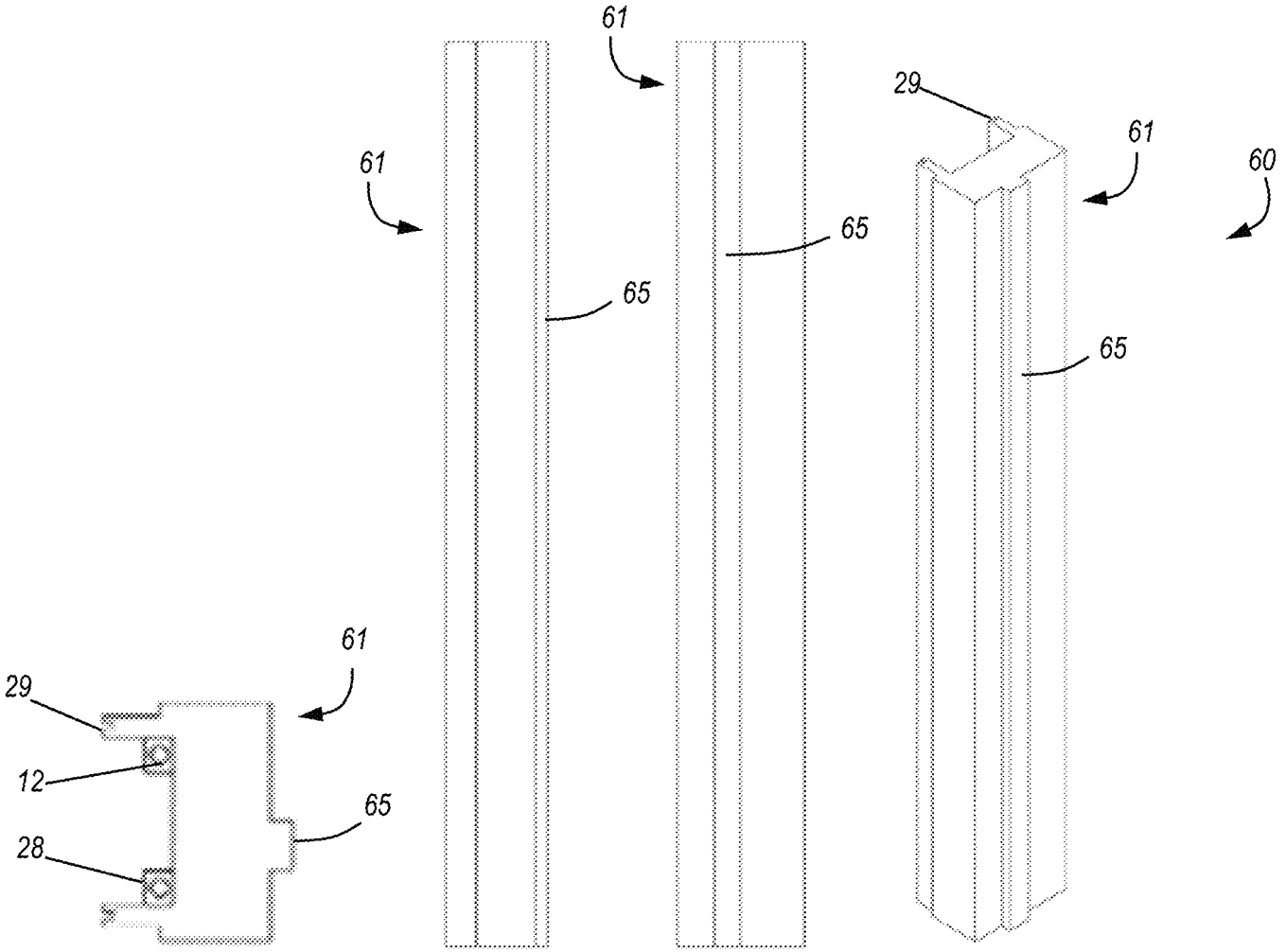
FIG. 35A is a schematic isometric view of a window jamb header of the modular wall building system as described herein.
FIG. 35B is a schematic side view of the window jamb header of FIG. 35A.
FIG. 35C is a schematic front view of the window jamb header of FIG. 35A.
FIG. 35D is a schematic top view of the window jamb header of FIG. 35A.
Figure 36A:
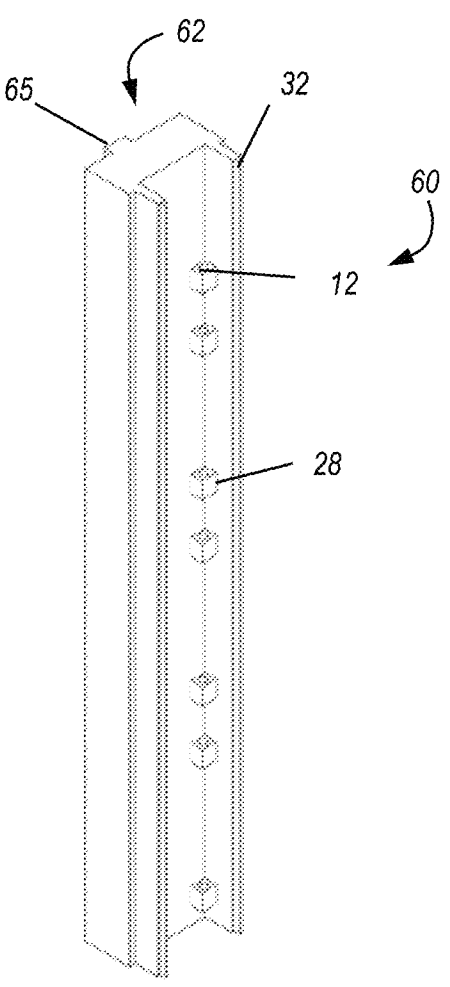
FIG. 36A is a schematic isometric view of a side window jamb of the modular wall building system as described herein.
Figure 36B:
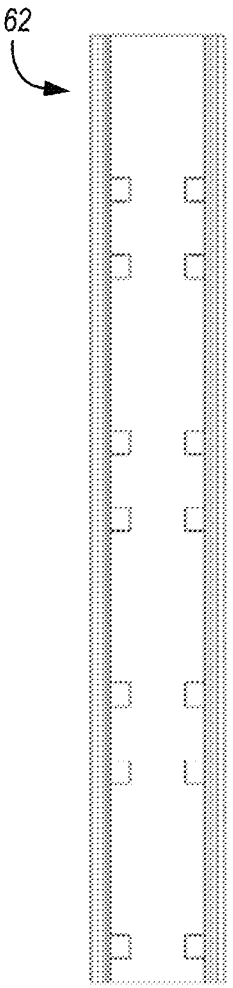
FIG. 36B is a schematic interior side view of the side window jamb of FIG. 36A.
Figure 36C:
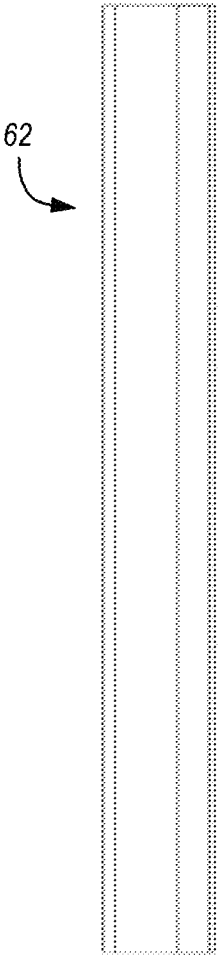
FIG. 36C is a schematic exterior side view of the side window jamb of FIG. 36A.
Figure 36D:
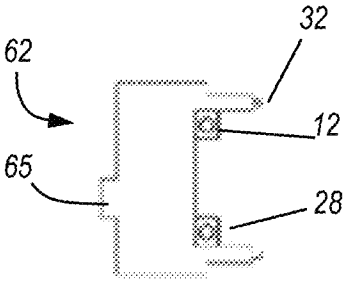
FIG. 36D is a schematic top view of the side window jamb of FIG. 36A.
Figure 37B:
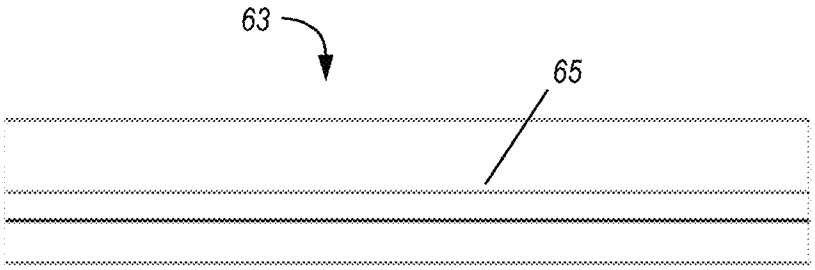
FIG. 37B is a schematic top view of the window lower jamb will of FIG. 37A.
Figure 37C:
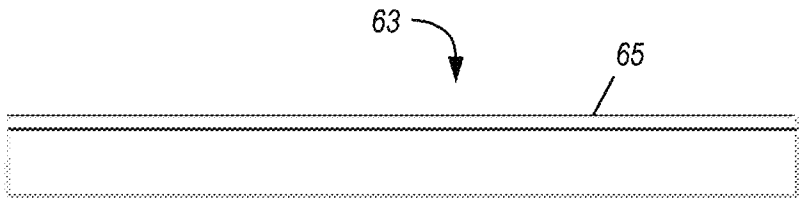
FIG. 37C is a schematic side view of the window lower jamb will of FIG. 37A.
Figure 37D:
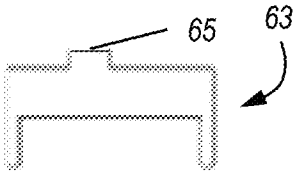
FIG. 37D is a schematic end view of the window lower jamb will of FIG. 37A.
Figure 37A:
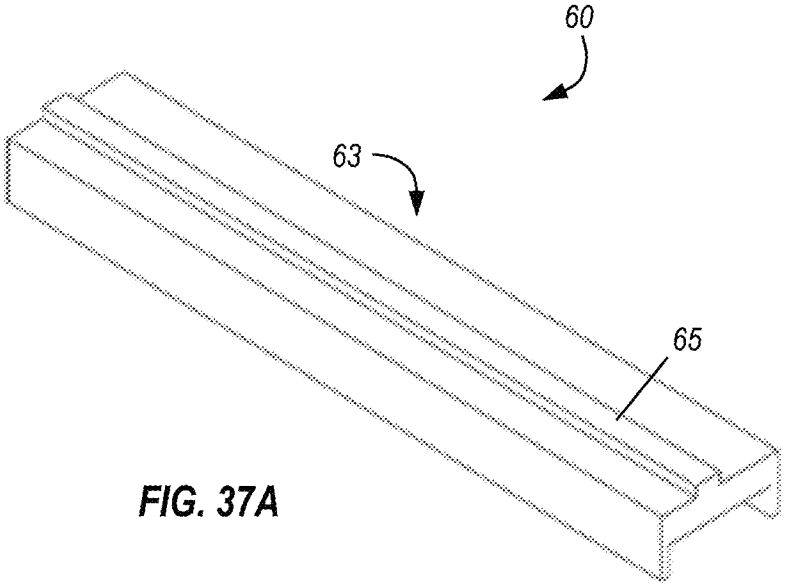
FIG. 37A is a schematic isometric view of a window lower jamb sill of the modular wall building system as described herein.

As shown in FIGS. 16A-17C, first and second door side jambs 30, 31 each include a jamb extension 27 extending into the door opening formed by the door module 75 when installed to a wall structure 70 as shown in FIG. 34A and FIG. 38. The jamb extension 27 can also be referred to herein as a door stop 27. Each of the door side jambs 30, 31 include pairs of receiving rails 28, which can also be referred to as receiving blocks 28, distributed vertically along the door side jamb 30, 31, including receiving through holes (see FIGS. 16C, 17C) for receiving connector pins 17 to attach jamb panel connectors 21 disposed in each of the layered course modules 80 to which the door side jambs 30, 31 are attached. Door side jamb 30 includes jamb grooves 29 for connecting to and forming a vertical joint with wall panels 14, 16 adjacent to the door side jamb 30 in each of the layered course modules 80 to which the door side jamb 30 are attached. Door side jamb 31 includes jamb tongues 32 for connecting to and forming a vertical joint with wall panels 14, 16 adjacent to the door side jamb 31 in each of the layered course modules 80 to which the door side jamb 31 is attached.

The door header 23, door header panels 24, 26, and door jambs 30, 31 can be molded, milled, or otherwise shaped from polymer based, plastic composite, carbon fiber composite, wood, metal, ballistic, or other materials capable of maintaining the designated shape and providing the structural strength of the door module 75. The door system 75 is an integrated module comprised of the door header 23, inner header panel 24, outer header panel 26, and side jamb 30 and side jamb 31. The system can be assembled as individual components or preassembled and installed as a complete integrated unit onsite. Door openings and sizes can be varied to meet required needs.

Referring to FIGS. 35A-37D, the wall building system 100 can include a window module 60 for assembly into a wall structure 70, where the wall module 60 can be provided as an integrated assembly comprised of a window header 64 (see FIG. 13A), window side jambs 61, 62 and a lower sill 63 as shown in FIGS. 35A through 37D. The window header 64 and window side jambs 61, 62 are configured for attachment to the course modules 80 as described for the door module 75. The window side jambs 61, 62 and lower sill 63 include a window jamb extension 65, also referred to herein as a window stop 65, for receiving a window to the window module 60. The lower sill 63 includes flanges extending from the underside of lower sill, such that the lower sill can be fitted over the wall panels 14, 16 of the course module 80 supporting the window module 60. The window module 60 can be assembled from individual components 61, 62, 63, 64 or preassembled and installed as a complete integrated window unit onsite. Window openings and sizes can be varied to meet required needs. Side jambs 61, 62 have individual receiving rails 28 with receiver through-holes 12 for attachment, as shown in the figures.

Figure 18A:
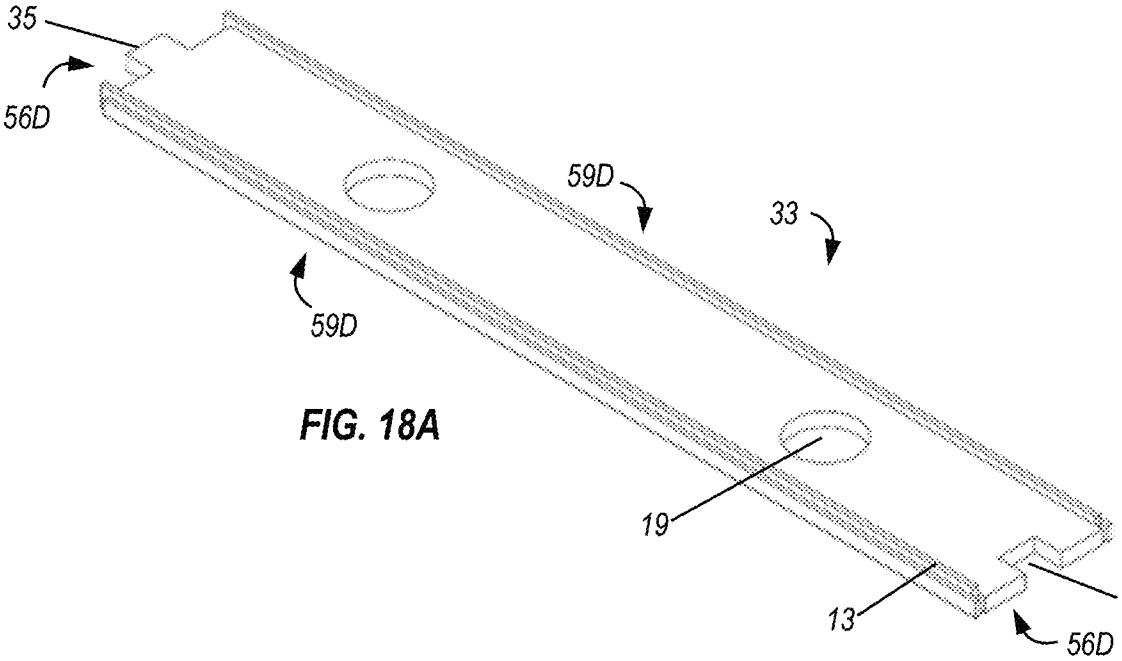
FIG. 18A is a schematic isometric view of a bottom plate with an integrated locking tab and receiver for assembling a starter or bottom course module for the modular wall building system as described herein, and showing panel tongues for connecting the bottom plate to inner and outer wall panels.
Figure 18B:
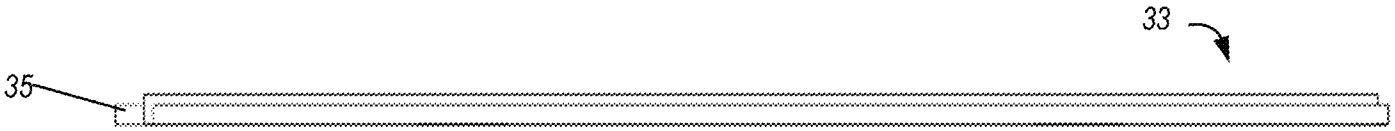
FIG. 18B is a schematic side view of the bottom plate of FIG. 18A.
Figure 22B:
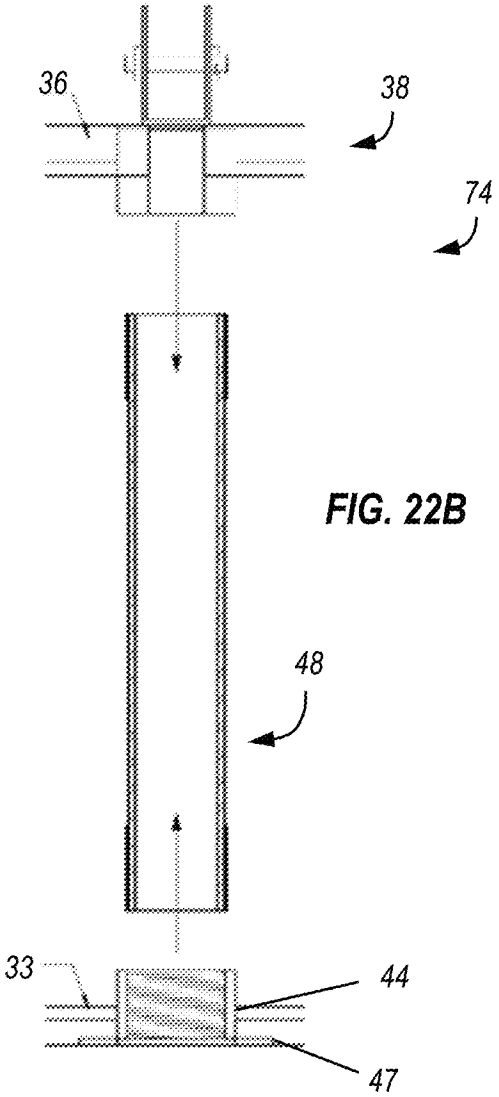
FIG. 22B is a schematic sectional view of the column assembly of FIG. 22A.
Figure 24:
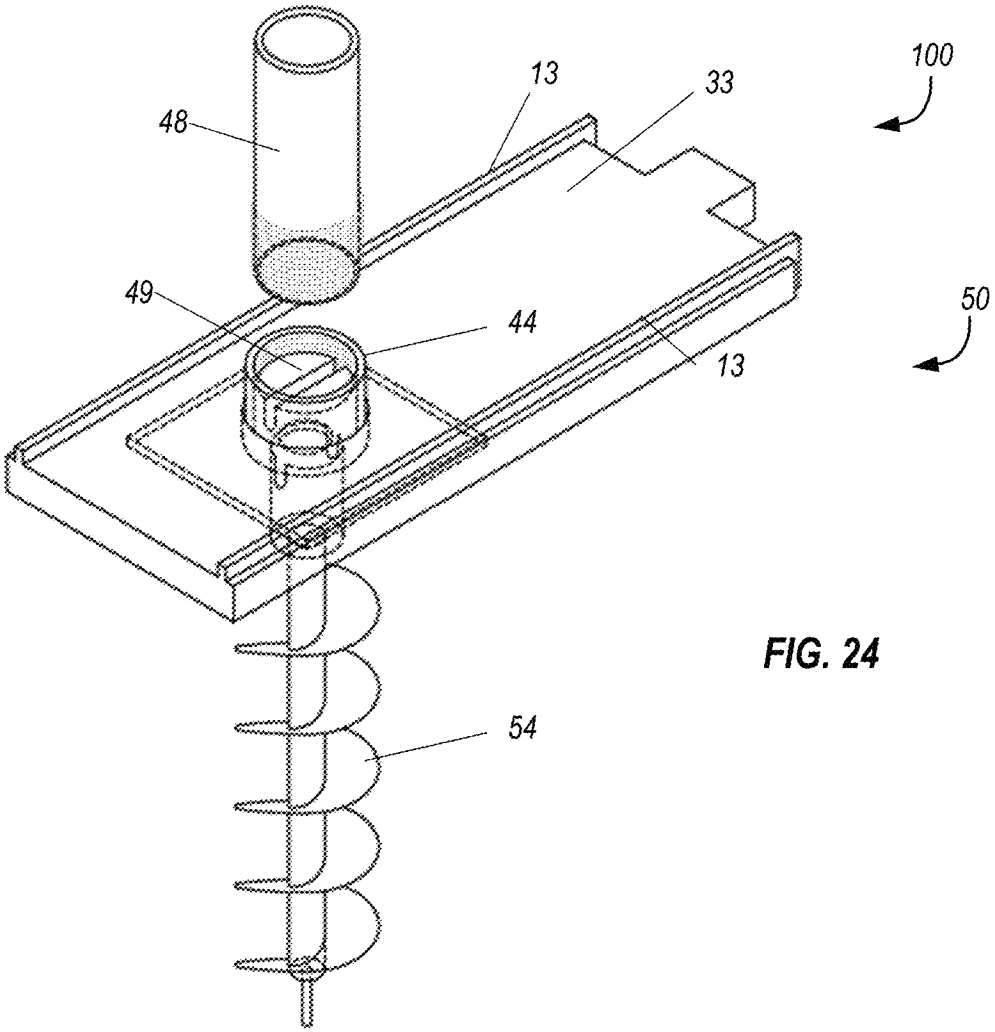
FIG. 24 is a schematic isometric partially exploded view of the tie down system of FIG. 23A attached to the bottom plate and lower connector.
Figure 25:
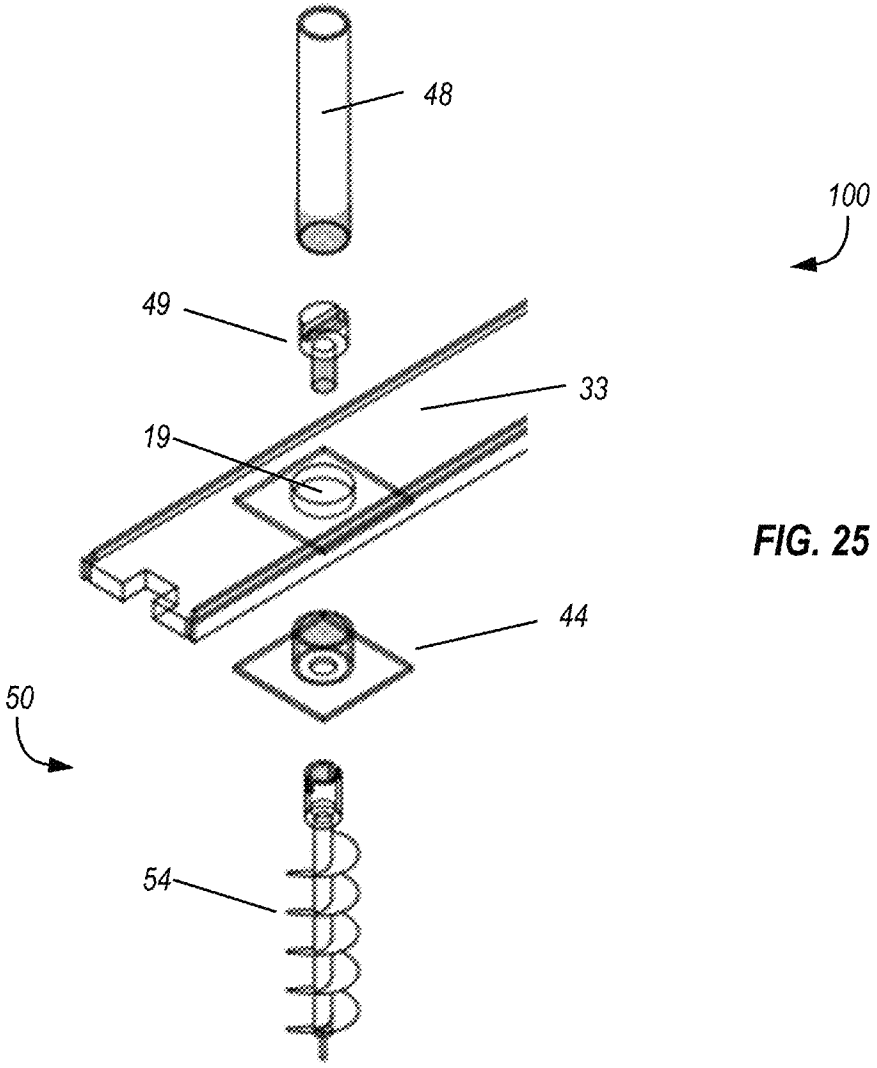
FIG. 25 is a schematic isometric exploded view of the tie down system of FIG. 23A showing the bottom plate and lower connector.
Figure 30:
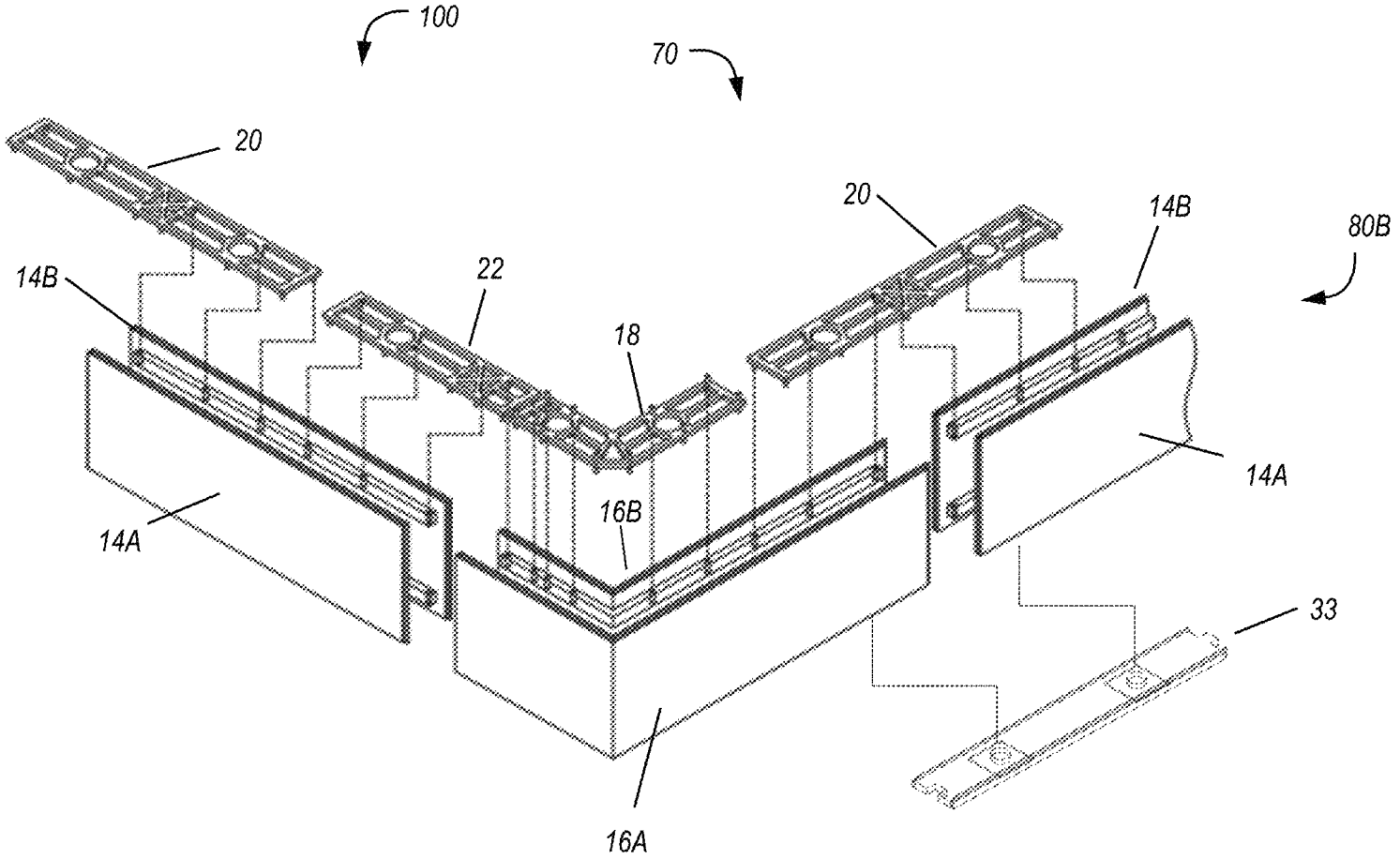
FIG. 30 is a schematic isometric exploded view of a corner portion of a bottom course module including full length, partial length and corner panel connectors and a bottom plate in relative arrangement to the inner and outer wall panels, where the bottom plate and panel connectors in an installed position each span the vertical wall joint formed between the adjacent panels connected by the bottom plate and panel connectors.

FIGS. 18A-18B show a base plate 33 which can be joined to other base plates 33 via tab extensions 35 and tab receivers 34, also referred to herein as bowtie extensions 35 and bow tie receivers 34, to form a base plate starter course, upon which a bottom course module 80B can be layered and attached, as shown in FIG. 30. The base plate 33, also referred to herein as a bottom plate 33, includes the bow tie locating system 35, 34, lateral through-holes 19, opposing longitudinal plate edges 59D, and opposing lateral plate edges 56D and tongues 13 extending top side from longitudinal plate edges 59D to receive and attach to the wall panels 14, 15 of the bottom course module 80B, as shown in FIG. 30. The lateral through-holes 19, also referred to herein as structural openings 19, are each configured to receive a structural column 48 and/or lower connector 44, also referred to as a base connector 44, as shown in FIGS. 22B, 24 and 25 and described in further detail herein. The width, length, and thickness of the base plate 33 can be modified to meet required needs, including interfacing with the components of the bottom course module 80B. The bottom plate can be extruded, molded, milled, stamped, pressed, or otherwise shaped from polymer-based material, plastic composite, wood, metal, ballistic materials, carbon fiber, or other materials capable of maintaining the designated shape. The bottom plate 33 can be colored as needed, and/or coated or painted, for example, for corrosion resistance and/or environmental attack.

Figure 19B:
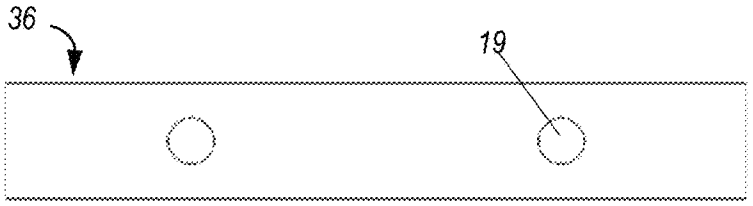
FIG. 19B is a schematic top view of the top plate of FIG. 19A.
Figure 19C:
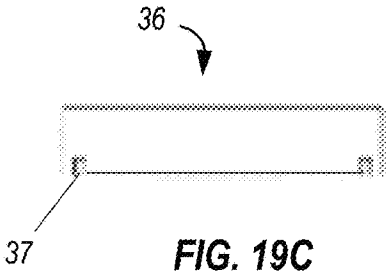
FIG. 19C is a schematic end view of the top plate of FIG. 19A, showing panel grooves for connecting the top plate to inner and outer wall panels.
Figure 19A:
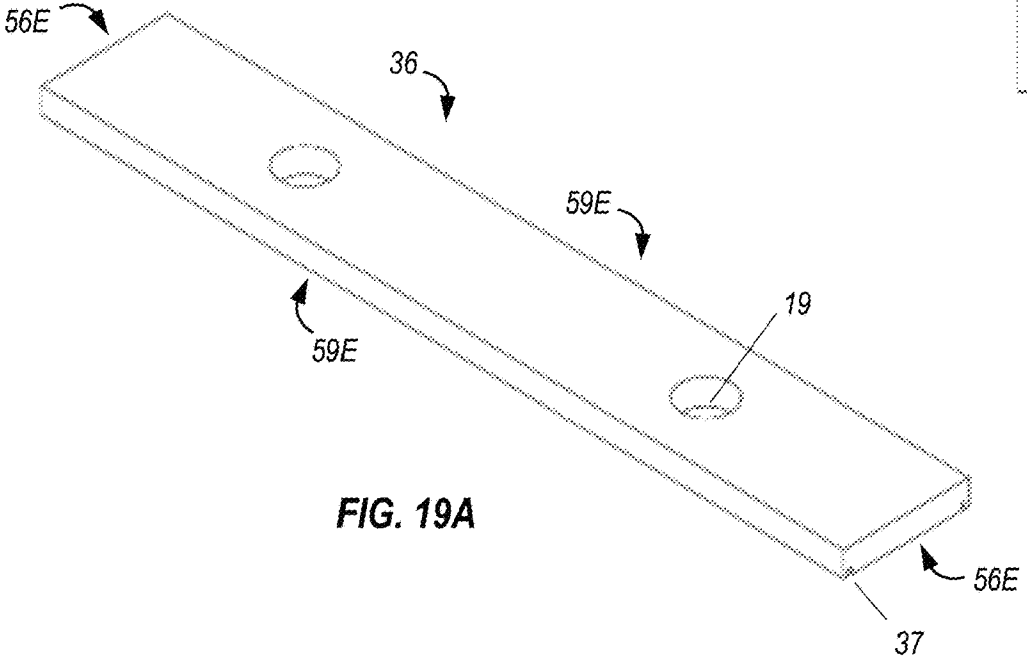
FIG. 19A is a schematic isometric view of a top plate including structural through holes for assembling a top course module for the modular wall building system as described herein.
Figure 33:
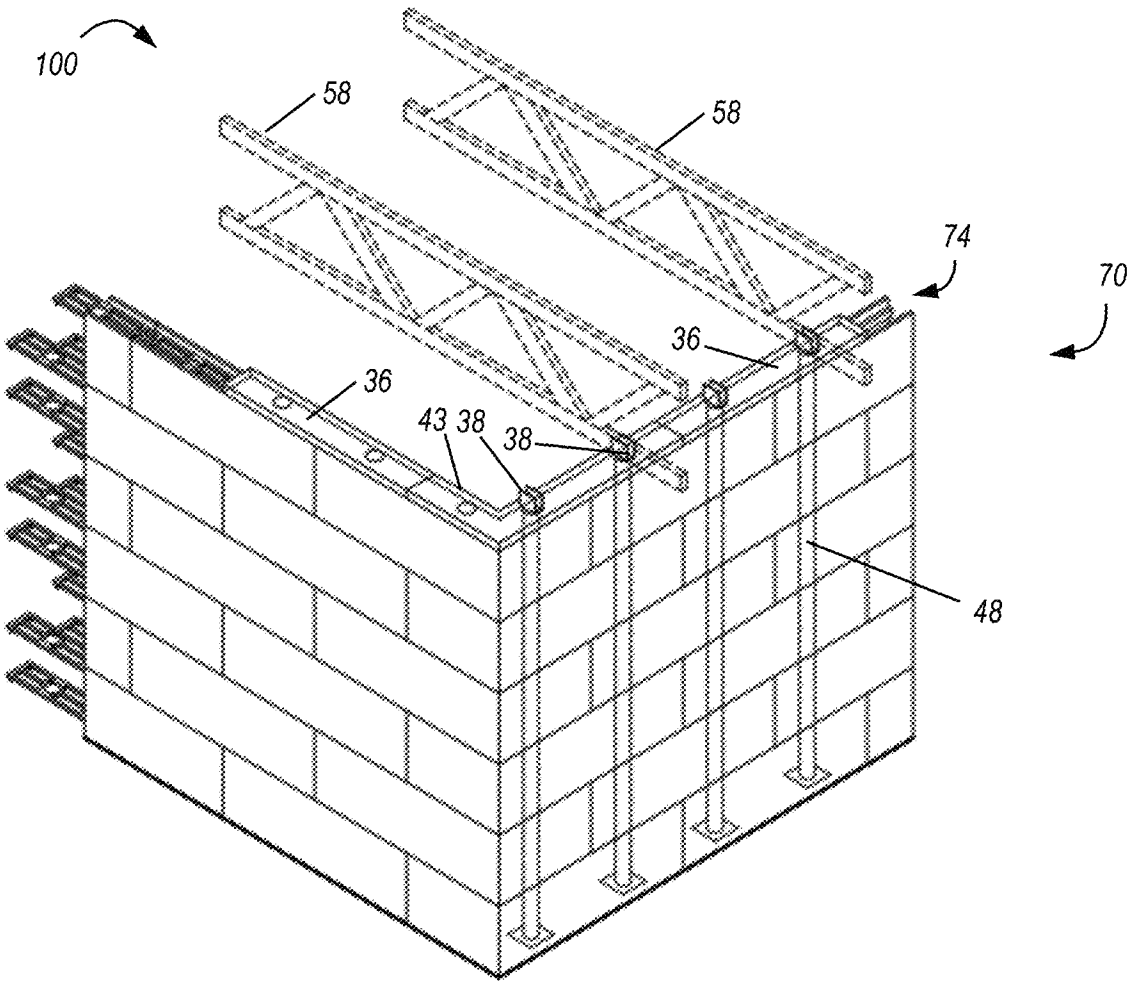
FIG. 33 is a schematic isometric view of the completed wall structure of FIG. 31 further including example trusses installed to the truss connectors.

FIGS. 19A-19C show a top plate 36 including structural openings 19, opposing longitudinal plate edges 59E, and opposing lateral plate edges 56E, and top plate grooves 37 for attaching the top plates 36 to wall panels 14, 16 of a top course 80C, as shown in FIG. 32, where the top plates 36 attached to the top course 80C comprise a top course. The structural openings 19 are each configured to receive a structural column 48 and/or upper connector 38, also referred to herein as a truss connector 38. As shown in FIG. 33, a corner top plate 43 can be provided to connect top plates 36 of the top plate course. The width, length, and thickness of the top plates 36, 43 can be modified to meet required needs and to correspond to the interfacing components of the top course module 80C. The top plates 36, 43 can be extruded, molded, milled, stamped, pressed, or otherwise shaped from polymer-based material, plastic composite, wood, metal, ballistic materials, carbon fiber, or other materials capable of maintaining the designated shape. The top plates 36, 43 can be colored as needed, and/or coated or painted, for example, for corrosion resistance and/or environmental attack.

As shown in FIGS. 22A-22B and FIGS. 31-33, a structural module 74 installed between the inner and outer wall panels 14, 16 is comprised of the truss connector 38, lower connector 44, and structural column 48. The structural module 74 is specifically designed to compress the wall structure 70 into a single mass as the truss connector 38 and lower connector 44 are tightened, such that the truss connector 38 bears on the top plate 36 and the lower connector plate 47 of the lower connector 44 bears against the bottom plate 33 from the underside. When tightened through the structural column 48, the truss connector 38 and lower connector 44 sandwich the layered course modules 80 between the top and bottom plates 36, 33, tying the wall panels 14, 16 and the layered course modules 80 into a single wall mass. The truss connector 38, lower connector 44, and structural column 48 can be sized to meet a required need. The structural column 48 can be any shape (circular, square, hexagon, etc) and composed of metal, composite, plastic, polymer-based material, wood, or other material able to retain shape while providing structural column strength to the structural module 74.

FIGS. 20A-20D show the truss connector 38 in additional detail. The truss connector 38 can be formed of a plastic composite material, a polymer based material, or metal with or without ballistic capabilities, and may be coated or otherwise treated to prevent environmental attack. The truss connector 48 incorporates a threaded connector cup 39, also referred to herein as an upper connector cup 39, for attachment to a threaded column end 57 of the structural column 48. The truss connector 48 includes a truss bracket 42 for receiving a truss 58, as shown in FIG. 33. The truss connector 48, in a non-limiting example, can include attachment holes 41 for receiving a bolt 40 or other fastener, for fastening the truss 58 to the truss connector 38.

Figure 20B:
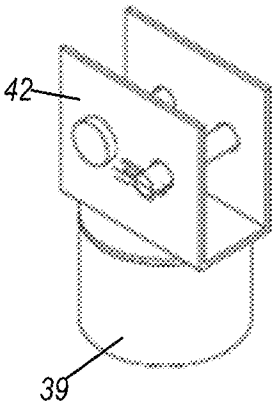
FIG. 20B is a schematic isometric view of the truss connector of FIG. 20A.
Figure 20D:
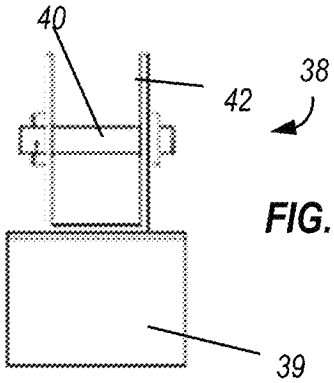
FIG. 20D is a schematic front view of the truss connector of FIG. 20A.
Figure 20A:
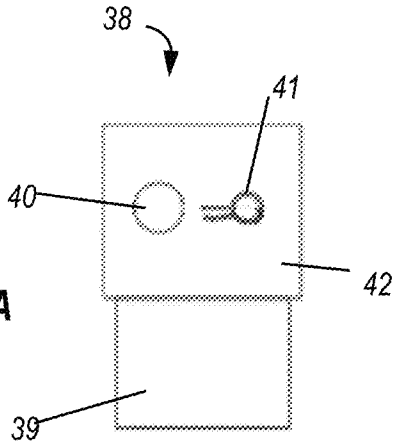
FIG. 20A is a schematic end view of a truss connector for assembling a top course module for the modular wall building system as described herein.
Figure 20C:
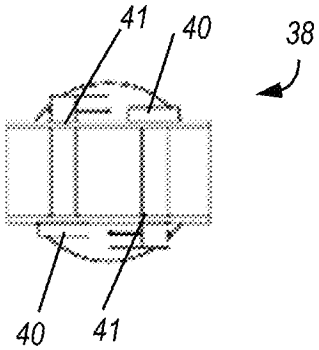
FIG. 20C is a schematic top view of the truss connector of FIG. 20A.
Figure 21A:
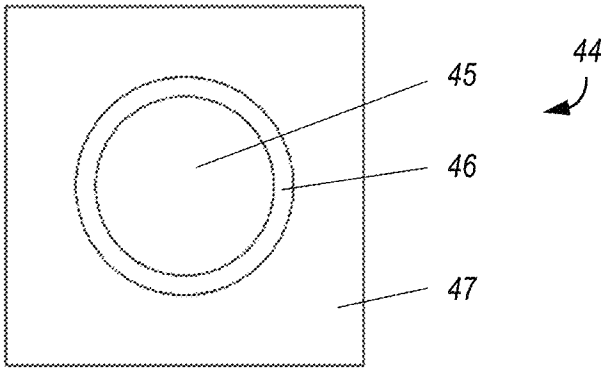
FIG. 21A is a schematic top view of a base plate (lower) connector for assembling a bottom course module for the modular wall building system as described herein.
Figure 21B:
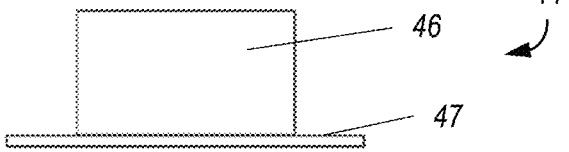
FIG. 21B is a schematic side view of the lower connector of FIG. 21A.
Figure 21C:
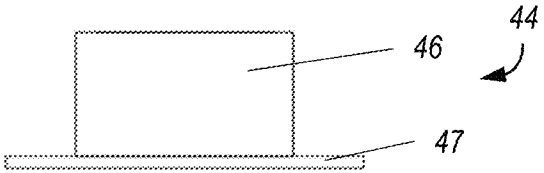
FIG. 21C is a schematic front view of the lower connector of FIG. 21A.
Figure 21D:
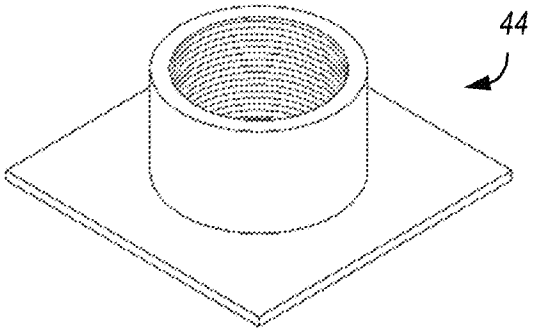
FIG. 21D is a schematic isometric view of the lower connector of FIG. 21A.
Figure 22A:
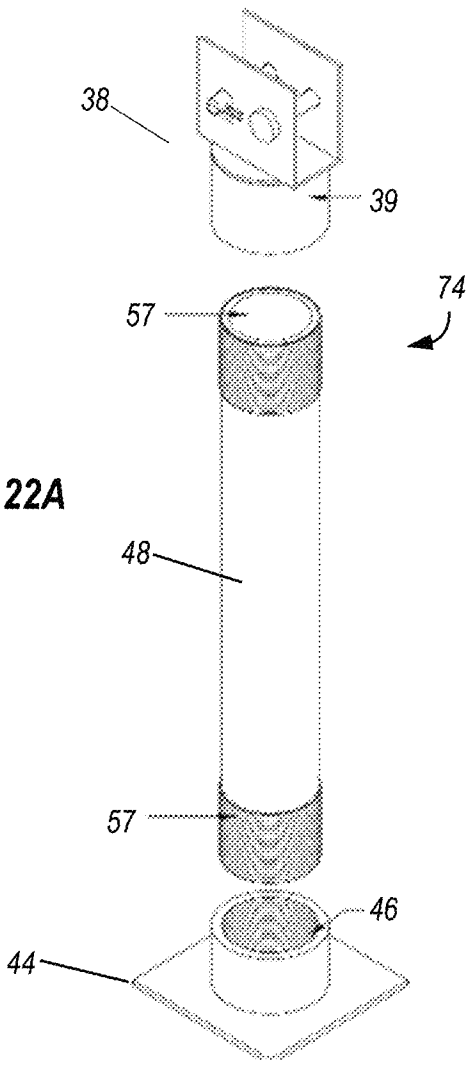
FIG. 22A is a schematic isometric exploded view of a structural column assembly including a structural column, a truss connector, and a lower connector.
Figure 23C:
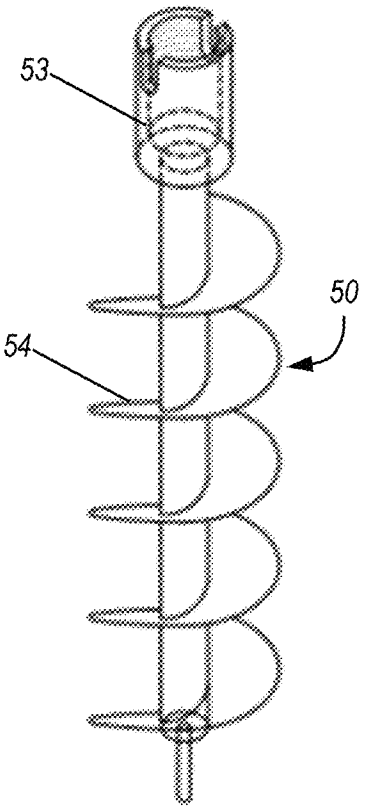
FIG. 23C is a schematic isometric view of the attachment pier of the tie down system of FIG. 23A, the attachment pier including an attachment receiver.
Figure 23B:
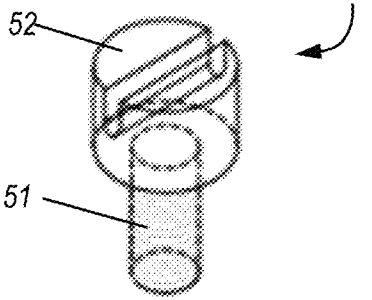
FIG. 23B is a schematic n isometric view of the tie down attachment screw of FIG. 23A.
Figure 23A:
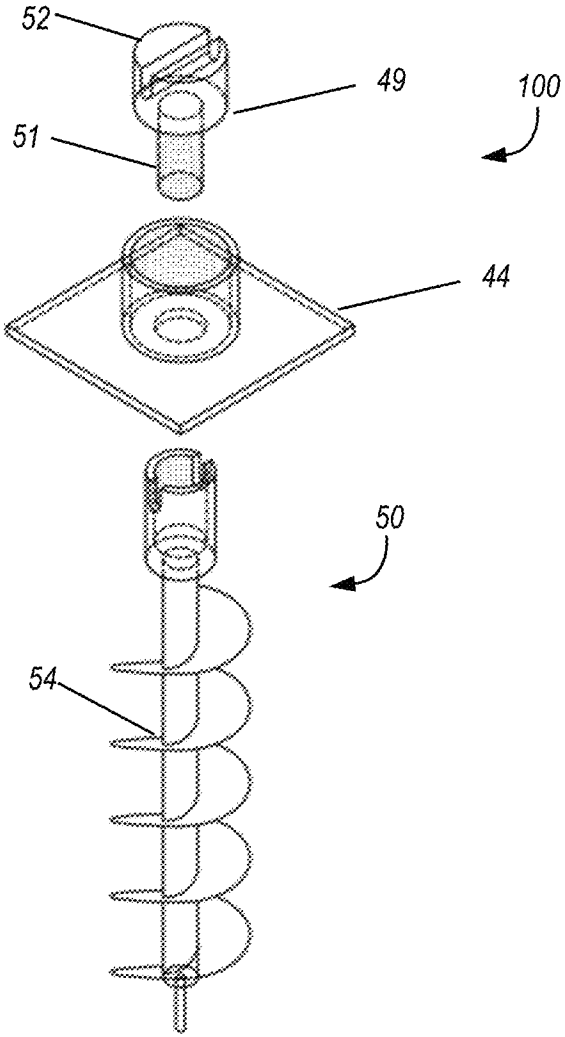
FIG. 23A is a schematic isometric exploded view of a structural tie down system for fastening the bottom course module to a foundation, including an attachment pier and an attachment screw attachable to the lower connector.

FIGS. 21A-20D show the lower connector 44, which can also be referred to herein as a lower column attachment plate. The lower connector 44 can be built of plastic composite or metal with or without ballistic capabilities, and may be coated or otherwise treated to prevent environmental attack. The lower connector 44 includes a threaded lower connector cup 46, for insertion of a structural column 48 via a cup opening 45, and attachment to a threaded column end 57 of the structural column 48, and a lower connector plate 47 for interfacing with and being retained against the bottom plate 33 as the structural module 74 is tightened into tension as previously described herein, and as shown in FIGS. 22A and 22B.

In a non-limiting example, the modular wall building system 100 can include a tie down system 50 as shown in FIGS. 23A-23C, 24, and 25, which is configured to tie the wall structure 70 to a foundation structure (not shown), which may be, for example, the ground upon which the wall structure 70 is installed, for semi-permanent and/or permanent installations of the wall structure 70, and/or for temporary installations of the wall structure 70 where environmental conditions such as high wind conditions, warrant installation of the tie down system 50. The tie down system 50 passes through and integrates to the lower connector 44 and bottom plate 33, as shown in FIGS. 23-24. In the illustrative example shown in the figures, the tie down system includes a helical attachment pier 54 for attaching the bottom plates 33 to a foundation structure, which in the example is the ground. The example is non-limiting, and it would be understood that the tie down system 50 can be configured to attach the bottom plates 33 to any suitable foundation structure, including, for example, a concrete slab, asphalt pavement, wood or composite decking, another structure, such as a boat deck or a building roof, etc. In the illustrative example, the tie down system 50 is comprised of the helical attachment pier 54 and an attachment screw 49. In the example shown, the attachment screw includes a screw thread 51 and a screw head 52. The helical attachment 54, in the example shown, includes a receiver cup 53 having a slotted upper edge such that the helical attachment 54 can be manually screwed into the ground using a hand attachment, such as a T-handle inserted to the slot. The bottom plates 33 and lower attachment plate 44 are installed over the receiver cup of the helical attachment with the receiver cup aligned with the lateral through-hole 19 and lower attachment plate. The tie down attachment screw 49 is then inserted into the lower attachment plate 44 and the screw thread 51 is screwed into the top of the helical pier receiver cup 54 effectively tying the helical tie down 54 to the base plate starter course 33. A structural element 48 is then threaded to the lower attachment plate effectively tying the full wall to the ground once the upper truss connector 38 is secured and tightened on the top of the structural element 48 over the top plate.

FIGS. 26-34B in combination with the remaining figures and description of the modular wall building system 100 provided herein, illustrate a method for assembling and/or fabricating a wall structure 70, such as the non-limiting example wall structure 70 shown in FIG. 38. Referring to FIG. 26, the assembly process of installing a connector 18, 20, 21, 22 to a panel 14, 16 is illustrated. Connector pins 17 are aligned with and inserted into the receiver through-holes 12 of the panel receiving rails 11, and then manually pressed or pounded into position until the connector 18, 20, 21, 22 is fully seated against the top surface of the receiver rail 11. The connector pins 17 may be chamfered at the ends to facilitate alignment with the receiver through-holes 12. The receiver through-holes 12 can also be formed as blind holes for receiving the connector pins 17. By being formed as through-holes 12, the system 100 is advantaged in that connector pins 17 can be pushed out of the through-holes 12 by a force exerted on the ends of the pins via the through-hole opening at the bottom side of the receiving rail 11, to assist in removal of the connectors 18, 20, 21, 22 from the panels 14, 16 during disassembly of the wall structure 70, as may be required for transport and reinstallation or reconfiguration of the wall structure 70. Gravity and friction hold the connection pins 17 in place in the through-holes 12 during assembly of the course modules 80.

A completed course module 80 has all connectors 18, 20, 21, 22 fully seated in the receiving rails 11 of the wall panels 14, 16 forming the course module. All vertical panel joints 68 have a tensile stiffening cross member 55 of a panel connector 18, 20, 21, 22 located at centerline of the vertical joint 68. In the example shown, full connectors 20 span half the distance of each panel 14, 16 they are attaching.

The corner assembly of each course module 80 is comprised of a corner inner and outer panels 16, a corner connector 18, a partial connector 22, a full connector 20, and two sets of inner 14B and outer 14A panels. The partial connector 22 is connected to the receiving rails 11 of the short leg segments of the corner panels 16, takeoff tying the corner panels 16 to the full-size panel 14.

As shown in FIG. 30, in forming the bottom course module 80B, the corner panels 16A, 16B are set in position atop starter course formed of base plates 33. Corner connector 18 is installed and seated. Inner and outer panels 14B, 14A are set against the corner panels 16 with the tongue 13 and grooves 15 aligned and pushed together to form vertical panel joints 68. The connectors 22 and 20 are then installed on both the upper and lower receiving rails 11 tying the corner wall panels 16 to the full length wall panels 14. Intermediate wall panels 14 and connectors 20, 21, 22 are installed between the corner assemblies, to connect the corner assemblies to each other, completing assembly of the bottom course module 80B. As previously described herein, door side jambs 30, 31 of a door module 75 can be installed to the bottom course module 80B as required.

As shown in FIG. 31, a first wall course module 80A (layer of panels 14, 16 and connectors 18, 20, 21, 22) is assembled and set in position atop the constructed bottom course module 80B. The long panel segment and short panel segment of the corner panels 16 are alternated between the bottom course module 80B and the first wall course module 80A to create a running bond pattern as shown in FIG. 31. Each additional wall course module 80A (layers) is assembled and set in position atop the previously assembled wall course module 80A, alternating the long panel segment and short panel segment of the layered wall course modules 80A to continue the running bond pattern as shown in FIG. 31. This installation pattern and process is repeated and continued until the number of wall course modules 80A are layered and connected to form a wall structure 70 of the required height.

Referring to FIGS. 22B, 30 and 31, for wall structures 70 including structural modules 74, the lower connector 44 is inserted to the bottom plate 33 while forming the starter course and prior to assembling the bottom course module 80B onto the bottom plates 33 comprising the starter course. Installation of the structural column 48 to the lower connector cup of the lower connector 44 can occur at any time during layering and assembly of the course modules 80A, 80B, 80C. For example, the structural column 48 can be inserted through one or more assembled and layered course modules 80 as shown in FIG. 31, by inserting the structural column 48 through the structural openings 19 of the layered and assembled course modules 80, and screwing the threaded column end 57 into the lower connector cup 46. In this example, as additional course modules 80 are assembled, the connectors 18, 20, 21, 22 are positioned inserting the ends 57 of the structural columns 48 through the structural openings 19 of the panel connectors 18, 20, 21, 22, as shown in FIG. 31. Alternately, the course modules 80A, 80B, 80C can be fully assembled and the structural columns 48 then installed by insertion though the layered course modules 80A, 80B, 80C and attachment to the lower connector cup 46.

Completion of a full wall height is capped by a top course module 80C and the top cap 36, which can also be referred to as a top plate 36, and secured with the truss connector 38, as shown in FIG. 32. The grooves 15 of the top cap 36 are aligned with the panel tongues 13 of the wall panels 14, 16 forming the top course module 80C and are pressed down until the panel tongues 13 are fully seated in the grooves 15, to provide a secure attachment resistant to water and air leakage. The truss connector 38 is then aligned with the structural column 48 and threaded into position and tightened.

Roofs can be installed utilizing truss systems (gable, flat, shed, hip, etc), or covered using tent/barrel system and tarped. Roofs can also be left completely open with no covering as needed. Roofs can be fabricated using locally sourced materials, such as thatch, bamboo, etc. In a non-limiting example shown in FIG. 33, trusses are attached to the truss connectors to form a truss roof structure.

FIG. 34A shows a wall structure 70 assembled with a door module 75 installed, assembled using the door module 75 components as shown in FIGS. 13A-17B, as previously described herein.

Other configurations and uses of the modular building system 100 are possible. For example, the modular building system 100 can be used for the constructions of permanent structures, including houses, offices, storage facilities, etc., and may be adapted to incorporate, for example, plumbing, electrical, and/or heating, ventilation and/or cooling systems. In one example, a filler material may be installed into the wall structure, to modify the insulating, ballistic, thermal, or other structural characteristics of the wall structure. The filler material may be a removable material, for example, a locally sourced or organic material such as straw, mud or dirt, wool, cotton, wood fiber, etc., or a permanent or semi-permanent installed material structural material such as foam insulation, concrete, etc. In one example, the modular building system 100 can be combined with conventional building structures and/or materials to form a hybrid structure, or can be configured as a connecting structure between other structures.

The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of 'comprising' and "including" to provide more specific embodiments and are also disclosed. As used in this disclosure and in the appended claims, the singular forms "a", "an", "the", include plural referents unless the context clearly dictates otherwise.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The following Clauses provide example configurations of a modular wall building system including a course module disclosed herein.

Clause 1. A course module for a modular wall building system, each course module comprising: at least one inner wall panel; at least one outer wall panel; wherein each of the inner wall panels and each of the outer wall panels comprises: upper and lower receiving rails extending from an interior surface of the wall panel; each of the receiving rails including a plurality of receiver holes; a first longitudinal panel edge adjacent a first lateral panel edge; a second longitudinal panel edge opposing the first longitudinal panel edge and adjacent a second lateral panel edge, the second lateral panel edge opposing the first lateral panel edge; a panel tongue defined by the first longitudinal panel edge and the first lateral panel edge; a panel groove extending from the second longitudinal panel edge and the second lateral panel edge; wherein the panel tongue defined by the first lateral panel edge of a respective inner panel is inserted into the panel groove of an adjacent inner panel to form a panel joint therebetween connecting the respective and adjacent inner panels; wherein the panel tongue defined by the first lateral panel edge of a respective inner panel is inserted into the panel groove extending from the second lateral panel edge of an adjacent inner panel to define a panel joint therebetween connecting the respective and adjacent inner panels; wherein the panel tongue defined by the first lateral panel edge of a respective outer panel is inserted into the panel groove extending from the second lateral panel edge of an adjacent outer panel to form a panel joint therebetween connecting the respective and adjacent outer panels; panel connectors; wherein each of the panel connectors comprises: a first longitudinal connector edge positioned adjacent a first lateral connector edge; a second longitudinal edge opposing the first longitudinal edge and positioned adjacent a second lateral connector edge, the second lateral connector edge opposing the first lateral connector edge; a first plurality of connector pins extending from the panel connector and distributed along the first longitudinal connector edge; a second plurality of connector pins extending from the panel connector and distributed along the second longitudinal connector edge; wherein each of the first and second plurality of connector pins are configured to be received into the receiver holes of the receiving rail thereby attaching the panel connector to the receiving rail; wherein each of the panel connectors are disposed between the inner wall panels and the outer wall panels and connected via the connector pins to the receiving rails such that each panel connector is at least one of: an upper panel connector attached to the upper receiving rails of the respective and adjacent inner wall panels and to the upper receiving rails of the respective and adjacent outer wall panels; or a lower panel connector attached to the lower receiving rails of the respective and adjacent inner wall panels and to the lower receiving rails of the respective and adjacent outer wall panels; wherein the upper panel connector is positioned such that: the first longitudinal connector edge of the upper panel connector is connected to the upper receiving rails of the respective and adjacent inner panels such that the upper panel connector spans the first panel joint and connects the upper receiving rail of the first inner panel to the second inner panel; and the second longitudinal connector edge of the upper panel connector is connected to the upper receiving rails of the respective and adjacent outer panels such that the upper panel connector spans the second panel joint and connects the upper receiving rail of the first outer panel to the second outer panel; and wherein the lower panel connector is positioned such that: the first longitudinal connector edge of the lower panel connector is connected to the lower receiving rails of the respective and adjacent inner panels such that the lower panel connector spans the first panel joint and connects the lower receiving rail of the first inner panel to the second inner panel; the second longitudinal connector edge of the lower panel connector is connected to the lower receiving rails of the respective and adjacent outer panels such that the lower panel connector spans the second panel joint and connects the lower receiving rail of the first outer panel to the second outer panel.

Clause 2. The course module of clause 1, wherein the upper receiving rail is positioned adjacent to the first longitudinal panel edge and the lower receiving rail is positioned adjacent to the second longitudinal panel edge.

Clause 3. The course module of clause 2, wherein the upper receiving rail is parallel to the first longitudinal panel edge and the lower receiving rail is parallel to the second longitudinal panel edge.

Clause 4. The course module of clause 1, wherein the plurality of receiver holes are distributed longitudinally in the receiving rails.

Clause 5. The course module of clause 1, wherein each of the panel connectors includes a structural opening configured to receive a vertical structural member through the structural opening.

Clause 6. The course module of clause 1, wherein the panel connectors include a full length connector, a partial length connector, and a corner connector; wherein the inner wall panels include inner full length panels, inner partial length panels, and inner corner panels; wherein the outer wall panels include outer full length panels, outer partial length panels, and outer corner panels; and wherein the corner connector is attachable to the inner and outer corner panels to selectively attach the inner corner panel to the full length inner panel or the partial length inner panel, and to selectively attach the outer corner panel to the full length inner panel or the partial length inner panel.

Clause 7. The course module of clause 1, wherein the panel connectors include a jamb connector; wherein the jamb connector includes a stiffening member positioned adjacent the first lateral edge; wherein the jamb connector is configured such that the stiffening member is attachable to a door jamb via a plurality of connectors pins extending from the stiffening member adjacent the first lateral edge.

Clause 8. The course module of clause 1, further including a door header, wherein: the inner wall panels include at least one inner header panel; the outer wall panels include at least one outer header panel; each of the inner and outer header panels includes an upper receiving rail adjacent the first longitudinal edge of the header panel; each of the inner and outer header panels includes a first lower receiving rail adjacent the first lateral edge of the header panel and a second lower receiving rail adjacent the second lateral edge of the header panel; and each of the inner and outer header panels is configured to receive the door header between the first and second lower receiving rails.

Clause 9. The course module of clause 1, wherein: the course module is one of a plurality of course modules including a wall course module and a top course module; wherein the top course module is attached to the wall course module via insertion of the panel tongue defined by the first longitudinal edges of the wall panels forming the wall course module into the panel groove defined by the second longitudinal edge of the wall panels forming the top course module.

Clause 10. The course module of clause 9, wherein the top course module includes a plurality of top plates, each top plate including: opposing first and second longitudinal edges; the first longitudinal edge opposing the second longitudinal edge; opposing first and second lateral edges; the first lateral edge opposing the second lateral edge; a first plate groove formed in the top plate adjacent the first longitudinal edge; a second plate groove formed in the top plate adjacent the second longitudinal edge; wherein each of the plurality of top plates is attached to the top course module via insertion of the tongues defined by the first longitudinal edge of the inner wall panels forming the top course module into the first plate grooves, and insertion of the tongues of the top plates defined by the second longitudinal edge of the outer wall panels forming the top course module into the second plate grooves.

Clause 11. The course module of clause 9, wherein the each of the top plates includes a structural opening configured to receive a vertical structural member through the structural opening.

Clause 12. The course module of clause 11, wherein: the structural opening is configured to receive a truss connector; the truss connector includes a first end and a second end; and the truss connector is configured to attach at the first end to the vertical structural member, and to attach at the second end to a truss member.

Clause 13. The course module of clause 1, wherein: the course module is one of a plurality of course modules including a wall course module and a bottom course module; wherein the wall course module is attached to the bottom course module via insertion of the panel tongue defined by the first longitudinal edges of the wall panels forming the bottom course module into the panel groove defined by the second longitudinal edge of the wall panels forming the wall course module.

Clause 14. The course module of clause 13, wherein the bottom course module includes a plurality of bottom plates, each bottom plate including: opposing first and second longitudinal edges; the first longitudinal edge opposing the second longitudinal edge; opposing first and second lateral edges; the first lateral edge opposing the second lateral edge; a first tongue extending from the bottom plate and positioned adjacent the first longitudinal edge; a second tongue extending from the bottom plate and positioned adjacent the second longitudinal edge; wherein each of the plurality of bottom plates is attached to the bottom course module via insertion of the first tongues of the bottom plates into the panel grooves defined by the second longitudinal edge of the inner wall panels forming the bottom course module, and insertion of the second tongues of the bottom plates into the panel grooves defined by the second longitudinal edge of the outer wall panels forming the bottom course module.

Clause 15. The course module of clause 14, wherein each of the bottom plates includes: a tab extending from the first lateral edge; and a tab receiver defined by the second lateral edge; and each bottom plate is connected to an adjacent bottom plate by insertion of the tab of the bottom plate into the tab receiver of the adjacent bottom plate.

Clause 16. The course module of clause 15, wherein: each of the bottom plates includes a lower connector; the lower connector is configured to receive a tie down system; and the tie down system is configured to attach the bottom plate to a foundation structure.

Clause 17. A modular wall building system including a plurality of course modules of any of clauses 1 to 16, the system comprising: wherein the plurality of course modules are layered to form a wall structure; each respective course module layered adjacent to another course module such that each course module is connected to the another course module by connection of the panel tongues of the wall panels of one of the respective course module and the another course module into the panel grooves of the wall panels of the other of the respective course module and the another course module to form the wall structure.

Clause 18. The modular wall building system of clause 17 including a bottom course module of any of clauses 1 to 16, the system further comprising; at least one wall course module; wherein the wall structure includes the at least one wall module layered on and connected to the bottom course module.

Clause 19. The modular wall building system of clause 18, further comprising: a bottom plate structure including a plurality of bottom plates; wherein the bottom course module is layered intermediate the bottom plate structure and the at least one wall course module.

Clause 20. The modular wall building system of clause 17 including a top course module of any of clauses 1 to 12, the system further comprising: at least one wall course module; wherein the wall structure includes the top course module layered on and connected to the at least one wall module.

Clause 21. The modular wall building system of clause 20, further comprising: a plurality of vertical structural members; wherein each vertical structural member is positioned intermediate the inner and outer wall panels of the layered course modules and is received by a plurality of panel connectors.

Clause 22. The modular wall building system of clause 20, further comprising a door module including a door header operatively connected to inner and outer door header panels; wherein each of the inner and outer door header panels is respectively attached to adjacent inner and outer wall panels.

Clause 23. A method for assembling a modular wall building system including a plurality of course modules of any of clauses 1 to 16, the method comprising: providing a plurality of course modules; layering a respective course module on to another course module; connecting each respective course module to the another course module via insertion of the panel tongues of the wall panels of one of the respective course module and the another course module into the panel grooves of the wall panels of the other of the respective course module and the another course module.

Clause 24. The method of clause 23, the modular wall building system including a bottom course module of any of clauses 1 to 16, the method further comprising: providing a bottom course module; providing at least one wall course module; layering the at least one wall module on to the bottom course module; and connecting the at least one wall module to the bottom course module via insertion of the panel tongues of the wall panels of one of the bottom course module into the panel grooves of the wall panels of the wall course module.

Clause 25. The method of clause 24, further comprising: providing a bottom plate structure including a plurality of bottom plates; layering the bottom course module intermediate the bottom plate structure and the at least one wall module; and attaching the bottom plate structure to the bottom course module.

Clause 26. The method of clause 23, the modular wall building system including a top course module of any of clauses 1 to 12, the method further comprising: providing a top course module; providing at least one wall course module; layering the top course module on to the at least one wall module; and attaching the top course module to the at least one wall module.

Clause 27. The method of clause 26, further comprising: providing a plurality of vertical structural members; inserting each vertical structural member between the inner and outer wall panels of the plurality of course modules, via at least one panel connector disposed in each of the course modules.

Clause 28. The method of clause 26, further comprising: providing a door module including a door header and first and second door jambs; providing a course module including inner and outer door header panels configured to receive the door header; installing the door header to the inner and outer door header panels; and providing at least one course module including first and second jamb connectors disposed between the inner and outer wall panels; connecting the first door jamb to the first jamb connectors; and connecting the second door jamb to the second jamb connectors.

The invention claimed is:

1. A course module for a modular wall building system, each course module comprising:

at least one inner wall panel;

at least one outer wall panel;

wherein each of the inner wall panels and each of the outer wall panels comprises:

upper and lower receiving rails extending from an interior surface of the wall panel;

each of the receiving rails including a plurality of receiver holes;

a first longitudinal panel edge adjacent a first lateral panel edge;

a second longitudinal panel edge opposing the first longitudinal panel edge and adjacent a second lateral panel edge, the second lateral panel edge opposing the first lateral panel edge;

a panel tongue defined by the first longitudinal panel edge and the first lateral panel edge;

a panel groove extending from the second longitudinal panel edge and the second lateral panel edge;

wherein the panel tongue defined by the first lateral panel edge of a respective inner panel is inserted into the panel groove extending from the second lateral panel edge of an adjacent inner panel to define a panel joint therebetween connecting the respective and adjacent inner panels;

wherein the panel tongue defined by the first lateral panel edge of a respective outer panel is inserted into the panel groove extending from the second lateral panel edge of an adjacent outer panel to form a panel joint therebetween connecting the respective and adjacent outer panels;

panel connectors;

wherein each of the panel connectors comprises:

a first longitudinal connector edge positioned adjacent a first lateral connector edge;

a second longitudinal edge opposing the first longitudinal edge and positioned adjacent a second lateral connector edge, the second lateral connector edge opposing the first lateral connector edge;

a first plurality of connector pins extending from the panel connector and distributed along the first longitudinal connector edge;

a second plurality of connector pins extending from the panel connector and distributed along the second longitudinal connector edge;

wherein each of the first and second plurality of connector pins are configured to be received into the receiver holes of the receiving rail thereby attaching the panel connector to the receiving rail;

wherein each of the panel connectors are disposed between the inner wall panels and the outer wall panels and connected via the connector pins to the receiving rails such that each panel connector is at least one of:

an upper panel connector attached to the upper receiving rails of the respective and adjacent inner wall panels and to the upper receiving rails of the respective and adjacent outer wall panels; or a lower panel connector attached to the lower receiving rails of the respective and adjacent inner wall panels and to the lower receiving rails of the respective and adjacent outer wall panels;

wherein the upper panel connector is positioned such that:

the first longitudinal connector edge of the upper panel connector is connected to the upper receiving rails of the respective and adjacent inner panels such that the upper panel connector spans the first panel joint and connects the upper receiving rail of the first inner panel to the second inner panel; and the second longitudinal connector edge of the upper panel connector is connected to the upper receiving rails of the respective and adjacent outer panels such that the upper panel connector spans the second panel joint and connects the upper receiving rail of the first outer panel to the second outer panel; and wherein the lower panel connector is positioned such that:

the first longitudinal connector edge of the lower panel connector is connected to the lower receiving rails of the respective and adjacent inner panels such that the lower panel connector spans the first panel joint and connects the lower receiving rail of the first inner panel to the second inner panel;

the second longitudinal connector edge of the lower panel connector is connected to the lower receiving rails of the respective and adjacent outer panels such that the lower panel connector spans the second panel joint and connects the lower receiving rail of the first outer panel to the second outer panel.

2. The course module of claim 1, wherein the upper receiving rail is positioned adjacent to the first longitudinal panel edge and the lower receiving rail is positioned adjacent to the second longitudinal panel edge.

3. The course module of claim 2, wherein the upper receiving rail is parallel to the first longitudinal panel edge and the lower receiving rail is parallel to the second longitudinal panel edge.

4. The course module of claim 1, wherein the plurality of receiver holes are distributed longitudinally in the receiving rails.

5. The course module of claim 1, wherein each of the panel connectors includes a structural opening configured to receive a vertical structural member through the structural opening.

6. The course module of claim 1, wherein the panel connectors include a full length connector, a partial length connector, and a corner connector;

wherein the inner wall panels include inner full length panels, inner partial length panels, and inner corner panels;

wherein the outer wall panels include outer full length panels, outer partial length panels, and outer corner panels; and wherein the corner connector is attachable to the inner and outer corner panels to selectively attach the inner corner panel to the full length inner panel or the partial length inner panel, and to selectively attach the outer corner panel to the full length inner panel or the partial length inner panel.

7. The course module of claim 1, wherein the panel connectors include a jamb connector;

wherein the jamb connector includes a stiffening member positioned adjacent a first lateral edge of the jamb connector;

wherein the jamb connector is configured such that the stiffening member is attachable to a door jamb via a plurality of connectors pins extending from the stiffening member adjacent the first lateral edge of the jamb connector.

8. The course module of claim 1, further including a door header, wherein:

the inner wall panels include at least one inner header panel;

the outer wall panels include at least one outer header panel;

each of the inner and outer header panels includes an upper receiving rail adjacent a first longitudinal edge of the header panel;

each of the inner and outer header panels includes a first lower receiving rail adjacent a first lateral edge of the header panel and a second lower receiving rail adjacent a second lateral edge of the header panel; and each of the inner and outer header panels is configured to receive the door header between the first and second lower receiving rails.

9. The course module of claim 1, wherein:

the course module is one of a plurality of course modules including a wall course module and a top course module;

wherein the top course module is attached to the wall course module via insertion of the panel tongue defined by first longitudinal edges of the wall panels forming the wall course module into the panel groove defined by second longitudinal edges of the wall panels forming the top course module.

10. The course module of claim 9, wherein the top course module includes a plurality of top plates, each top plate including:

opposing first and second longitudinal edges;

the first longitudinal edge opposing the second longitudinal edge;

opposing first and second lateral edges;

the first lateral edge opposing the second lateral edge;

a first plate groove formed in the top plate adjacent the first longitudinal edge;

a second plate groove formed in the top plate adjacent the second longitudinal edge;

wherein each of the plurality of top plates is attached to the top course module via insertion of the tongues defined by the first longitudinal edge of the inner wall panels forming the top course module into the first plate grooves, and insertion of the tongues of the top plates defined by the second longitudinal edge of the outer wall panels forming the top course module into the second plate grooves.

11. The course module of claim 9, wherein the each of the top plates includes a structural opening configured to receive a vertical structural member through the structural opening.

12. The course module of claim 11, wherein:

the structural opening is configured to receive a truss connector;

the truss connector includes a first end and a second end; and the truss connector is configured to attach at the first end to the vertical structural member, and to attach at the second end to a truss member.

13. The course module of claim 1, wherein:

the course module is one of a plurality of course modules including a wall course module and a bottom course module;

wherein the wall course module is attached to the bottom course module via insertion of the panel tongues defined by the first longitudinal edges of the wall panels forming the bottom course module into the panel grooves extending from the second longitudinal edges of the wall panels forming the wall course module.

14. The course module of claim 13, wherein the bottom course module includes a plurality of bottom plates, each bottom plate including:

opposing first and second longitudinal edges;

the first longitudinal edge opposing the second longitudinal edge;

opposing first and second lateral edges;

the first lateral edge opposing the second lateral edge;

a first tongue extending from the bottom plate and positioned adjacent the first longitudinal edge;

a second tongue extending from the bottom plate and positioned adjacent the second longitudinal edge;

wherein each of the plurality of bottom plates is attached to the bottom course module via insertion of the first tongues of the bottom plates into the panel grooves defined by the second longitudinal edge of the inner wall panels forming the bottom course module, and insertion of the second tongues of the bottom plates into the panel grooves defined by the second longitudinal edge of the outer wall panels forming the bottom course module.

15. The course module of claim 14, wherein each of the bottom plates includes:

a tab extending from the first lateral edge; and a tab receiver defined by the second lateral edge; and each bottom plate is connected to an adjacent bottom plate by insertion of the tab of the bottom plate into the tab receiver of the adjacent bottom plate.

16. The course module of claim 15, wherein:

each of the bottom plates includes a lower connector;

the lower connector is configured to receive a tie down system; and the tie down system is configured to attach the bottom plate to a foundation structure.

17. A modular wall building system comprising:

a plurality of course modules;

each course module comprising:

at least one inner wall panel;

at least one outer wall panel;

wherein each of the inner wall panels and each of the outer wall panels comprises:

upper and lower receiving rails extending from an interior surface of the wall panel;

each of the receiving rails including a plurality of receiver holes;

a first longitudinal panel edge adjacent a first lateral panel edge;

a second longitudinal panel edge opposing the first longitudinal panel edge and adjacent a second lateral panel edge, the second lateral panel edge opposing the first lateral panel edge;

a panel tongue defined by the first longitudinal panel edge and the first lateral panel edge;

a panel groove extending from the second longitudinal panel edge and the second lateral panel edge;

wherein the panel tongue defined by the first lateral panel edge of a respective inner panel is inserted into the panel groove extending from the second lateral panel edge of an adjacent inner panel to define a panel joint therebetween connecting the respective and adjacent inner panels;

wherein the panel tongue defined by the first lateral panel edge of a respective outer panel is inserted into the panel groove extending from the second lateral panel edge of an adjacent outer panel to form a panel joint therebetween connecting the respective and adjacent outer panels;

panel connectors;

wherein each of the panel connectors comprises:

a first longitudinal connector edge positioned adjacent a first lateral connector edge;

a second longitudinal edge opposing the first longitudinal edge and positioned adjacent a second lateral connector edge, the second lateral connector edge opposing the first lateral connector edge;

a first plurality of connector pins extending from the panel connector and distributed along the first longitudinal connector edge;

a second plurality of connector pins extending from the panel connector and distributed along the second longitudinal connector edge;

wherein each of the first and second plurality of connector pins are configured to be received into the receiver holes of the receiving rail thereby attaching the panel connector to the receiving rail;

wherein each of the panel connectors are disposed between the inner wall panels and the outer wall panels and connected via the connector pins to the receiving rails such that each panel connector is at least one of:

an upper panel connector attached to the upper receiving rails of the respective and adjacent inner wall panels and to the upper receiving rails of the respective and adjacent outer wall panels; or a lower panel connector attached to the lower receiving rails of the respective and adjacent inner wall panels and to the lower receiving rails of the respective and adjacent outer wall panels;

wherein the upper panel connector is positioned such that:

the first longitudinal connector edge of the upper panel connector is connected to the upper receiving rails of the respective and adjacent inner panels such that the upper panel connector spans the first panel joint and connects the upper receiving rail of the first inner panel to the second inner panel; and the second longitudinal connector edge of the upper panel connector is connected to the upper receiving rails of the respective and adjacent outer panels such that the upper panel connector spans the second panel joint and connects the upper receiving rail of the first outer panel to the second outer panel; and wherein the lower panel connector is positioned such that:

the first longitudinal connector edge of the lower panel connector is connected to the lower receiving rails of the respective and adjacent inner panels such that the lower panel connector spans the first panel joint and connects the lower receiving rail of the first inner panel to the second inner panel;

the second longitudinal connector edge of the lower panel connector is connected to the lower receiving rails of the respective and adjacent outer panels such that the lower panel connector spans the second panel joint and connects the lower receiving rail of the first outer panel to the second outer panel;

wherein the plurality of course modules are layered to form a wall structure;

each respective course module layered adjacent to another course module such that each course module is connected to the another course module by connection of the panel tongues of the wall panels of one of the respective course module and the another course module into the panel grooves of the wall panels of the other of the respective course module and the another course module to form the wall structure.

18. The modular wall building system of claim 17, further comprising;

at least one wall course module;

wherein the wall structure includes the at least one wall course module layered on and connected to a bottom course module.

19. The modular wall building system of claim 18, further comprising:

a bottom plate structure including a plurality of bottom plates;

wherein the bottom course module is layered intermediate the bottom plate structure and the at least one wall course module.

20. The modular wall building system of claim 17, the system further comprising:

at least one wall course module;

wherein the wall structure includes the top course module layered on and connected to the at least one wall module.

21. The modular wall building system of claim 20, further comprising:

a plurality of vertical structural members;

wherein each vertical structural member is positioned intermediate the inner and outer wall panels of the layered course modules and is received by a plurality of panel connectors.

22. The modular wall building system of claim 20, further comprising a door module including a door header operatively connected to inner and outer door header panels; wherein each of the inner and outer door header panels is respectively attached to adjacent inner and outer wall panels.

23. A method for assembling a modular wall building system, the method comprising:

providing a plurality of course modules;

wherein each of the course modules comprises:

at least one inner wall panel;

at least one outer wall panel;

wherein each of the inner wall panels and each of the outer wall panels comprises:

upper and lower receiving rails extending from an interior surface of the wall panel;

each of the receiving rails including a plurality of receiver holes;

a first longitudinal panel edge adjacent a first lateral panel edge;

a second longitudinal panel edge opposing the first longitudinal panel edge and adjacent a second lateral panel edge, the second lateral panel edge opposing the first lateral panel edge;

a panel tongue defined by the first longitudinal panel edge and the first lateral panel edge;

a panel groove extending from the second longitudinal panel edge and the second lateral panel edge;

wherein the panel tongue defined by the first lateral panel edge of a respective inner panel is inserted into the panel groove extending from the second lateral panel edge of an adjacent inner panel to define a panel joint therebetween connecting the respective and adjacent inner panels;

wherein the panel tongue defined by the first lateral panel edge of a respective outer panel is inserted into the panel groove extending from the second lateral panel edge of an adjacent outer panel to form a panel joint therebetween connecting the respective and adjacent outer panels;

panel connectors;

wherein each of the panel connectors comprises:

a first longitudinal connector edge positioned adjacent a first lateral connector edge;

a second longitudinal edge opposing the first longitudinal edge and positioned adjacent a second lateral connector edge, the second lateral connector edge opposing the first lateral connector edge;

a first plurality of connector pins extending from the panel connector and distributed along the first longitudinal connector edge;

a second plurality of connector pins extending from the panel connector and distributed along the second longitudinal connector edge;

wherein each of the first and second plurality of connector pins are configured to be received into the receiver holes of the receiving rail thereby attaching the panel connector to the receiving rail;

wherein each of the panel connectors are disposed between the inner wall panels and the outer wall panels and connected via the connector pins to the receiving rails such that each panel connector is at least one of:

an upper panel connector attached to the upper receiving rails of the respective and adjacent inner wall panels and to the upper receiving rails of the respective and adjacent outer wall panels; or a lower panel connector attached to the lower receiving rails of the respective and adjacent inner wall panels and to the lower receiving rails of the respective and adjacent outer wall panels;

wherein the upper panel connector is positioned such that:

the first longitudinal connector edge of the upper panel connector is connected to the upper receiving rails of the respective and adjacent inner panels such that the upper panel connector spans the first panel joint and connects the upper receiving rail of the first inner panel to the second inner panel; and the second longitudinal connector edge of the upper panel connector is connected to the upper receiving rails of the respective and adjacent outer panels such that the upper panel connector spans the second panel joint and connects the upper receiving rail of the first outer panel to the second outer panel; and wherein the lower panel connector is positioned such that:

the first longitudinal connector edge of the lower panel connector is connected to the lower receiving rails of the respective and adjacent inner panels such that the lower panel connector spans the first panel joint and connects the lower receiving rail of the first inner panel to the second inner panel;

the second longitudinal connector edge of the lower panel connector is connected to the lower receiving rails of the respective and adjacent outer panels such that the lower panel connector spans the second panel joint and connects the lower receiving rail of the first outer panel to the second outer panel;

the method further comprising:

layering a respective course module on to another course module;

connecting each respective course module to the another course module via insertion of the panel tongues of the wall panels of one of the respective course module and the another course module into the panel grooves of the wall panels of the other of the respective course module and the another course module.

24. The method of claim 23, the method further comprising:

providing a bottom course module;

providing at least one wall course module;

layering the at least one wall module on to the bottom course module; and connecting the at least one wall module to the bottom course module via insertion of the panel tongues of the wall panels of one of the bottom course module into the panel grooves of the wall panels of the wall course module.

25. The method of claim 24, further comprising:

providing a bottom plate structure including a plurality of bottom plates;

layering the bottom course module intermediate the bottom plate structure and the at least one wall module; and attaching the bottom plate structure to the bottom course module.

26. The method of claim 23, the method further comprising:

providing a top course module;

providing at least one wall course module;

layering the top course module on to the at least one wall module; and attaching the top course module to the at least one wall module.

27. The method of claim 26, further comprising:

providing a plurality of vertical structural members;

inserting each vertical structural member between the inner and outer wall panels of the plurality of course modules, via at least one panel connector disposed in each of the course modules.

28. The method of claim 26, further comprising:

providing a door module including a door header and first and second door jambs;

providing a course module including inner and outer door header panels configured to receive the door header;

installing the door header to the inner and outer door header panels; and providing at least one course module including first and second jamb connectors disposed between the inner and outer wall panels;

connecting the first door jamb to the first jamb connectors; and connecting the second door jamb to the second jamb connectors.

* * * * *